US007770820B2

(12) United States Patent
Clearman et al.

(10) Patent No.: US 7,770,820 B2
(45) **Date of Patent: *Aug. 10, 2010**

(54) SPRAY APPARATUS AND DISPENSING TUBES THEREFORE

(75) Inventors: Joseph H. Clearman, Poulsbo, WA (US); Jack F. Clearman, Poulsbo, WA (US)

(73) Assignee: Moen Incorporated, North Olmsted, OH (US)

( * ) Notice: Subject to any disclaimer, the term of this patent is extended or adjusted under 35 U.S.C. 154(b) by 18 days.

This patent is subject to a terminal disclaimer.

(21) Appl. No.: 11/355,515

(22) Filed: Feb. 15, 2006

(65) Prior Publication Data

US 2006/0157590 A1 Jul. 20, 2006

Related U.S. Application Data

(63) Continuation-in-part of application No. 10/917,691, filed on Aug. 13, 2004, now Pat. No. 7,278,591.

(60) Provisional application No. 60/699,723, filed on Jul. 15, 2005.

(51) Int. Cl.
*B05B 3/02* (2006.01)
*B05B 1/34* (2006.01)

(52) U.S. Cl. ..... 239/222.11; 239/380; 239/381

(58) Field of Classification Search ..... 239/222.11, 239/222.13, 225.1, 214, 233, 237, 242, 255, 239/263, 380, 381, 589.1, DIG. 12
See application file for complete search history.

(56) References Cited

U.S. PATENT DOCUMENTS 2,639,191 A 5/1953 Hruby, Jr.

(Continued)

FOREIGN PATENT DOCUMENTS

DE 3044310 A1 6/1982

(Continued)

OTHER PUBLICATIONS

PCT International Search Report; PCT/DE 99/02640; Oct. 2, 2000; 3 pages.

(Continued)

*Primary Examiner*—Davis Hwu
(74) *Attorney, Agent, or Firm*—Calfee, Halter & Griswold LLP

(57) ABSTRACT

A spray apparatus comprises a housing having a fluid inlet, a plurality of tubes for dispensing fluid from the housing, and an integrating member operatively coupled to at least a subset of the plurality of tubes for effecting coordinated movement of the coupled tubes in response to movement of the integrating member. An actuator, such as a turbine or an adjustable control ring, is employed for inducing movement of the integrating member. The dispensing tubes may be flexible so as to allow for easy adjustment of the fluid-dispensing direction or shape by the application of a lateral force at one or more locations along the length of the tubes. The flexibility also facilitates amplified direction/shape changes (compared to rigid dispensing tubes) in the dispensed fluid streams, e.g., when the tubes are subjected to a lateral force on one side and an opposing pivoting force (axially offset from the lateral force) on the other side.

18 Claims, 71 Drawing Sheets

U.S. PATENT DOCUMENTS

| | | | | |
|---|---|---|---|---|
| 2,848,276 | A | | 8/1958 | Clearman |
| 3,009,648 | A | | 11/1961 | Hait |
| 3,091,400 | A | | 5/1963 | Aubert |
| 3,357,643 | A | | 12/1967 | Kruby, Jr. |
| 3,691,584 | A | | 9/1972 | Landers |
| 3,791,584 | A | | 2/1974 | Drew et al. |
| 3,805,319 | A | | 4/1974 | Evans |
| 3,880,357 | A | | 4/1975 | Baisch |
| 3,929,287 | A | | 12/1975 | Givier et al. |
| 4,018,385 | A | | 4/1977 | Bruno |
| 4,068,801 | A | | 1/1978 | Leutheuser |
| 4,073,438 | A | | 2/1978 | Meyer |
| 4,117,979 | A | | 10/1978 | Lagarelli et al. |
| 4,340,177 | A | | 7/1982 | Huber |
| 4,420,951 | A | | 12/1983 | Clearman et al. |
| 4,487,368 | A | | 12/1984 | Clearman |
| 4,629,404 | A | | 12/1986 | Raymond |
| 4,671,462 | A | | 6/1987 | Badria |
| 4,773,594 | A | | 9/1988 | Clearman |
| 4,828,179 | A | | 5/1989 | Garner |
| 4,838,486 | A | | 6/1989 | Finkbeiner |
| 4,944,457 | A | | 7/1990 | Brewer |
| 5,108,035 | A | | 4/1992 | Friedrichs |
| 5,172,862 | A | | 12/1992 | Heimann et al. |
| 5,217,166 | A | | 6/1993 | Schulze et al. |
| 5,248,092 | A | | 9/1993 | Rankin |
| 5,332,155 | A | | 7/1994 | Jüger |
| 5,375,768 | A | * | 12/1994 | Clark ..... 239/210 |
| 5,397,064 | A | * | 3/1995 | Heitzman ..... 239/99 |
| 5,439,174 | A | | 8/1995 | Sweet |
| 5,467,927 | A | | 11/1995 | Lee |
| 5,551,635 | A | | 9/1996 | Jüger |
| 5,577,664 | A | | 11/1996 | Heitzman |
| 5,588,595 | A | | 12/1996 | Sweet et al. |
| 5,598,975 | A | | 2/1997 | Jüger |
| 5,647,537 | A | | 7/1997 | Bergmann |
| 5,671,885 | A | | 9/1997 | Davisson |
| 5,704,547 | A | | 1/1998 | Golan et al. |
| 6,092,739 | A | | 7/2000 | Clearman |
| 6,186,414 | B1 | | 2/2001 | Clearman et al. |
| 6,199,771 | B1 | | 3/2001 | Clearman et al. |
| 6,254,013 | B1 | | 7/2001 | Clearman et al. |
| 6,254,014 | B1 | | 7/2001 | Clearman et al. |
| 6,360,965 | B1 | | 3/2002 | Clearman et al. |
| 6,360,967 | B1 | | 3/2002 | Schorn |
| 6,439,477 | B1 | | 8/2002 | Sweet et al. |
| 6,454,186 | B2 | | 9/2002 | Haverstraw et al. |
| 6,527,204 | B2 | | 3/2003 | Heitzman |
| 6,533,194 | B2 | | 3/2003 | Marsh et al. |
| 6,659,372 | B2 | | 12/2003 | Marsh et al. |
| 6,719,218 | B2 | | 4/2004 | Cool et al. |
| 7,111,800 | B2 | | 9/2006 | Berning et al. |
| 2003/0006304 | A1 | | 1/2003 | Cool et al. |
| 2004/0164189 | A1 | | 8/2004 | Berning |

FOREIGN PATENT DOCUMENTS

| | | | |
|---|---|---|---|
| EP | 0 719 587 | | 7/1996 |
| EP | 1 357 235 | A1 | 10/2003 |
| FR | 2 568 120 | A | 1/1986 |
| WO | WO 00/03810 | A | 1/2000 |
| WO | 00/10720 | A1 | 3/2000 |
| WO | WO 00/10720 | A | 3/2000 |
| WO | 01/66263 | A1 | 9/2001 |
| WO | WO 01/66263 | A1 | 9/2001 |

OTHER PUBLICATIONS

PCT International Search Report; PCT/US2005/028675; filing date Aug. 13, 2005; 6 pages.

Written Opinion of the International Search Authority for PCT/US2005/028675 (WO 2006/020832 A1)—Feb. 13, 2007.

International Preliminary Report on Patentability Chapter I for PCT/US2005/028675 (WO 2006/020832 A1)—Feb. 13, 2007.

International Search Report for PCT/US2006/005695 (WO 2007/011424 A1)—Jan. 25, 2007.

Written Opinion of the International Search Authority for PCT/US2006/005695 (WO 2007/011424 A1)—Jan. 15, 2008.

International Preliminary Report on Patentability Chapter I for PCT/US2006/005695 (WO 2007/011424 A1)—Jan. 16, 2008.

* cited by examiner

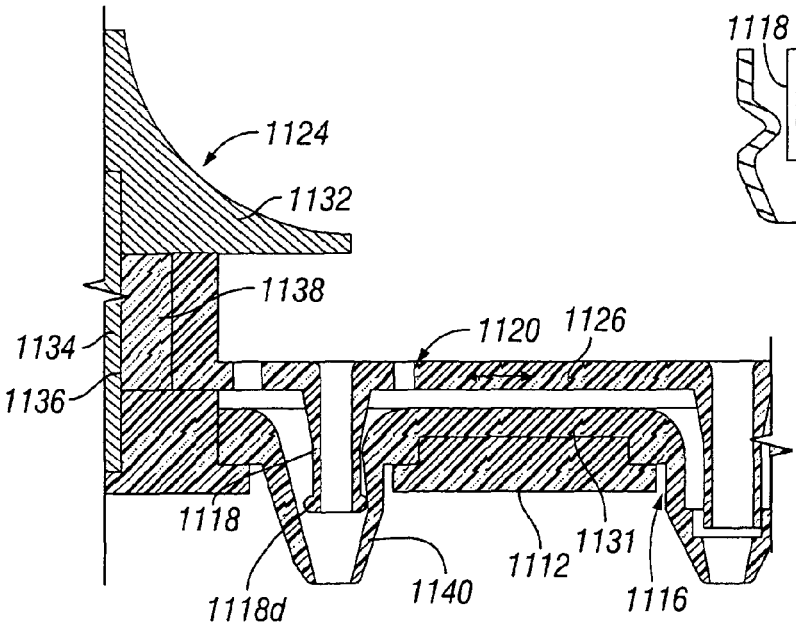
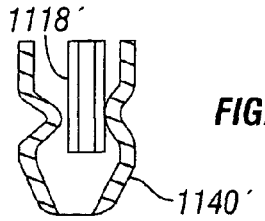
FIG. 11A
FIG. 11
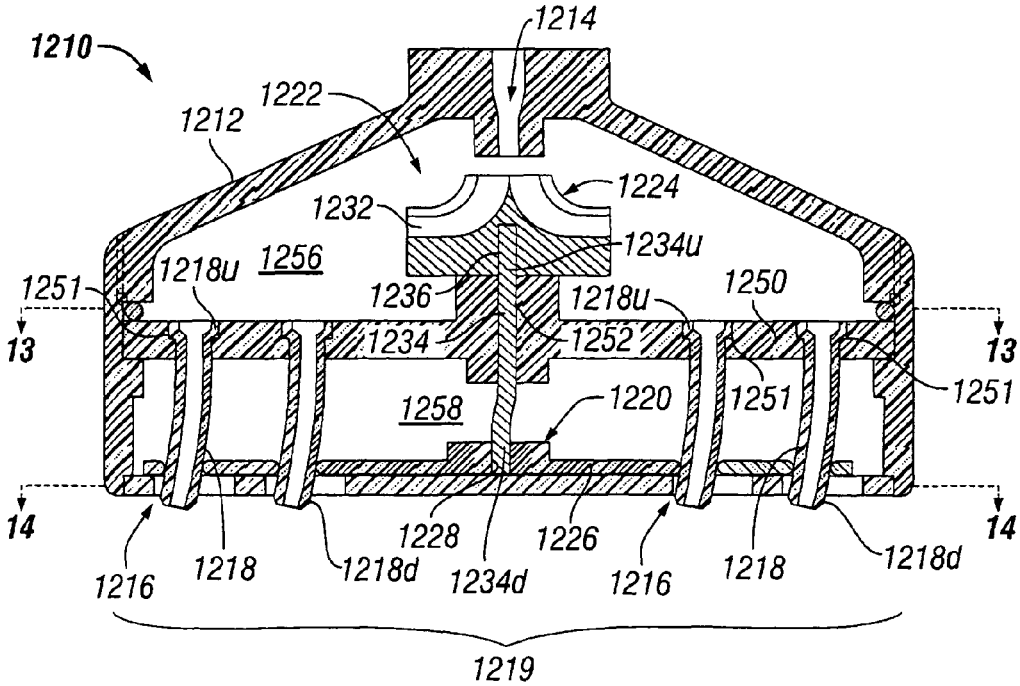
FIG.12

SPRAY APPARATUS AND DISPENSING TUBES THEREFORE

CROSS-REFERENCE TO RELATED APPLICATION

This application claims priority to U.S. patent application Ser. No. 10/917,691, filed on Aug. 13, 2004 now U.S. Pat. No. 7,278,591, and to U.S. Provisional Patent Application Ser. No. 60/699,723, filed on Jul. 15, 2005, the entire contents of which applications are hereby incorporated herein by reference.

BACKGROUND OF THE INVENTION

1. Field of the Invention

The present invention relates to devices for distributing liquids such as water in desirable showering streams, such as showerheads and faucets.

2. Background of the Related Art

Showerheads are commercially available in numerous designs and configurations. While many showerheads are designed and sold for their decorative styling, there are many different showerhead mechanisms that are intended to improve or change one or more characteristic of the resulting water spray pattern. A particular spray pattern may be described by the characteristics of spray width, spray distribution or trajectory, spray velocity, and the like. Furthermore, the spray pattern may be adapted or designed for various purposes, including a more pleasant feeling to the skin, better performance at rinsing, massaging of muscles, and conservation of water, just to name a few.

The vast majority of showerheads may be categorized as being either stationary or oscillating, and having either fixed or adjustable openings or jets. Stationary showerheads with fixed jets are the simplest of all showerheads, consisting essentially of a water chamber and one or more jets directed to produce a constant pattern. Stationary showerheads with adjustable jets are typically of a similar construction, except that some may allow adjustment of the jet direction, jet opening size and/or the number of jets utilized. For example, a showerhead currently used in typical new residential home construction provides a stationary spray housing having a plurality of spray jets disposed in a circular pattern, wherein the velocity of the spray is adjustable by manually rotating an adjustment ring relative to the spray housing.

One example of a stationary showerhead is described in U.S. Pat. No. 5,172,862 (Heimann et al.). The Heimann showerhead has a body with a single fluid inlet and a plurality of fluid outlets. The fluid outlets are provided in the form of a plurality of flexible tubular extensions positioned in respective perforations of a lower elastomeric wall of the showerhead body. A movable disk or plate is provided to selectively deform or flick the flexible tubular extensions so as to "flake off" lime deposits that may have adhered to, or built up within, the extensions during operation. The movement of the disk is purely a manual operation, and the plate is not adapted to alter the direction, shape, or spray pattern of the water flow.

These stationary showerheads cause water to flow through its apertures and contact essentially the same points on a user's body in a repetitive fashion. Therefore, the user feels a stream of water continuously on the same area and, particularly at high pressures or flow rates, the user may sense that the water is drilling into the body, thus diminishing the effect derived from such a shower head. In order to reduce this undesirable feeling, various attempts have been made to provide oscillating showerheads.

Examples of oscillating spray heads include the showerheads disclosed in U.S. Pat. No. 3,791,584 (Drew et al.), U.S. Pat. No. 3,880,357 (Baisch), U.S. Pat. No. 4,018,385 (Bruno), U.S. Pat. No. 4,944,457 (Brewer), U.S. Pat. No. 5,397,064 (Heitzman), U.S. Pat. No. 5,467,927 (Lee), U.S. Pat. No. 5,704,547 (Golan et al.), and U.S. Pat. No. 6,360,967 (Schorn). U.S. Pat. No. 4,944,457 (Brewer) discloses an oscillating showerhead that uses an impeller wheel mounted to a gearbox assembly that produces an oscillating movement of the nozzle. Similarly, U.S. Pat. No. 5,397,064 (Heitzman) discloses a showerhead having a rotary valve member driven by a turbine wheel and gear reducer for cycling the flow rate through the housing between high and low flow rates. Both of these showerheads require extremely complex mechanical structures in order to accomplish the desired motion. Consequently, these mechanisms are prone to failure due to wear on various parts and mineral deposits throughout the structure.

U.S. Pat. No. 3,691,584 (Drew et al.) also discloses an oscillating showerhead, but utilizes a nozzle mounted on a stem that rotates and pivots under forces places on it by water entering through radially-disposed slots into a chamber around a stem. Although this showerhead is simpler than those of Brewer and Heitzman, it still includes a large number of piece requiring precise dimensions and numerous connections between pieces. Furthermore, the Drew showerhead relies upon small openings for water passageways and is subject to mineral buildup and plugging with particles.

U.S. Pat. No. 5,467,927 (Lee) discloses a showerhead with an apparatus having a plurality of blades designed to produce vibration and pulsation. One blade is provided with an eccentric weight that causes vibration and an opposite blade is provided with a front flange that causes pulsation by momentarily blocking the water jets. Again, the construction of this showerhead is rather complex and its narrow passageways are subject to mineral buildup and plugging with particulates.

U.S. Pat. No. 5,704,547 (Golan et al.) discloses a showerhead including a housing, a turbine and a fluid exit body, such that fluid flowing through the turbine causes rotation of the turbine. The rotating turbine can be used to cause rotation of the fluid exit body and/or a side-to-side rocking motion in a pendulum-like manner.

U.S. Pat. No. 6,360,967 (Schorn) discloses a showerhead having a turbine wheel that rotates a plurality of gear disks to induce wobbling of a plurality of nozzle elements. The turbine wheel and gear disks are rotated continuously about their axes while fluid flows through the showerhead, limiting the number of nozzle elements that can be practically employed and further limiting the incorporation of shower-adjustment features.

Therefore, there is a need for an improved apparatus that delivers water in a continually changing manner, such as wobbling, orbiting, rotating, and the like. It would be desirable if the apparatus provided a simple design and construction with minimal restriction to water flow and open conduits for reducing the possibility or extent of plugging. It would be further desirable if the apparatus employed a design that facilitated easy cleaning of the fluid discharge nozzles or jets, in the event that full or partial plugging (e.g., by mineral depositing) did occur. It would be further desirable if the apparatus could be housed within a smaller housing thereby providing a higher degree of design flexibility. Ultimately, it would be desirable to have a spin driver that would operate regardless of the extent to which the spin driver was allowed to tilt.

Most spray heads, whether they are stationary or oscillating, deliver fluids in a predetermined manner. The user is not allowed to effect changes in the fluid delivery characteristics of the spray head, except perhaps increasing or decreasing the fluid flow rate by turning the control valve that communicates fluid to the spray head. One such spray head which allows user adjustments between a vibrating (i.e., massage) mode and a non-vibrating mode is disclosed in U.S. Pat. No. 5,467,927 (Lee). However, spray heads that allow adjustment of other fluid delivery characteristics have not been available. Another such spray head which allows user adjustments concerning the shape of the resulting spray pattern is disclosed in U.S. Pat. No. 5,577,664 (Heitzman, also mentioned above). The Heitzman showerhead employs a control ring for selective rotation of a pair of cam rings, which ultimately produces twisting of bundled pluralities of orifice tubes to affect a desired spray width.

WO 00/10720 discloses a shower head comprising a water supply line, nozzles arranged in a nozzle plate, and nozzle channels extending inside said nozzles. Each nozzle channel produces a jet of water directed toward the user's body. The nozzle for producing an impingement line of the jet of water directed toward the exposed body part is connected to a propulsion device configured as a water motor. The nozzles are arranged such that they can move in relation to the nozzle plate, and the ends of a plurality of nozzles located inside the shower head are displaced in relation to the nozzle plate by the water motor which moves the nozzles together. The nozzles are an integral part of a connection plate and are held together by the connection plate. The connection plate ensures sealing of the nozzle plate against the water chamber. The nozzles of WO 00/10720 are connected and sealed together near the distal end of the nozzles.

Therefore, there is also a need for an improved spray head or showerhead that allows a user to adjust or control the delivery of fluid. Characteristics of the fluid delivery that would be particularly desirable to adjust include the spray width, the spray velocity and spray flow rate. It would be desirable if the spray head were able to deliver water in the desired manner, even at low pressures or flow rates dictated or desirable for water conservation. It would be further desirable if the spray head provided a simple design and construction with minimal restriction to water flow, and enhanced fidelity such that each of a plurality of discharge nozzles or jets could be controlled.

A need further exists for a spray apparatus that facilitates direction control of its spray stream, or shower, without the need for a ball- or swivel-mounted housing. A related need exists for fluid-dispensing tubes (suitable for a spray apparatus) having particular flexing characteristics that may be employed to advantage. A need further exists for such an apparatus that is suitable for mounting within a wall, so as to conserve space, e.g., within an enclosed shower stall.

DEFINITIONS

Certain terms are defined throughout this description as they are first used, while certain other terms used in this description are defined below:

"Nutating" means oscillatory movement by the axis of a rotating body, e.g., wobbling.

"Orbiting" means revolving in a generally circular or elliptical path.

"Oscillating" means to move or travel back and forth between two points by one or more various paths, and may include, e.g., at least one of circular, elliptical, and linear movement.

"Planar" means lying in a substantially flat or level surface, framework, or structure, and may include, e.g., plates, boards, lattices, and screens, but some degree of curvature or irregularity is allowed.

"Rotary" means characterized by turning or moving about an axis or a center, and may include, e.g., spinning, nutating, or a combination thereof.

"Spinning" means turning on or around an axis.

"Wobbling" means to move or proceed with an irregular rocking or staggering motion, and includes the motion of a circular member rolling on its edge along a surface following a circular path.

SUMMARY OF THE INVENTION

The above-described needs, problems, and deficiencies in the art, as well as others, are addressed by the present invention in its various aspects and embodiments.

In one aspect, the present invention provides a spray apparatus, including a housing having a fluid inlet and a plurality of fluid outlets, and a turbine carried for rotary movement within the housing under fluid flow from the fluid inlet to one or more of the fluid outlets. An integrating member is operatively coupled to the turbine for oscillatory movement relative to the housing under rotary movement of the turbine, and a plurality of tubes are each disposed in one of the fluid outlets for dispensing fluid from the housing. At least a subset of the plurality of tubes are operatively-coupled to the integrating member for coordinated movement of the coupled tubes in the respective plurality of fluid outlets.

It is presently preferred that at least a portion of the housing is substantially cylindrical. In various embodiments, the fluid inlet of the housing directs fluid towards the turbine in a direction selected from axial, radial, tangential, and combinations thereof.

In particular embodiments of the inventive spray apparatus, the integrating member is operatively coupled to the turbine for oscillatory movement within the housing under rotary movement of the turbine. The rotary movement of the turbine may include spinning, nutating, or a combination thereof. The nutating of the turbine may include a wobbling motion. The oscillatory movement of the integrating member may include at least one of circular, elliptical, and linear movement.

In particular embodiments of the inventive spray apparatus, the fluid-dispensing tubes may be rigid or flexible, with the flexibility being preferably provided by manufacturing the tubes of materials including a natural polymer, a synthetic polymer, or a combination thereof.

The subset of the plurality of tubes that are operatively-coupled to the integrating member are, in some embodiments, oriented with respect to one another in a configuration that is parallel, divergent, convergent, or a combination thereof.

In various embodiments of the inventive spray apparatus, the turbine includes a head having at least two angled or angled or curved vanes on an upper surface thereof and being radially symmetrical.

In particular embodiments, the integrating member includes a first structural member, referred to frequently throughout as a planar member, having a substantially central orifice. It will be appreciated by those skilled in the art, however, that the integrating member need not be characterized by a planar member (i.e., curved-shape members, among others, may also be used). The turbine includes a head having at least one angled or angled or curved vane on an upper surface thereof, and a shaft depending from the turbine head and extending at least partially through the orifice in the first planar member for operatively coupling the integrating member to the turbine. The turbine shaft is preferably disposed in an opening formed through a lower portion of the turbine head, and is preferably fixed for rotation with the turbine head. Alternatively, the turbine shaft may be integrally formed with the turbine head.

In certain of the fixed-shaft embodiments, the spray apparatus further includes a second planar member sealingly mounted against rotation within the housing between the integrating member and the fluid inlet. The second planar member includes a substantially central orifice within which the turbine shaft is carried for rotation, a plurality of first orifices therein, and a plurality of second orifices therein. An upstream portion of each of the coupled tubes is affixed in one of the first orifices of the second planar member, and a downstream portion of each of the coupled tubes extends at least partially through one of the fluid outlets. Thus, fluid flowing into the fluid inlet is directed through the coupled tubes via the first orifices.

In some of these certain embodiments, a second subset of the tubes are not coupled to the integrating member. Each of the non-coupled tubes has an upstream portion affixed in one of the second orifices of the second planar member, and a downstream portion that extends at least partially through one of the fluid outlets. Accordingly, fluid flowing into the fluid inlet is directed through the non-coupled tubes via the second orifices. The housing preferably defines a flow passage for selectively communicating with the first and second orifices of the second planar member. Accordingly, the spray apparatus of these certain embodiments preferably further includes a valve assembly for directing fluid in the flow passage to either: the first orifices of the second planar member; the second orifices of the second planar member; or a combination thereof.

The turbine shaft may be equipped with a cam portion positioned beneath and/or opposite the turbine head such that the cam portion rotates with the turbine head. The cam portion is carried within the orifice of the first planar member. The cam portion may optionally be integral with the turbine head.

In a particular one of these embodiments, the cam portion has a sloping vertical profile, and further includes a means for adjusting the elevation of the integrating member relative to the cam portion so as to induce engagement of the integrating member with varying elevations of the sloping vertical profile of the cam portion. This permits the range of oscillating of the integrating member resulting from rotation of the turbine to be adjusted.

In certain of these embodiments, the shaft is disposed for nutation within the orifice of the integrating member.

In other of these embodiments, the turbine further includes an eccentric or cam portion carried about the shaft for rotation within the orifice of the integrating member, whereby spinning of the turbine about the axis of the shaft results in nutation of the eccentric/cam portion of the turbine.

In still other of these embodiments, the shaft is a crankshaft having a first end portion mounted to the turbine head and a second end portion rotatably carried within the substantially central orifice in the first planar member. The second end portion of the crankshaft is axially offset from the axis of the crankshaft by a bend in the crankshaft intermediate the first and second end portions. The crankshaft is supported for rotation about a central axis within the housing by a second planar member sealingly mounted against rotation within the housing between the integrating member and the turbine head. The second planar member preferably includes a substantially central orifice within which the crankshaft is carried for rotation, and a plurality of noncentral orifices therein. An upstream portion of each of the tubes is affixed in one of the noncentral orifices of the second planar member, and a downstream portion of each of the tubes extends at least partially through one of the fluid outlets. Accordingly, fluid flowing into the fluid inlet is directed through the tubes via the noncentral orifices.

In a particular one of these embodiments, the inventive spray apparatus further includes an adjustable manifold disposed within the housing above the second planar member for directing fluid from the inlet to either: an outer sub-plurality of the noncentral orifices of the second planar member; an inner sub-plurality of the noncentral orifices of the second planar member; or a combination thereof.

In certain of these embodiments, the turbine includes an eccentric member carried about the turbine shaft opposite the turbine head such that the eccentric member rotates with the turbine head. The eccentric member is preferably carried within the orifice of the first planar member, and is nutated by rotation of the turbine head to induce orbiting of the integrating member.

In a particular one of these embodiments, a means for selectively pointing downstream end portions of the plurality of tubes is further provided. Accordingly, each of the coupled tubes preferably includes an elastomeric material. The pointing means preferably includes a set of spaced-apart protuberances on an outer surface of each of the coupled tubes defining a side recess between the protuberances. Each of the coupled tubes is disposed in one of a plurality of noncentral orifices formed in the first planar member, in such a manner that the first planar member is connected to the plurality of coupled tubes via the side recesses. An internally-threaded sleeve is carried for rotation about an externally-threaded sidewall portion of the housing. The sleeve has an annular groove formed in an inner surface thereof within which the first planar member is circumferentially carried. Thus, rotation of the sleeve induces vertical movement thereof that applies a vertical force to the coupled tubes at the respective side recesses.

As mentioned previously, particular embodiments of the inventive spray apparatus further include a second planar member sealingly mounted against rotation within the housing between the integrating member and the fluid inlet. The second planar member preferably includes a substantially central orifice within which the turbine shaft is carried for rotation, and a plurality of noncentral orifices therein. An upstream portion of each of the tubes is affixed in one of the noncentral orifices of the second planar member and a downstream portion of each of the tubes extends at least partially through one of the fluid outlets. Accordingly, fluid flowing into the fluid inlet is directed through the tubes via the noncentral orifices.

In certain of these embodiments, the housing defines a flow passage for communicating with the noncentral orifices of the second planar member, and the spray apparatus further includes a valve assembly for directing fluid in the flow passage to either: an outer sub-plurality of the noncentral orifices of the second planar member; an inner sub-plurality of the noncentral orifices of the second planar member; or a combination thereof. The valve assembly preferably includes a stop valve having a movable stem for closing portions of the flow passage, and an actuator for moving the stem as desired to direct the fluid flow.

In some of these flow-passage embodiments, the inventive spray apparatus further includes a third planar member for removably covering the inner sub-plurality of noncentral orifices of the second planar member. The third planar member has a sloped rim about at least a portion thereof. The movable valve stem is preferably equipped with a plug and a distal end, such that movement of the valve stem in a radially-inward direction results in the plug closing off a portion of the fluid passage communicating fluid to the outer sub-plurality of noncentral orifices of the second planar member. Movement of the valve stem in a radially-inward direction preferably results in the distal valve stem end engaging the sloped rim so as to remove the third planar member from the inner sub-plurality of noncentral orifices of the second planar member, prior to the plug closing off a portion of the fluid passage communicating fluid to the outer sub-plurality of noncentral orifices of the second planar member.

In a particular embodiment of the inventive spray apparatus, the integrating member includes stacked complementary upper and lower plates each having a plurality of slots therein. The slots of the upper plate overlie and are conversely oriented to respective slots of the lower plate, so as to effect a plurality of common constricted slot areas through the upper and lower plates for engaging the respective coupled fluid-dispensing tubes by the extension of portions of the respective coupled tubes through the common slot areas. Preferably, at least one of the complementary plates is rotatable with respect to the other of the complementary plates for moving the coupled tubes inwardly or outwardly with respect to the central axis.

Particular embodiments of the inventive spray apparatus include an additional planar member supported for limited rotation about the central axis within the housing. The additional planar member includes a plurality of noncentral angularly-oriented slots for engaging portions of the respective coupled fluid-dispensing tubes intermediate the downstream and upstream portions thereof by the extension of the coupled tube portions through the plurality of noncentral slots of the additional planar member. The additional planar member is rotatable with respect to the housing for moving the coupled tube portions inwardly or outwardly with respect to the central axis. This rotation is preferably achieved using an actuator carried on the housing.

In a particular embodiment of the inventive spray apparatus, the turbine shaft is carried in the orifices of the integrating member and the turbine such that the turbine is rotationally supported by the integrating member.

In particular embodiments of the inventive spray apparatus, the integrating member engages each of the coupled tubes at a similar location on each tube. The engagement location may be: at or near a downstream portion of each coupled tube; intermediate downstream and upstream portions of each coupled tube; or at or near an upstream portion of each coupled tube.

In the latter case, the integrating member preferably includes a plurality of orifices therein, and an upstream portion of each of the coupled tubes is affixed in one of the orifices of the integrating member. In this case, it is also preferable that a downstream portion of each of the tubes extends at least partially through one of the outlets, and that each of the outlets is equipped with an O-ring through which a portion of each of the tubes intermediate the upstream and downstream portions is pivotally carried. A plurality of sleeves are preferably each fitted about one of the tubes intermediate the integrating member and the outlet through which the tube extends.

It is further preferred that the oscillating of the integrating member effects a coordinated oscillating of the downstream portion of each of the coupled tubes. Such oscillating preferably includes at least one of circular, elliptical, and linear movement by the downstream portion of each of the coupled tubes.

In particular embodiments of the inventive spray apparatus, the tubes have downstream portions that extend at least partially through the respective fluid outlets. A plurality of flexible nozzles are preferably each carried within the fluid outlets about respective downstream portions of the tubes. The nozzles may have internal profiles that are sized and shaped to effect a desired range of nozzle movement under movement of the downstream portions of the coupled tubes within the fluid outlets. Alternatively, the downstream portions of the coupled tubes may have external profiles that are sized and shaped to effect a desired range of nozzle movement upon movement of the downstream portions of the coupled tubes with respect to the fluid outlets. Accordingly, in one particular embodiment, movement of downstream portions of the coupled tubes within the flexible nozzles results in a generally conical fluid spray pattern for each nozzle.

In particular embodiments of the inventive spray apparatus, the coupled fluid-dispensing tubes are integrally formed with the integrating member.

In particular embodiments of the inventive spray apparatus, the integrating member is planar and is supported for rotation about a central axis within the housing. The integrating member of certain of these embodiments includes a plurality of angularly-oriented slots for engaging portions of the respective coupled tubes intermediate the upstream and downstream portions thereof by the extension of the coupled tube portions through the angularly-oriented slots. The integrating member is rotatable with respect to the housing for moving the coupled tube portions. An actuator is preferably carried by the housing for rotating the integrating member.

In a particular embodiment, the inventive spray apparatus further includes an actuator for restricting oscillatory movement of the integrating member so as to restrict movement of the coupled tubes.

In another aspect, the present invention provides a spray apparatus, including a housing having a fluid inlet, and a plurality of tubes for dispensing fluid from the housing. An integrating member is operatively coupled to at least a subset of the plurality of tubes for effecting coordinated movement of the coupled tubes in response to movement of the integrating member. An actuator is also provided for inducing movement of the integrating member.

In particular embodiments of the inventive spray apparatus, the integrating member includes a plurality of angularly-oriented slots for engaging portions of the respective coupled tubes intermediate the upstream and downstream portions thereof by the extension of the coupled tube portions through the plurality of angularly-oriented slots. The integrating member is rotatable by the actuator with respect to the housing for moving the coupled tube portions. The actuator preferably includes a slidable lever extending through a slot in a side wall of the housing. The lever has an inner portion that engages the integrating member and an outer portion disposed outside the housing.

In a further aspect, the present invention provides a spray apparatus, including a housing having a fluid inlet and a plurality of fluid outlets, and a plurality of tubes each exclusively disposed in one of the fluid outlets for dispensing fluid from the housing. An integrating member is operatively coupled to at least a subset of the plurality of tubes for effecting coordinated movement of the coupled tubes in the respective plurality of fluid outlets in response to movement of the integrating member. An actuator is also provided for inducing movement of the integrating member.

In various embodiments of the inventive spray apparatus, the actuator includes a turbine carried for rotary movement within the housing under fluid flow from the fluid inlet to one or more of the fluid outlets, and the integrating member is operatively coupled to the turbine for oscillatory movement relative to the housing under rotary movement of the turbine.

In a further aspect, the present invention provides a method of spraying fluid, including the steps of delivering pressurized fluid to a plurality of dispensing tubes (e.g., via a housing that carries the tubes), coupling together at least a subset of the plurality of tubes (e.g., via an integrating member) so that the coupled tubes move in a coordinated fashion under an actuating force, and applying an actuating force to the coupled tubes (e.g., via an actuator, such as a turbine, carried within a housing) to effect a desired fluid spray through the tubes.

In a still further aspect, the present invention provides a spray apparatus, including a housing having a fluid inlet, an actuator carried for rotary movement within the housing under fluid flow from the fluid inlet, an integrating member operatively coupled to the actuator for oscillatory movement relative to the housing under rotary movement of the actuator, and a plurality of tubes for dispensing fluid from the housing. At least a subset of the plurality of tubes is operatively-coupled to the integrating member for coordinated movement of the coupled tubes.

A still further aspect of the present invention provides a spray apparatus, including a housing having a fluid inlet, and a plurality of tubes for dispensing fluid from the housing. A means is further provided for converting energy from fluid delivered through the fluid inlet into coordinated movement of at least a subset of the plurality of tubes. The converting means preferably includes an actuator (e.g., a turbine) and an integrating member in accordance with one or more of the various embodiments described herein, as well as equivalents thereto.

In another aspect, the present invention provides a spray apparatus, comprising a housing having a fluid inlet, a plurality of tubes for dispensing fluid from the housing, and an integrating member operatively coupled to at least a subset of the plurality of tubes for effecting coordinated movement of the coupled tubes in response to movement of the integrating member. An actuator is employed for inducing movement of the integrating member. The integrating member may be operatively coupled to the dispensing tubes at various positions along the tubes, such as intermediate the ends of the respective coupled tubes or near dispensing ends of the respective coupled tubes.

The dispensing tubes may be flexible so as to allow for easy adjustment of the fluid-dispensing direction or shape by the application of a lateral force at one or more locations along the length of the tubes. The flexibility also facilitates amplified direction/shape changes (compared to rigid dispensing tubes) in the dispensed fluid streams, e.g., when the tubes are subjected to a lateral force on one side and an opposing pivoting force (axially offset from the lateral force) on the other side.

Many of the embodiments of the invention utilize tubes that are flexible so that they bend along their length when acted upon by an orbiting member or aiming member as described herein. It should be recognized that this degree of flexibility can be accomplished using various combinations of compositions, lengths, wall thickness, diameters, and the like. Depending upon the embodiment, it is also possible to make a tube too flexible, such that it no longer exhibits sufficient resilience to cause the tube to return to it original shape, avoid kinking and localized, unpredictable bending. Rather, it is preferred that the tubes undergo smooth arcing bends from one portion of the tube to another portion, such as from one end of the tube to the other.

Alternatively, as discussed in relation to FIG. 62A, which shows a fluid-dispensing tube employing a non-uniform distribution of ribs about its periphery (as well as along its length) for achieving non-uniform flexing of the tube, various nonuniform configurations of the tubes, such as ribs and/or changes in wall thickness or diameter, can be used to concentrate a greater or lesser amount of the bending at a particular point or portion along the length of the tube. For example, a tube having a proximal portion with a thicker tube wall than a distal portion will tend to experience more bending in the thinner distal portion.

When a tube is urged from its relaxed position so that it is smoothly bent along its length, the direction of the fluid spray from the distal outlet end will be at an even-greater angle relative to the relaxed tube position than an imaginary straight line between the tube inlet and outlet. Therefore, the flexible tubes of the invention can provide a multiplication of the spray angle relative to the angle that a rigid tube would achieve. Further still, a tube with non-uniform flexibility will concentrate a major portion of the bending in a shorter portion of the tube. A tube with the more rigid tube portion near the proximal end, for example the proximal half of the tube length, will concentrate most of the bending near the distal end, for example along the distal half of the tube length, such that the bending arc has a shorter radius and the resulting spray angle will be multiplied even more than with a tube having uniform flexibility.

Furthermore, in embodiments where the tubes extend through a fluid chamber, it is not necessary for the tubes themselves to extend the full distance between two members, such as the orbiting plate and the exit plate. Rather, a strap of the same or different material may be used for connecting the tube to, for example, the orbiting plate. Accordingly, the strap may exhibit a different degree of flexibility than the tube itself, either due to composition or dimensional differences, with the effect of more bending occurring in one or the two portions depending upon the flexibility and lengths of the two portions.

It should also be recognized that in each of the numerous embodiments of the invention detailed in this application, the tubes or straps are affixed at their proximal end and loose at their distal end. This is true whether the tubes lie within the fluid chamber or outside the fluid chamber. In this manner, the tubes are believed to be either relaxed or in slight tension, but never in compression. Furthermore, the invention includes embodiments in which the orbiting member reaches into the tubes and moves the tubes from the inside.

The flexible tubes used in the present invention are preferably made from a material such as silicone rubber or other elastomer, such as a thermoplastic elastomer. The tubes preferably exhibit a durometer hardness SHORE A of 30 to 80, more preferably to 40 to 60, and most preferably about 45. Suitable spray streams have been achieved with tubes having an internal diameter of 0.02 to 0.12 inches. Smooth arcing bends have been found in such tubes having a wall thickness of 0.015 to 0.06 inches, which may be uniform or non-uniform along a preferred length of 0.15 to 2 inches, more preferably a length of 0.15 to 1.35 inches. However, any of these parameters may be suitably changed in accordance with a particular embodiment The smooth arcing bends of the flexible tubes provide a controlled and repeatable spray direction when acted upon by a controlled and repeatable force, such as the force of the orbiting plate. Directional control on a stationary or moving spray pattern is the achieved by changing the direction or degree of the smooth arcing bend. Therefore, using flexible tubes makes it possible to implement a large number of features that can be built into a shower nozzle to allow a user to adjust one or more aspect of the resulting spray pattern.

In order to achieve the smooth arcing bends desired, it is important that the distal end of the tube, if not the entire length of the tube extending from a secured proximal end, pass loosely around or through adjacent structure. Most particularly, the tube should extend loosely through any orbiting plate, unless the orbiting plate is securing the proximal end of the tubes, and any exit plate to avoid binding of the tube and allow for a smooth arcing bend to be achieved. Still, the clearance of an opening in an orbiting plate should be minimal so that extent of orbiting is not significantly diminished. The orbiting plate preferably has a smooth rounded point contact against the tube wall to allow arcing of the tube in all directions without binding. Embodiments having the orbiting plate positioned at the distal end may include an optional exit plate, but the tube clearance through such an exit plate must avoid interference with the tubes across their full range of intended motion and/or aiming. However, in embodiments having the orbiting plate at the proximal end or middle of the tube and requiring an exit plate to limit side to side movement of the distal end, the openings through the exit plate should provide clearance around the tubes so that the tubes do not bind across their full range of intended motion and/or aiming. Still, this clearance must not be so great that the tubes slap around within the opening. Generally, the exit plate will have a round contact point, either in the middle or top of the exit plate's thickness, to allow smooth arcing bends with minimal clearance. In certain embodiments, where the exit plate forms a wall of the fluid chamber, the clearance is even more critical because too much fluid can escape through any large gaps between the opening and the tube wall. It has been discovered that moderate amounts of water can pass through this gap and flow along the exterior of the tube before being drawn off with the fluid stream exiting the distal end of the tube. This fluid passage beneficially serves to lubricate the contact between the tubes and the opening adding to the freedom of movement. Thus, it is also found that it is not necessary or desirable for the distal ends of the tube to be sealed relative to the fluid chamber. However, certain embodiments have fluid chambers sealed at the proximal end of the tubes, providing the advantage the lateral movements of the tubes and orbiting plates are not opposed by surrounding liquid, just air.

The embodiments of the invention can produce excellent orbiting spray patterns across a wide range of speeds, including 2000 to 3000 rotations per minute (RPMs), and most preferably near 2600 RPMs, such as 2400 to 2800 RPMs. A range of RPMs about half of these ranges is desirable for massage effects.

The actuator may comprise a turbine carried for rotary movement within the housing under fluid flow from the fluid inlet. In such instances, the integrating member may be operatively coupled to the turbine for oscillatory movement relative to the housing under rotary movement of the turbine. This results in coordinated oscillatory movement of the coupled dispensing tubes.

The integrating member may comprise a planar member having a substantially central orifice. In such instances, the turbine may comprise an output shaft having a cam portion that extends at least partially through the central orifice of the planar member for operatively coupling the turbine to the integrating member.

More particularly, the cam portion may have a sloping profile. In such instances, the inventive spray apparatus may further comprise a mechanism for adjusting the engagement position (e.g., the elevation) of the integrating member relative to the cam portion so as to induce engagement of the integrating member with varying portions of the sloping profile of the cam portion. In this manner, the range of oscillating of the integrating member (and, therefore, the coupled dispensing tubes) resulting from rotation of the turbine may be adjusted.

The inventive spray apparatus may further comprise one or more focusing elements that transversely engage the periphery of the dispensing tubes. The focusing elements may be displaced by the adjustment of the engagement position of the integrating member with the turbine cam so as to adjust the fluid-dispensing direction of the dispensing tubes in a unified converging (or diverging) manner, i.e., to focus the shape of the shower defined by the fluid streams dispensed from the plurality of dispensing tubes.

The focusing elements may comprise a flexible arm associated with one or more dispensing tubes. In such instances, each focusing element may be connected between a movable component of the spray apparatus and a fixed component of the spray apparatus. The movable component may be a movable outlet plate disposed beneath the planar member of the integrating member. The fixed component may be a planar member transversely-mounted within the housing above the integrating member.

Alternatively, each focusing element may be associated with a sub-plurality of dispensing tubes (e.g., three) that define a cluster. In such instances, each focusing element may be operable to adjust the fluid-dispensing direction of the dispensing tubes of the cluster in a unified converging (or diverging) manner. The focusing elements may be integrally formed with the integrating member. Additionally, each focusing element may be operable to produce a high impact spray, a soft impact spray, or a combination thereof from its associated cluster. Furthermore, a plurality of such focusing elements may be operable in a unified converging manner to produce a high impact shower, a soft impact shower, or a combination thereof from their respective clusters (i.e., the cluster outputs are collectively focused).

Each coupled dispensing tube of the inventive spray apparatus is preferably oscillated about a nominal position (e.g., a position defined by its own structural stiffness when unloaded). A mechanism may be provided for adjusting the nominal position of each of the dispensing tubes, so as to adjust the fluid-dispensing direction of (i.e., point) the dispensing tubes in a unified manner.

The spray apparatus housing may be adapted for stationary mounting to a wall. In such instances, the position-adjusting mechanism may operate independently of movement of the housing (i.e., obviating the need for a typical swivel/ball housing mount).

The spray housing may be integrally formed with a handle for gripping by a user, such as in the instance of a hand-held showering apparatus.

Alternatively, the spray apparatus housing may be adapted for use in a kitchen faucet application (as opposed, e.g., to a wall-mounted or hand-held showering apparatus). One example of such a spray apparatus housing is employed in association with a spray apparatus that comprises a housing having a fluid inlet, a plurality of tubes for dispensing liquid from the housing, and an aerator for dispensing an air-liquid mixture from the housing. An integrating member is operatively coupled to at least a subset of the plurality of tubes for effecting coordinated movement of the coupled tubes in response to movement of the integrating member. An actuator is employed for inducing movement of the integrating member. A valve assembly is employed for regulating the flow of liquid between the dispensing tubes and the aerator. The aerator is preferably located centrally with respect to the dispensing tubes. The dispensing tubes may be flexible so as to allow for easy adjustment of the fluid-dispensing direction or shape by the application of a lateral force at one or more locations along the length of the tubes.

In another aspect, the present invention provides a spray apparatus, comprising a housing adapted for mounting within a wall space exposed by an opening in a wall. The housing has a fluid inlet for receiving a fluid supply conduit and an open end for alignment with the wall opening. A face plate is employed for engaging the open end of the housing so as to control the movement/direction of the fluid-dispensing tubes passing therethrough. The face plate has a plurality of fluid outlets. A plurality of tubes are employed for dispensing fluid from the housing via the fluid outlets of the face plate. An integrating member is operatively coupled to at least a subset of the plurality of tubes for effecting coordinated movement of the coupled tubes in response to movement of the integrating member. An actuator is employed for inducing movement of the integrating member. The actuator may comprises a lever connected to the integrating member and extending through a slotted portion of the face plate for applying a sliding force to the integrating member. The dispensing tubes may be flexible so as to allow for easy adjustment of the fluid-dispensing direction or shape by the application of a lateral force at one or more locations along the length of the tubes.

Alternatively, the actuator may comprise a turbine carried for rotary movement within the housing under fluid flow from the fluid inlet to one or more of the fluid outlets. In such instances, the integrating member may operatively coupled to the turbine for oscillatory movement relative to the housing under rotary movement of the turbine.

In a further aspect, the present invention provides a spray apparatus, comprising a receptacle box adapted for mounting within a wall space exposed by an opening in a wall. The receptacle box has a neck for receiving a fluid supply conduit in the wall space and an open end for alignment with the wall opening. A housing is employed for fitting with the receptacle box. The housing has an open end for alignment with the open end of the receptacle box, and a fluid inlet defined by a nipple adapted for sealable fitting within the neck of the receptacle box. A face plate is employed for engaging the open end of the housing. The face plate has a plurality of fluid outlets. A plurality of tubes are employed for dispensing fluid from the housing via the fluid outlets of the face plate. An integrating member is operatively coupled to at least a subset of the plurality of tubes for effecting coordinated movement of the coupled tubes in response to movement of the integrating member. An actuator is employed for inducing movement of the integrating member. The actuator may comprise, e.g., a lever connected to the integrating member and extending through a slotted portion of the face plate for applying a sliding force to the integrating member. The dispensing tubes may be flexible so as to allow for easy adjustment of the fluid-dispensing direction or shape by the application of a lateral force at one or more locations along the length of the tubes.

In a still further aspect, the present invention provides a spray apparatus, comprising a housing having a fluid inlet for conveying fluid to a chamber thereof, and an open end opposite the fluid inlet. A plurality of tubes are employed for dispensing fluid from the chamber of the housing. An integrating member is at least partially carried by the housing across the open end of the housing and has a plurality of orifices for passage of the plurality of tubes therethrough for effecting coordinated movement of the coupled tubes in response to movement of the integrating member. An actuator is provided for inducing movement of the integrating member. The dispensing tubes may be flexible so as to allow for easy adjustment of the fluid-dispensing direction or shape by the application of a lateral force at one or more locations along the length of the tubes.

The integrating member of the inventive spray apparatus may comprises a planar member, and the actuator may comprise an adjustable control ring that at least partially carries the planar member. More particularly, the control ring may be adjustably carried by the housing. A spring retainer may be releasably secured to the control ring in one or more positions with respect to the housing. The integrating member may be integrally formed with the control ring.

In a still further aspect the present invention provides a dispensing tube for conducting fluid from a spray apparatus. The inventive dispensing tube comprises a tubular body, and an aerator plug for insertion in an end of the tubular body. The plug may optionally be integrally formed with a transverse planar member in which the tubes are mounted. The tubular body may be flexible so as to allow for easy adjustment of the fluid-dispensing direction or shape by the application of a lateral force at one or more locations along the length of the tubular body. The plug has one or more first passages for conducting water therethrough and one or more second passages for conducting air therethrough. At least one of the body and the plug is adapted for connection to a portion of the spray apparatus. The first passages may employ a cross-sectional shape that is one of circular, axial, curvilinear, and a combination thereof. The second passages may employ a cross-sectional shape that is one of circular, axial, curvilinear, and a combination thereof. The second passages are preferably discrete from the first passages.

In a still further aspect, the present invention provides a dispensing tube for conducting fluid from a spray apparatus. The inventive dispensing tube comprises a flexible tubular body having a non-uniform stiffness about its periphery, whereby the application of uniform lateral force about the periphery will produce non-uniform lateral flexing of the tubular body. The non-uniform stiffness may be provided by the tubular body having a non-uniform wall thickness about its periphery. Alternatively, the non-uniform stiffness may be provided by the tubular body having a non-uniform rib distribution about its periphery.

In a still further aspect, the present invention provides a dispensing tube for conducting fluid from a spray apparatus. The inventive dispensing tube comprises a flexible tubular body having a non-uniform stiffness along its length, whereby the application of lateral force to the tubular body will produce non-uniform flexing of the tubular body along its length. The non-uniform stiffness may be provided by the tubular body having a non-uniform wall thickness along its length. Alternatively, the non-uniform stiffness may be provided by the tubular body having a non-uniform rib distribution along its length.

In a still further aspect, the present invention provides a dispensing tube for conducting fluid from a spray apparatus. The dispensing tube comprises a tubular body having an inlet for receiving fluid and an outlet for dispensing fluid. The tubular body is flexible along substantially its entire length, whereby the outlet of the tubular body may be easily pointed under the application of lateral force to the tubular body at one or more locations along the length of the tubular body. The tubular body may comprise a natural polymer, a synthetic polymer, or a combination thereof.

Each flexible dispending tube may further comprise a strap connected at or near the inlet of its tubular body for pivotally mounting the tubular body within the housing. The strap may be pivotally mounted to the tubular body. The strap may be flexible, or it may be rigid over at least a substantial portion of its length. In the later case, the rigidity of the strap may be provided by a reinforcing member.

BRIEF DESCRIPTION OF THE DRAWINGS

A more particular description of the invention, briefly summarized above, is provided by reference to embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIGS. 11-11A show detailed sectional side views of alternative fluid-dispensing tubes and elastomeric sleeve nozzles, compared to those shown in FIGS. 9-10.

FIGS. 12-14 show sectional side and top views of another embodiment of a spray apparatus employing an enclosed turbine and an integrating member positioned beneath the apparatus's flow chamber in accordance with the present invention.

DETAILED DESCRIPTION OF THE INVENTION

Figure 1:
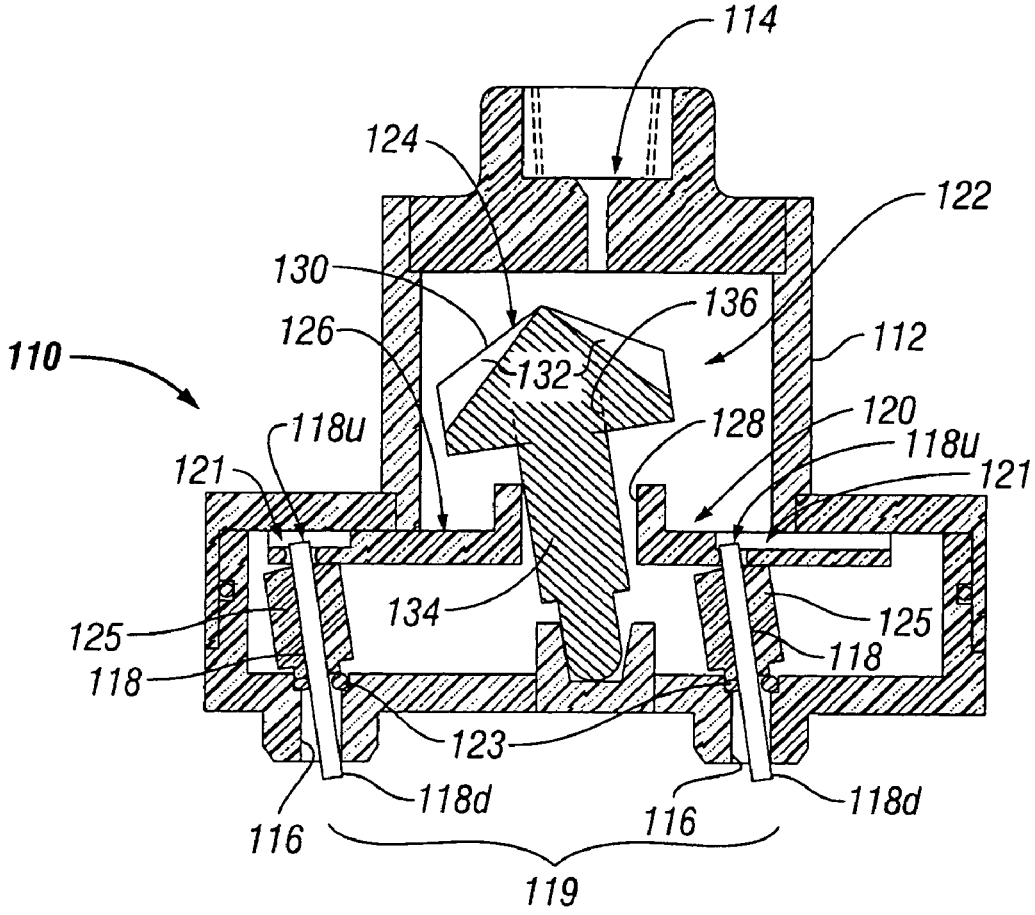
FIG. 1 shows a sectional side view of one embodiment of a spray apparatus employing a wobble turbine in accordance with the present invention.
Figure 47A:
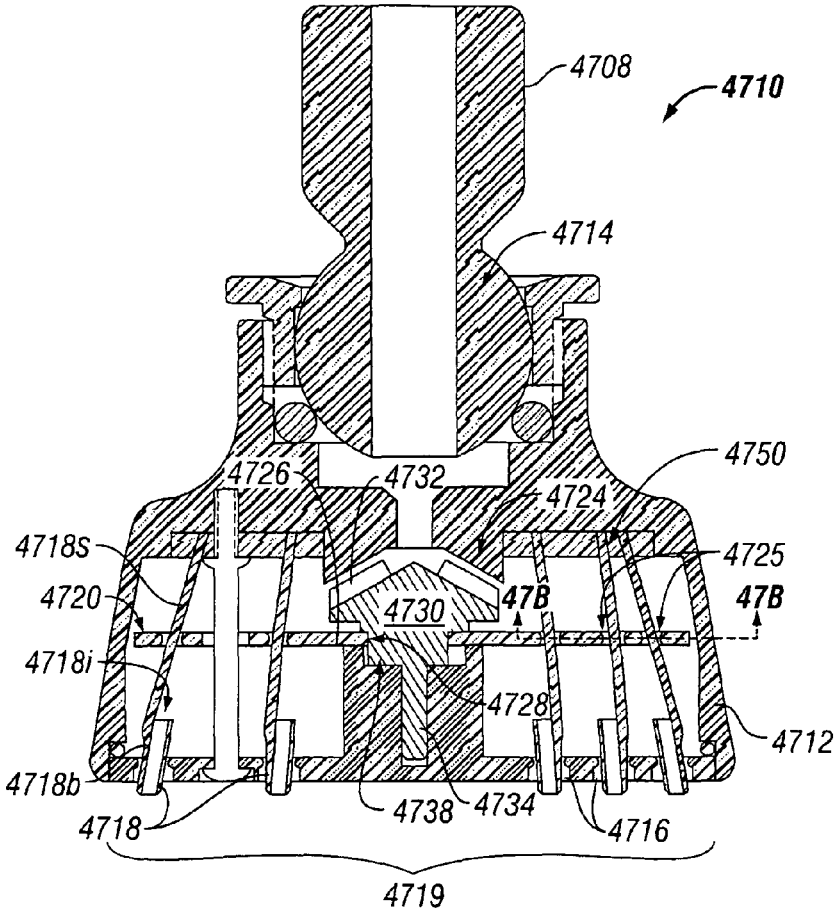
FIG. 47A is a section representation of a similar spray apparatus to that of FIG. 46, but employing a different engagement mechanism between the integrating member and the dispensing tubes.
Figure 68:
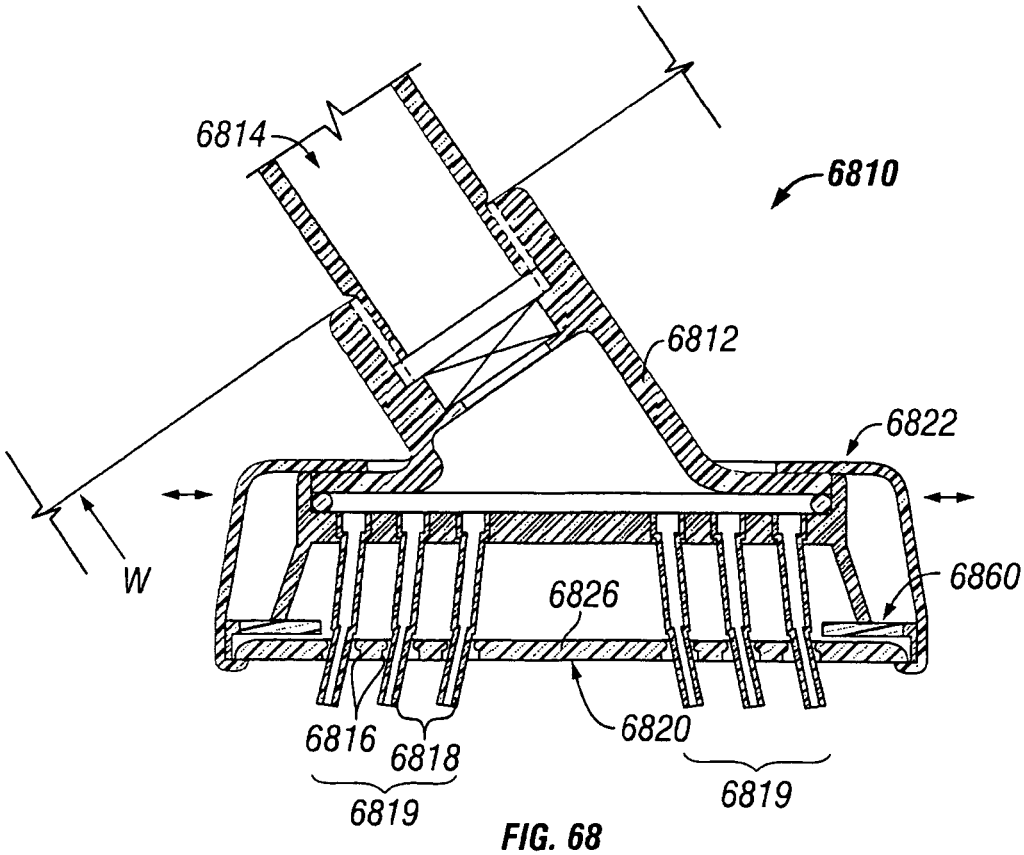
FIGS. 68-74 illustrate sectional representations of alternative spray apparatuses that permit near-wall mounting and unified pointing of fluid-dispensing tubes—via a movable control ring and a spring element—without the need for a shower ball/swivel mounting.
Figure 69:
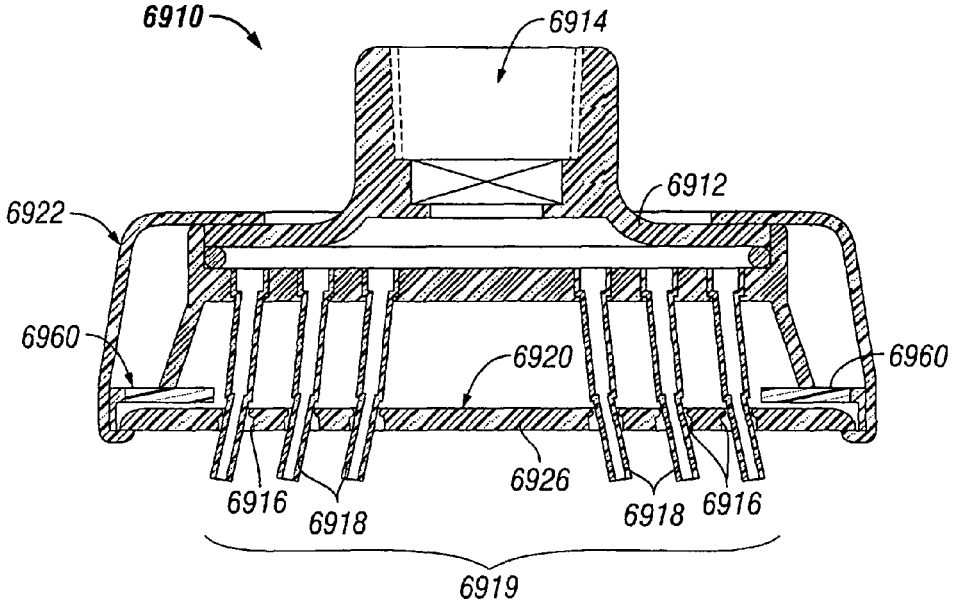
Figure 70:
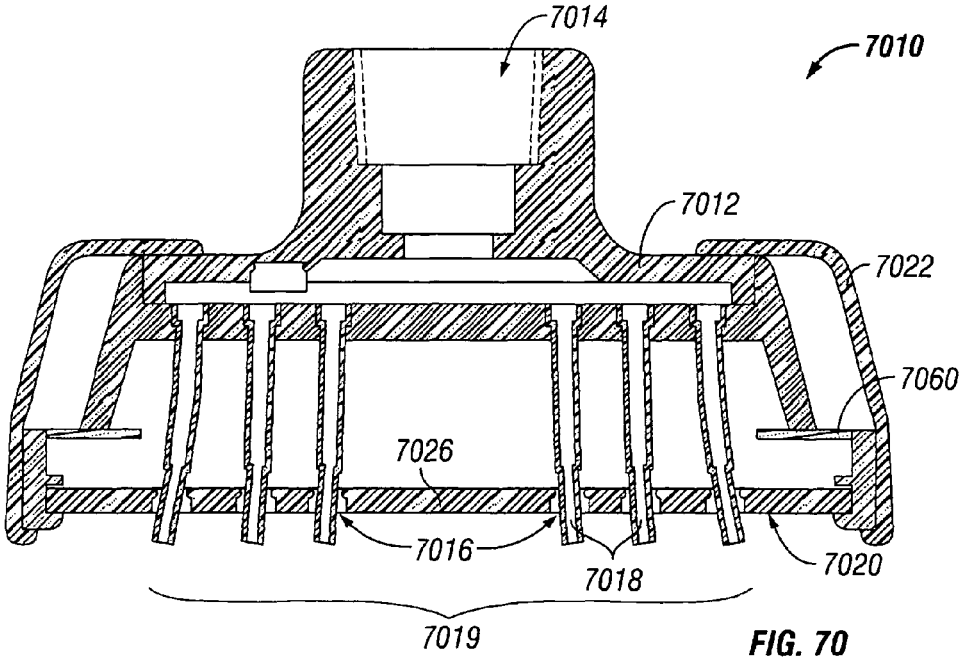
Figure 71:
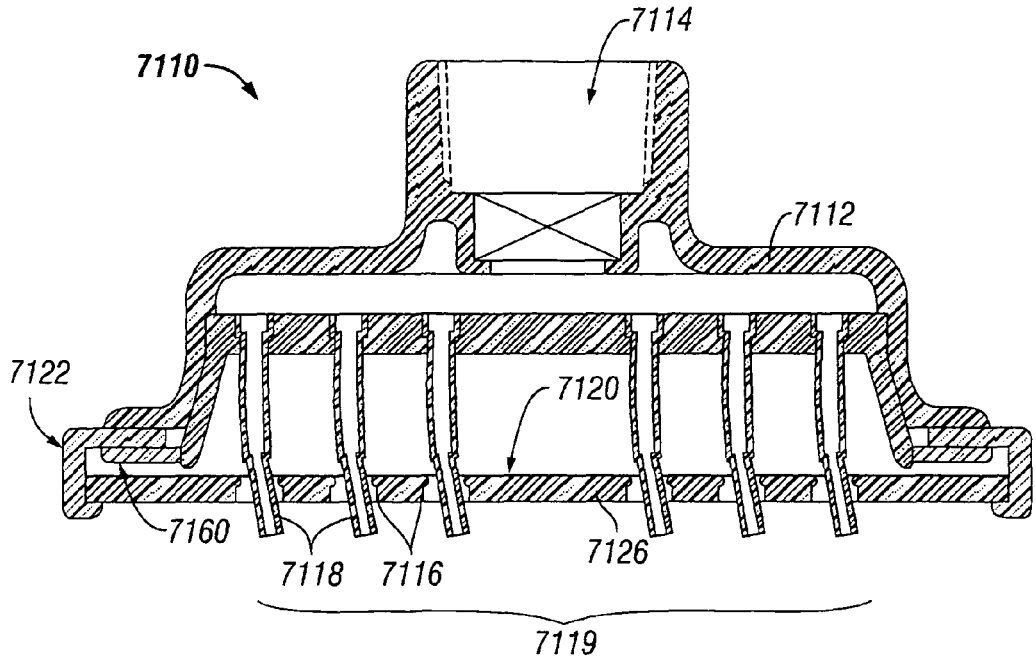
Figure 72:
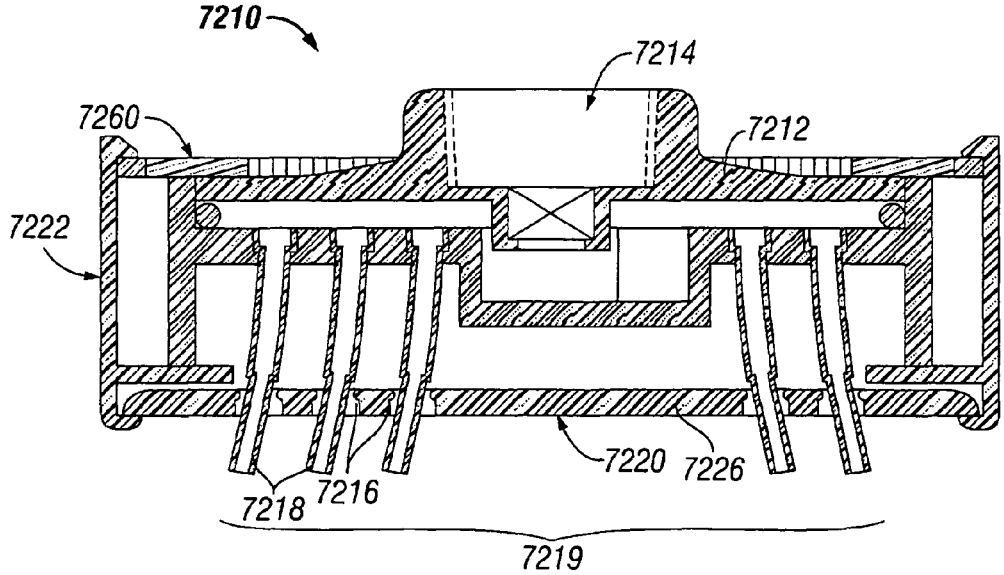
Figure 73:
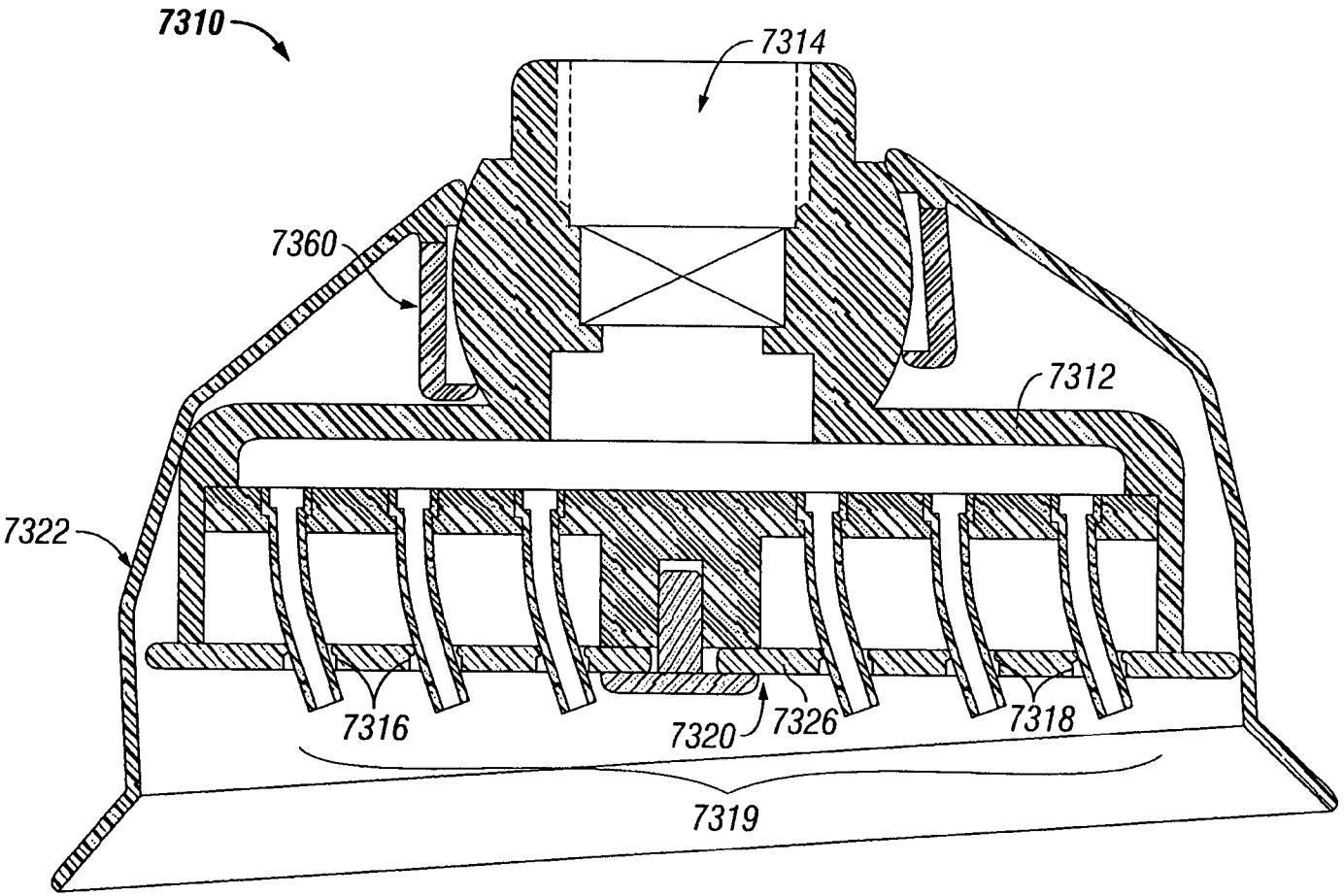

With reference now generally to FIGS. 1-68A (with "X" in the following reference numbers representing the number of the respective figure, e.g., "X10" means "1210" in FIG. 12), the present invention provides a spray apparatus X10, including a housing X12 having a fluid inlet X14 and a plurality of fluid outlets X16. The housing X12 is preferably made of a durable material known in the art to be suitable for use in showering applications, such as acrylonitrile butadiene styrene (ABS), acetal plastic, or an equivalent. It is presently preferred that at least a portion of the housing X12 is substantially cylindrical, as is shown more clearly in the housing embodiment 4112 of FIG. 41B, but this is not essential as shown, e.g., by the bell-shaped housing 4712 of FIG. 47, and the square-shaped housing 6612 in FIG. 66A.

A plurality of tubes X18 are further provided, each preferably being exclusively disposed in one of the fluid outlets X16, for dispensing fluid from the housing X12. An integrating member X20 is operatively coupled to at least a subset X19 of the plurality of tubes X18 for effecting coordinated movement of the coupled tubes X19 in the respective plurality of fluid outlets X16 in response to movement of the integrating member X20. Typically, no bearings are required since the contact forces are not significant and the moving parts are designed to be self-lubricated by the water flowing through the spray apparatus X10.

An actuator X22 is also provided for inducing movement of the integrating member X20. The actuator X22 preferably includes a turbine X24 carried for rotary movement within the housing X12 under fluid flow from the fluid inlet X14 to one or more of the fluid outlets X16. The fluid inlet X14 of the housing X12 preferably directs fluid towards the actuator X22 in a direction selected from axial, radial, tangential, and combinations thereof.

The integrating member X20 preferably includes a first planar member X26 having a substantially central orifice X28. The integrating member X20 is preferably operatively coupled to the turbine X24 for oscillatory movement relative to the housing X12 under rotary movement of the turbine X24. The rotary movement of the turbine may include spinning, nutating, or a combination thereof. The nutating of the turbine X24 may include a wobbling motion (see FIGS. 1-4, 20, 22).

The turbine X24 preferably includes a head X30 having at least one angled or curved vane (and preferably two or more radially-symmetrical vanes) X32 on an upper surface thereof, and a shaft X34 depending from the turbine head X30 and extending at least partially through the orifice X28 in the first planar member X26 for operatively coupling the integrating member X20 to the turbine X24. The turbine shaft X34 is preferably disposed in an orifice X36 formed through a lower portion of the turbine head X30, and is preferably fixed for rotation with the turbine head X30. Alternatively, as shown in FIGS. 1, 45, and 46-48A, the turbine shaft X34 may be integrally formed with the turbine head X30.

The turbine shaft may be equipped with an eccentric or cam portion X38 positioned beneath and/or opposite the turbine head X30, and affixed to the turbine shaft X34 such that the cam portion X38 rotates with the turbine head X30. The cam portion X38 is carried within the orifice X28 of the first planar member X26. The cam portion X38 may optionally be integral with the turbine head X30, as illustrated in FIGS. 5-8, 33, 45-50, 53, 55-56A, 63, and 65A-B.

The oscillatory movement of the integrating member X20 may include at least one of circular, elliptical, and linear movement. The oscillating of the integrating member X20 preferably effects a coordinated oscillating of a portion (e.g., the downstream portion) of each of the coupled tubes X19. The coupled tubes X19 are preferably oriented with respect to one another in a configuration that is parallel, divergent, convergent, or a combination thereof. Such oscillating preferably includes at least one of circular, elliptical, and linear movement by the coupled portion of each of the coupled tubes X19.

The integrating member X20 preferably engages each of the coupled tubes X19 at a similar location on each tube. The engagement location may be: at or near a downstream portion of each coupled tube (see FIGS. 12-30, 35, 37-44, 52, 54, 57-60A, and 66A-67A); intermediate downstream and upstream portions of each coupled tube (see FIGS. 33-34, 47A, 51, and 55); or at or near (or even above, e.g., by way of an upper strap) an upstream portion of each coupled tube (see FIGS. 1-11, 45, 46, 48A-50, 53, 55-56A, and 63-65B).

The fluid-dispensing tubes X18 may be rigid or flexible, with the flexibility being preferably provided by manufacturing the tubes of elastomeric materials including a natural polymer, a synthetic polymer, or a combination thereof. Additionally, the tubes X18 are each disposed in one of the fluid outlets X16. Some leakage around the tubes can be accommodated by the inventive spray apparatus X10.

Turning now to the particular figures, FIG. 1 shows a sectional side view of one embodiment of a spray apparatus 110 employing an actuator 122 in the form of a wobble turbine 124. The wobble turbine 124 is energized by water flowing through fluid inlet 114, in a manner that is known in the art (see, e.g., U.S. Pat. No. 6,092,739 to Clearman et al.), resulting in rotary movement of the turbine 124 which may include spinning, nutating, or a combination thereof about the central axis of the housing 112. Preferably, the output shaft 134 of the turbine is nutated by the rotary movement of the turbine 124 within the orifice 128 in the first planar member 126, resulting in oscillation of the integrating member 120 including the first planar member 126.

The integrating member 120 engages each of the coupled tubes 119 at or near an upstream portion of each coupled tube. For this purpose, the integrating member 120 preferably includes a plurality of orifices 121 therein, and an upstream portion 118*u* of each of the coupled tubes 119 is affixed in one of the orifices 121 of the integrating member 120. The oscillation of the integrating member 120 results in streams from the tubes moving thru substantially conical patterns. Similar structure is employed in other embodiments of the inventive spray apparatus (see, e.g., FIGS. 2-11), although the integrating member and coupled tubes are integrally formed in the embodiments of FIG. 7-11.

It is also preferable in certain embodiments (see, e.g., FIG. 1) that a downstream portion 118*d* of each of the tubes 118 (whether coupled or not) extends at least partially through one of the outlets 116 in the housing 112, and that each of the outlets 116 is equipped with an O-ring 123 through which a portion of each of the tubes intermediate the upstream and downstream portions 118*u*, 118*d* is pivotally carried. A plurality of sleeves 125 are preferably each fitted about one of the coupled tubes 119 intermediate the integrating member 122 and the fluid outlet 116 through which each tube 119 extends.

Figure 2A:
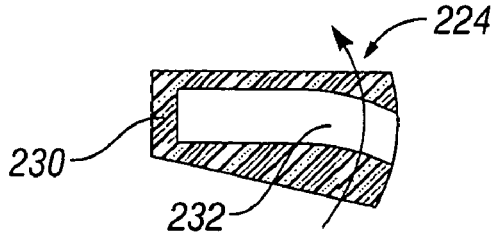
FIG. 2A shows a top view of the turbine employed by the spray apparatus of FIG. 2.
Figure 2:
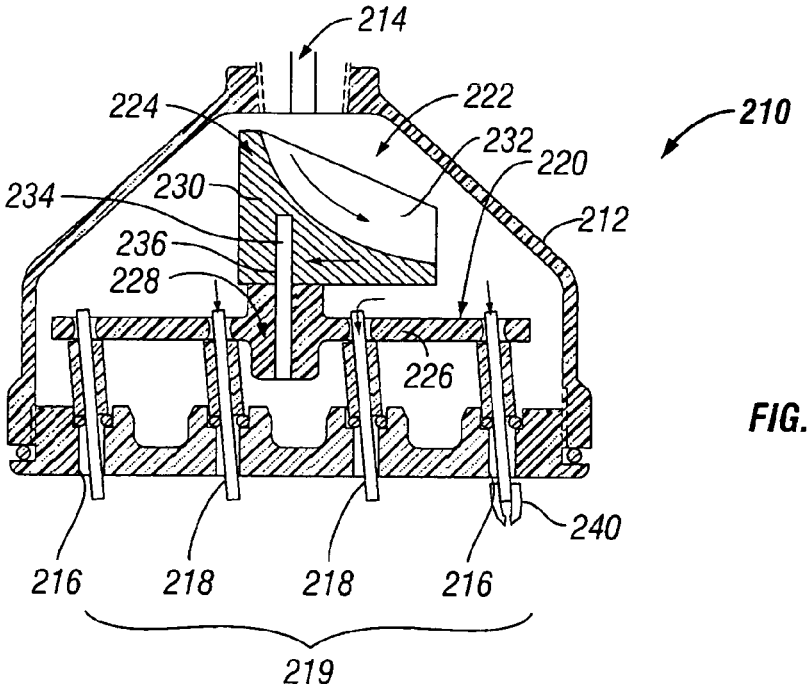
FIG. 2 shows a sectional side view of another embodiment of a spray apparatus employing a channel turbine to generate oscillatory movement of an integrating member in accordance with the present invention.

FIG. 2 shows a sectional side view of another embodiment of a spray apparatus 210 employing an actuator 222 in the form of a "channel" turbine 224 to generate oscillatory movement of an integrating member 220 having a first planar member 226. A turbine shaft 234 is carried in the orifices 228, 236 of the integrating member and the turbine, such that the turbine is rotationally supported by the integrating member (see also FIGS. 3-4, which employ similar support structure).

FIG. 2A shows a top view of the asymmetric turbine head 230 having a single angled or curved vane 232 for translating the energy of the water delivered through the fluid inlet 214 into rotary movement of the turbine 224. Since the integrating member 220 is free to move (within constraints) vertically as well as horizontally (this freedom of movement is shared by the embodiments of FIGS. 1-4), the integrating member undergoes fairly complex oscillating movement under the rotary movement of the turbine 224. The turbine 224 is known as a rotating channel turbine, wherein the force of the water applied via fluid inlet 214 against the angled or curved vane 232 pushes the turbine 224 and its supporting shaft 234 "back" off its nominal position. The continuous application of such force by the water results in an oscillating movement of the integrating member 220. Similar channel turbines are employed by the embodiments of FIGS. 3-4.

Figure 3:
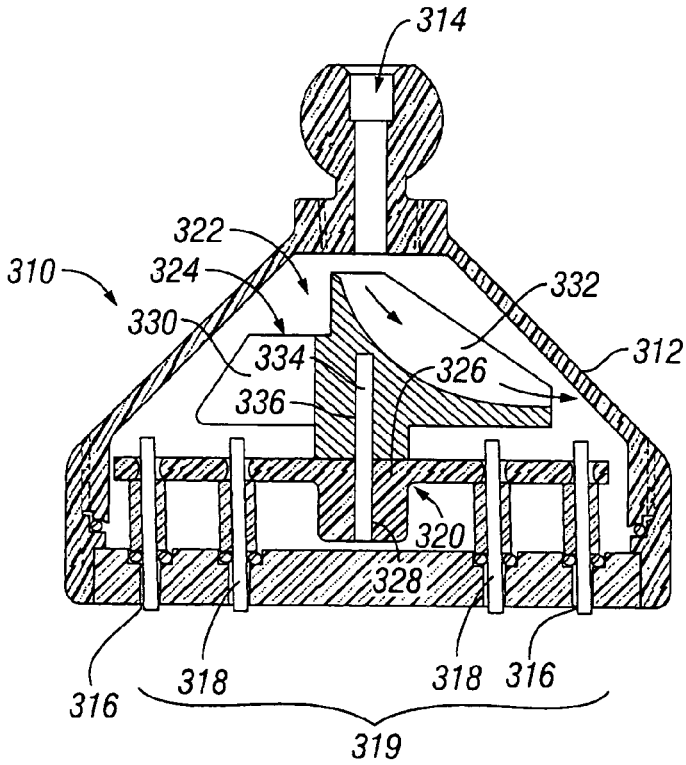
FIG. 3 shows a sectional side view of another embodiment of a spray apparatus that is similar to that of FIG. 2, but employing a different turbine design.

FIG. 3 shows a sectional side view of another embodiment of a spray apparatus that is similar to that of FIG. 2, but employing a different turbine design. More particularly, the turbine head 330 is equipped with a lateral component opposite the single angled or curved vane 332 to reduce the imbalance during rotary movement of the turbine 324, resulting in more controlled oscillation of the integrating member 320 including the first planar member 326. This in turn results in more controlled movement by the fluid-dispensing tubes 318. Alternatively, the turbine head 330 could employ a more conventional design shape (like that of FIGS. 5, 8, etc.), but nevertheless have a rotating imbalance (e.g., greater mass density on one side) to achieve the desired oscillation of the integrating member 320.

Figure 4:
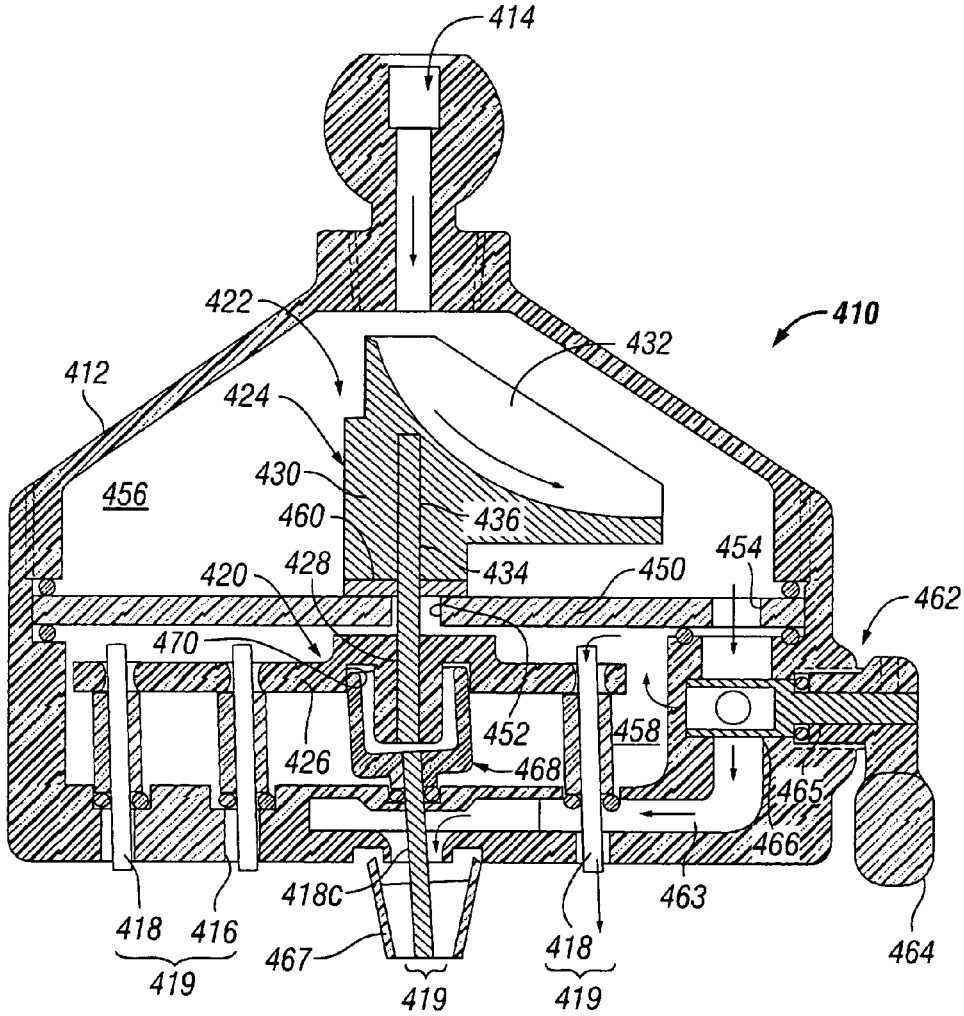
FIG. 4 a modified version of the spray apparatus of FIG. 2 wherein the apparatus is equipped with a flow diverter to create a massage effect.

FIG. 4 shows a modified version of the spray apparatus of FIG. 2 wherein the apparatus 410 is equipped with a flow diverter to create a massage effect. A second planar member 450 is mounted across the body 412 of the spray apparatus 410. The second planar member 450 is equipped with a first orifice 452 for conducting the turbine shaft 434 through the second planar member, and a second orifice 454 for conducting water in the upper flow chamber 456 to the lower flow chamber 458. The first orifice 452 is sealed with a gasket 460 to prevent water from passing therethrough, thereby ensuring that water flowing into the upper chamber 456 of the housing 412 via the fluid inlet 414 will subsequently pass through the second orifice 454.

A rotary valve assembly 462 directs water flowing through the second orifice 454 to either: the coupled plurality 419 of fluid-dispensing tubes 418; the central massage nozzle 467 (via conduit 463); or a combination thereof. The rotary valve assembly 462 includes an actuator handle 464, a plug valve body 466, and a shaft 465 connecting the two for transmission of applied torque from the handle 464 to the plug valve body 466.

A cup assembly 468 is restrained loosely in a recess 470 of the integrating member 420. A central rod 418*c* is affixed to the cup assembly 468, and is constrained so as to pivot in an integrated fashion with the tubes 418. Thus, central massage nozzle 467, which is affixed to central rod 418*c*, will experience movement that preferably includes at least one of circular, elliptical, and linear movement (along with the other coupled tubes 419) under oscillating motion of the integrating member 420.

Figure 5:
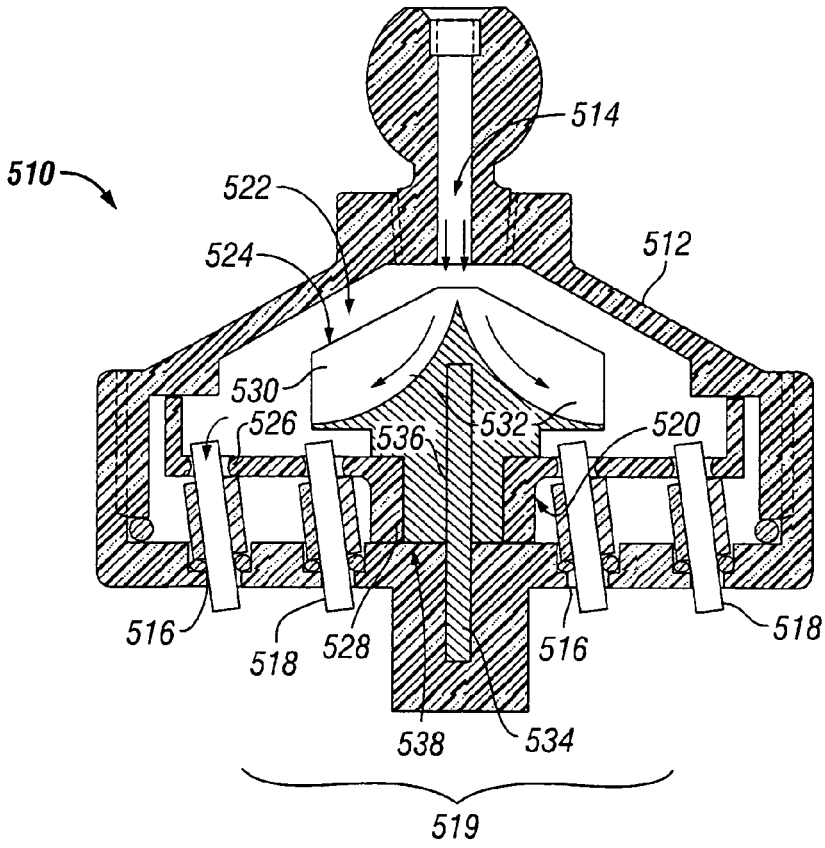
FIG. 5 a sectional side view of another embodiment of a spray apparatus having a turbine rotating on a central shaft and employing a cam action to generate oscillatory movement of an integrating member in accordance with the present invention.

FIG. 5 shows a sectional side view of another embodiment of a spray apparatus 510 having a turbine 524 rotating on a central shaft 534 and employing a cam portion 538 to generate oscillatory movement of an integrating member 520 in accordance with the present invention. The cam portion 538 is defined by an eccentric lower portion of the turbine 524 carried about the shaft 534 for rotation within the orifice 528 of the integrating member 520, whereby spinning of the turbine about the axis of the shaft 534 results in nutation of the turbine cam 538. Similar structure is employed in the embodiments of FIGS. 6-11 to achieve the camming action useful for oscillating the respective integrating members.

Figure 6A:
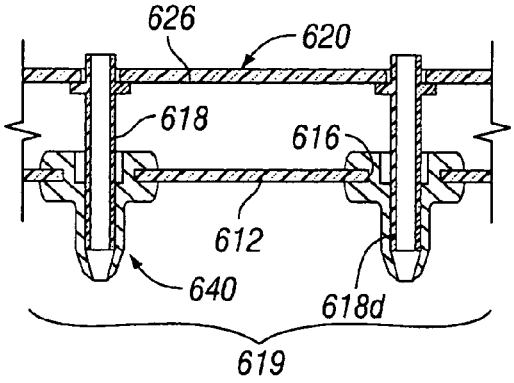
FIGS. 6A-B show examples of fluid-dispensing tubes each having elastomeric sleeve nozzles in accordance with the present invention.
Figure 6B:
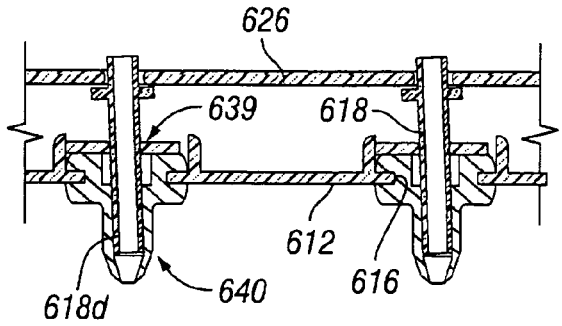

FIGS. 6A-B show examples of fluid-dispensing tubes 618 each having elastomeric sleeve nozzles 640 for focusing the water discharged through the fluid-dispensing tubes 618 to achieve a desirable spray pattern in accordance with the present invention. The sleeve nozzles 640 are preferably consistent with known rubber-tipped nozzles, but exhibit increased utility (e.g., easily deformable to dislodge lime deposits, etc.) in the inventive spray apparatus which employs sweeping sprays. The tubes 618 have downstream portions 618*d* that extend at least partially through the respective fluid outlets 616. Floating disks 639 are optionally applied (see FIG. 6B) to restrict the degree of non-linear flexing movement by the coupled tubes 619 (e.g., to reduce the vigorousness of the resulting shower).

FIGS. 7-11 illustrate a plurality of flexible nozzles (X40) each preferably being carried within the fluid outlets (X16) about respective downstream portions (X18*d*) of the coupled tubes (X19). The nozzles (X40) are integrally formed in a web or matrix (X31), and may have internal profiles that are sized and shaped (see, e.g., the stepped internal diameter of the nozzle 940*a* in FIG. 9) to effect a desired range of nozzle movement under movement of the downstream portions of the coupled tubes within the fluid outlets. Alternatively, the downstream portions (X18*d*) of the coupled tubes may have external profiles that are sized and shaped (see, e.g., FIG. 11) to effect a desired range of nozzle movement upon movement of the downstream portions of the coupled tubes with respect to the fluid outlets. Accordingly, movement of downstream portions (X18*d*) of the coupled tubes within the flexible nozzles (X40) results in a generally conical fluid spray pattern for each nozzle (similar to that shown in FIG. 19).

Figure 7:
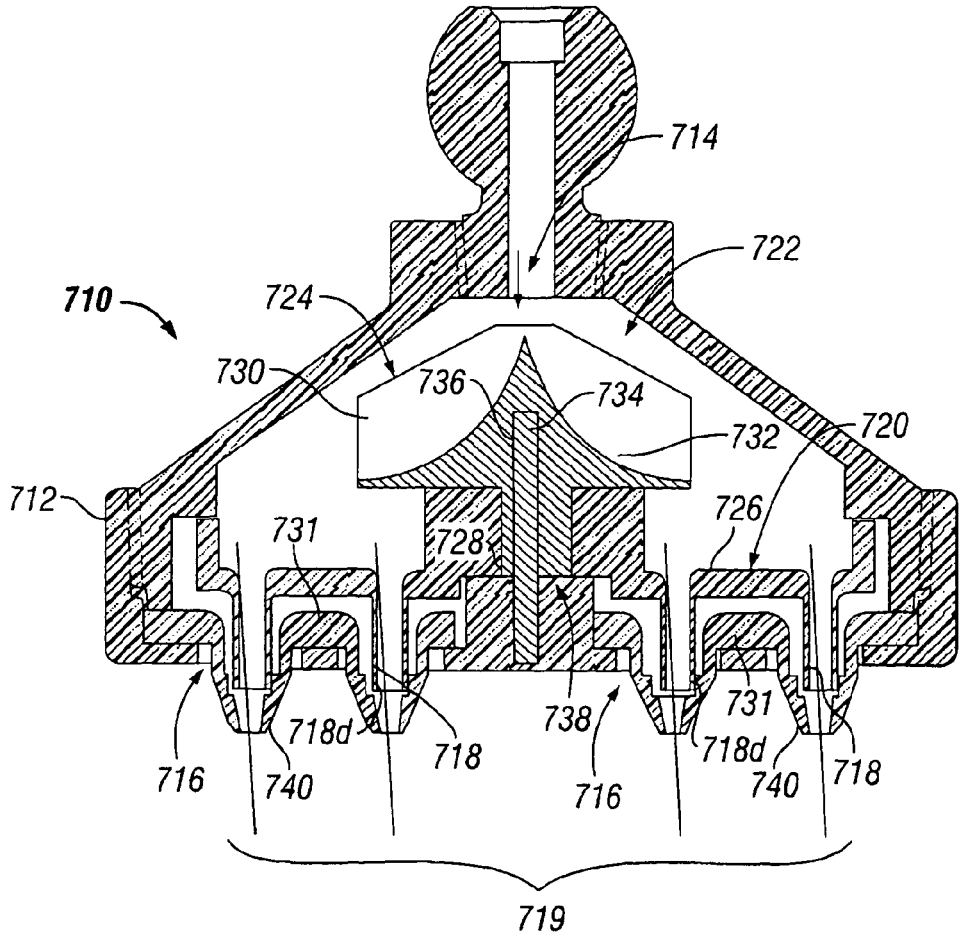
FIG. 7 shows a sectional side view of another embodiment of a spray apparatus that is similar to that of FIG. 5, but having fluid-dispensing tubes that are integrally formed with the integrating member and disposed within elastomeric sleeve nozzles like that of FIG. 6.
Figure 8:
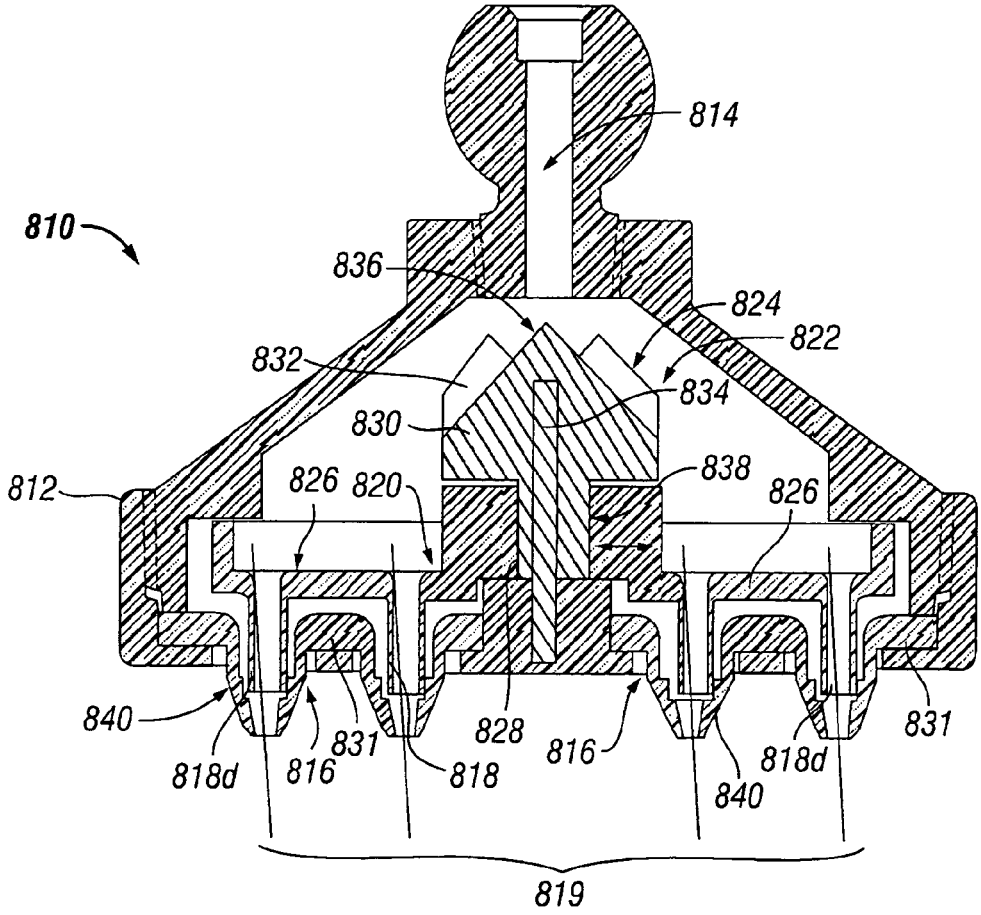
FIG. 8 shows a sectional side view of another embodiment of a spray apparatus that is similar to that of FIG. 7, but employing a multi-bladed turbine.
Figure 9:
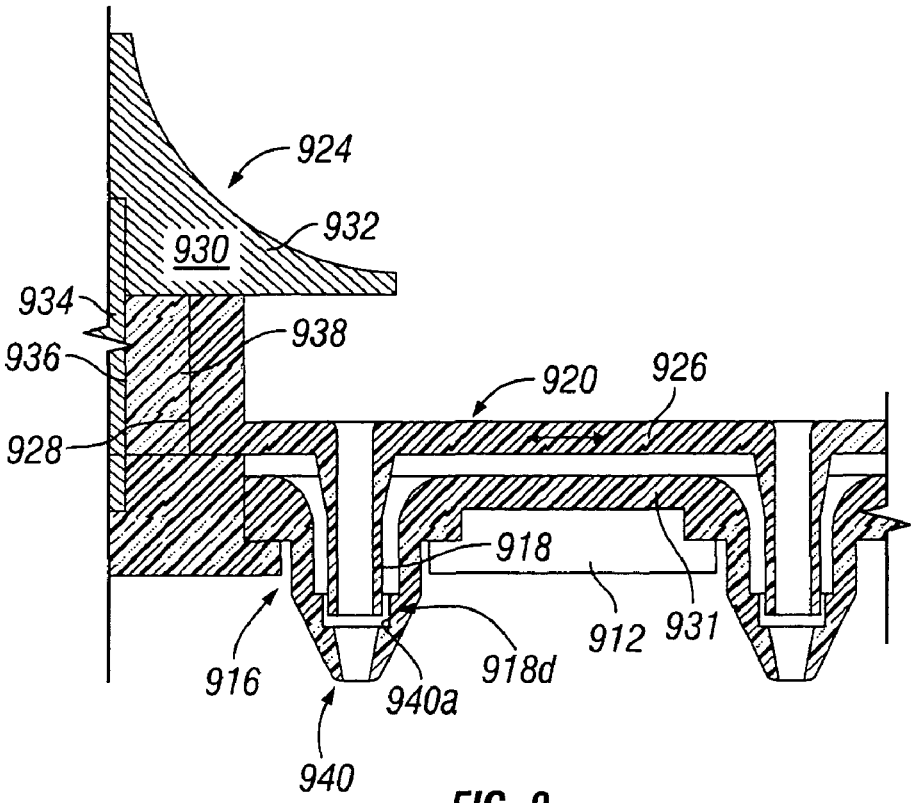
FIGS. 9 and 10 show detailed sectional side views of the fluid-dispensing tubes and elastomeric sleeve nozzles of the embodiments of FIGS. 7-8 in the nominal position (FIG. 9) and offset position (FIG. 10).
Figure 10:
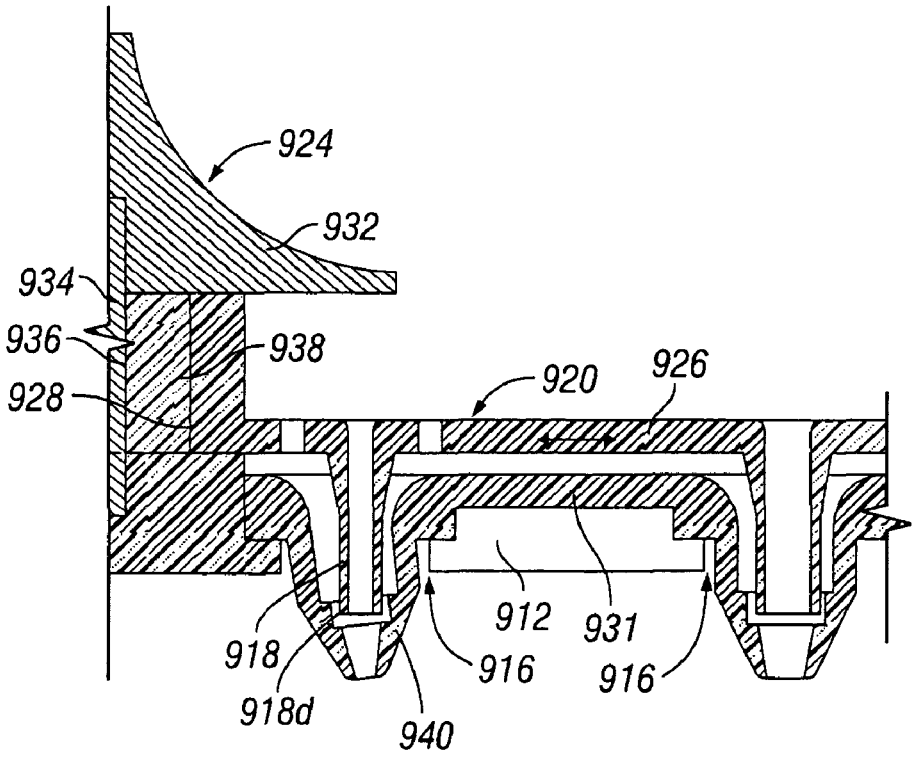

The embodiments shown in FIGS. 7 and 8 are quite similar, except for the respective turbine heads 730 (fewer vanes 732), 830 (more vanes 832).

Those skilled in the art and given the benefit of this disclosure will appreciate that FIGS. 1-11 employ integrating members disposed within a primary flow chamber within the housing (X12). Most of the figures that will now described, however, employ integrating members disposed beneath the primary flow chamber (unless otherwise indicated).

Figure 13:
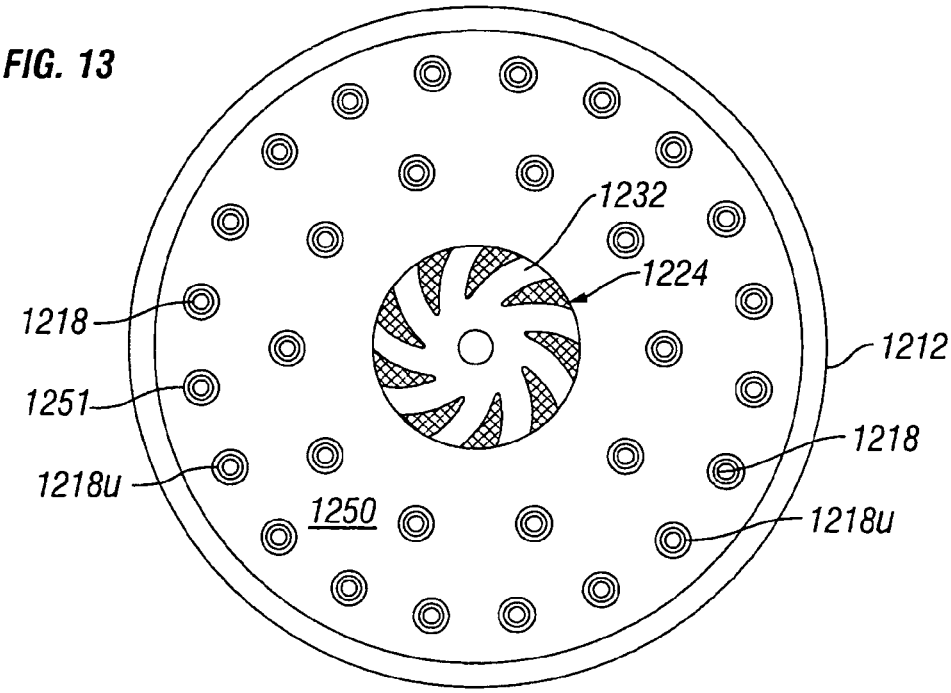
Figure 14:
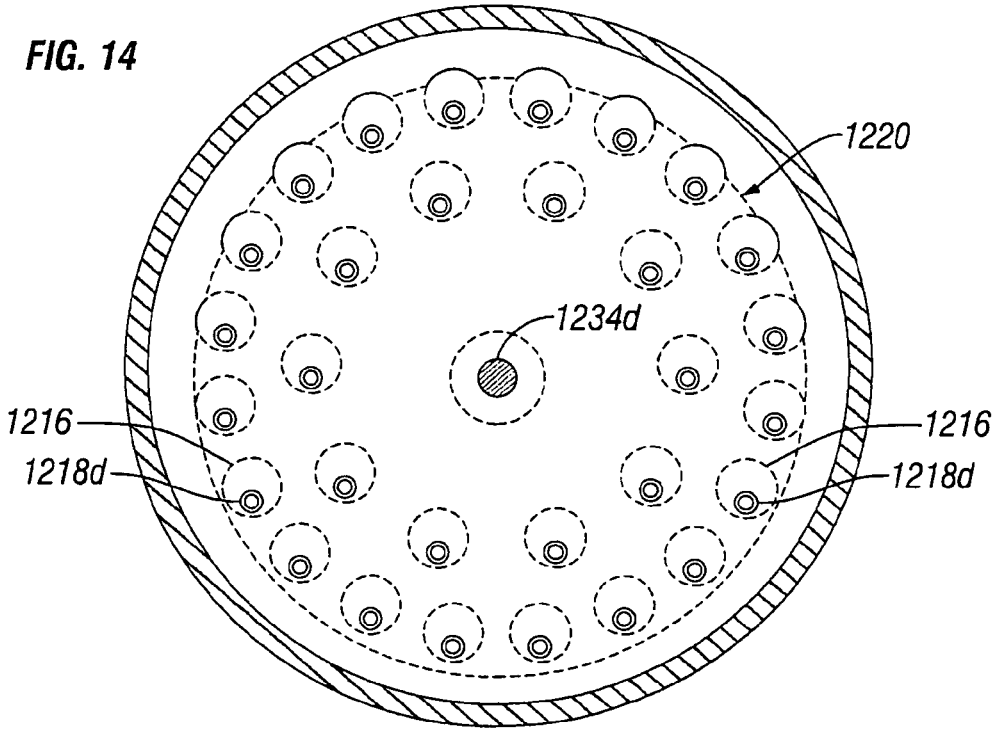

FIGS. 12-14 show an embodiment of a spray apparatus 1210 wherein the turbine 1224 is attached to a crankshaft 1234 that extends for rotation through a second planar member 1250. The rotating crankshaft 1234 drives the integrating member 1220 outside the flow chamber 1256. The integrating member 1220 including the first planar member 1226 is oscillated within the lower chamber 1258 to induce movement of the coupled fluid-dispensing tubes 1219 and achieve a desirable spray pattern. This embodiment, as well as others employing a second planar member (e.g., FIGS. 13-30) for carrying the upstream end of the fluid-dispensing tubes, has the advantage of imposing little or no pressure on the tubes 1218. The tubes 1218 serve to give the discharged water direction and shape (without discrete nozzles), but require little force to move. No seal is required for the crankshaft 1234, since leaks around the crankshaft 1234 can be absorbed into the shower streams.

The crankshaft has a first end portion 1234*u* mounted to the turbine head within orifice 1236, and a second end portion 1234*d* rotatably carried within the substantially central orifice 1228 in the first planar member 1226. The second end portion 1234*d* of the crankshaft 1234 is axially offset from the axis of the crankshaft by a bend in the crankshaft intermediate the first and second end portions. The crankshaft 1234 is supported for rotation about a central axis within the housing by the second planar member 1250 which is sealingly mounted against rotation within the housing between the integrating member 1220 and the turbine head 1230. The second planar member 1250 preferably includes a substantially central orifice 1252 within which the crankshaft 1234 is carried for rotation, and a plurality of noncentral orifices 2351 therein. An upstream portion 1218*u* of each of the tubes 1218 is affixed in one of the noncentral orifices 1251 of the second planar member 1250. A downstream portion 1218*d* of each of the tubes 1218 extends at least partially through one of the fluid outlets 1216. Accordingly, water flowing into the fluid 1214 inlet is directed through the tubes 1218, via the noncentral orifices 1251, to produce a showering spray.

Figure 15:
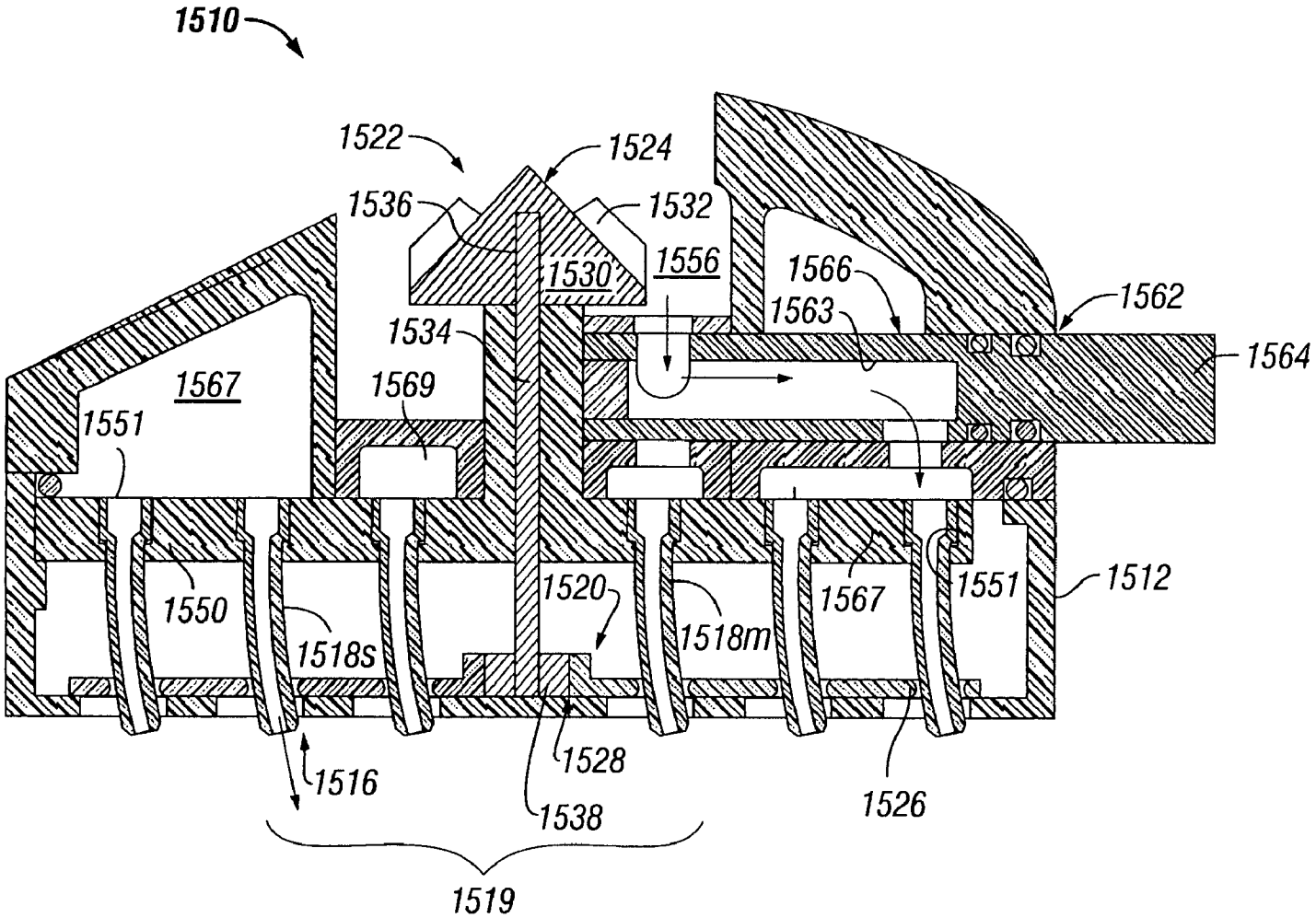
FIGS. 15-15A show sectional side views of another embodiment of a spray apparatus that is similar to that of FIG. 12, but employing a camshaft rather than a crankshaft and being further equipped with a flow diverter system for achieving a massage effect in accordance with the present invention.
Figure 15A:
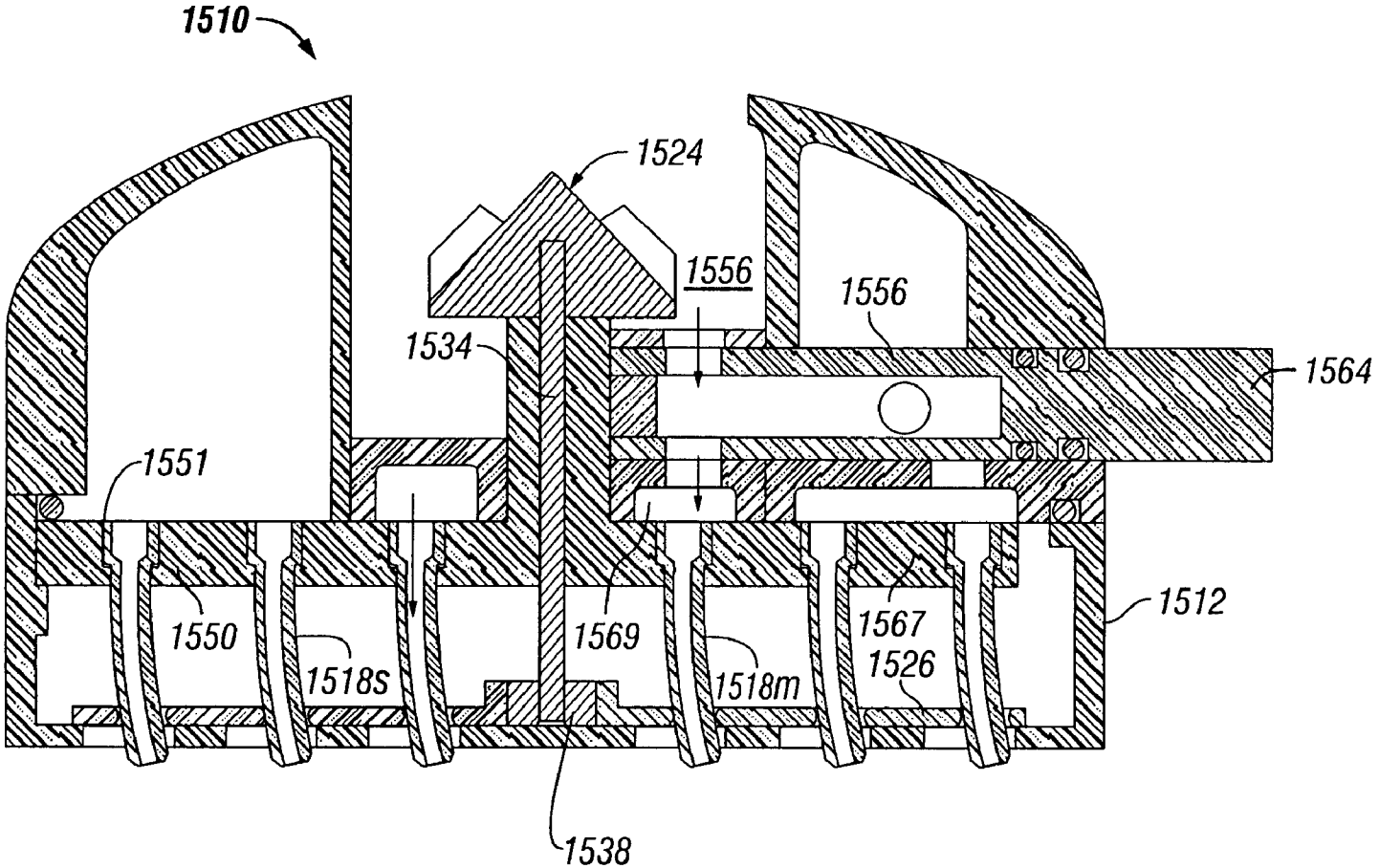

FIGS. 15 and 15A show sectional side views of another embodiment of a spray apparatus 1510 that is similar to that of FIG. 12, but employing a camshaft 1534 rather than a crankshaft. The turbine thus employs an eccentric or cam portion 1538 carried about the shaft 1534 for rotation within the orifice 1528 of the integrating member 1520. Accordingly, spinning of the turbine 1524 about the axis of the shaft 1534 results in nutation of the turbine cam 1538 sufficient to oscillate the integrating member 1520.

The spray apparatus 1510 is further equipped with a flow diverter system 1562 for achieving a massage effect. The flow diverter system 1562 includes an adjustable manifold or plug valve body 1566 disposed within a cylindrical bore in the housing above the second planar member for directing fluid in the flow chamber 1556 to either: an outer sub-plurality of the noncentral orifices 1551 of the second planar member 1550, via shower chamber 1567; an inner sub-plurality of the noncentral orifices 1551 of the second planar member 1550, via massage chamber 1569; or a combination thereof. The plug valve body 1566 is actuated by a handle 1564 that selectively rotates that plug valve body 1566 about its axis to achieve the desired flow configuration. Thus, in the configuration depicted in FIG. 15, the plug valve body 1566 has been rotated to open flow chamber 1556 to a conduit 1563 in the valve body 1566 whereby the fluid flows into channel or chamber 1567 to provide pressurized water to the outer sets of fluid-dispensing tubes 1518*s*. In the configuration depicted in FIG. 15A, the plug valve body 1566 has been rotated to open flow chamber 1556 to the channel or chamber 1569 to provide pressurized water to the inner sets of fluid-dispensing tubes 1518*m*.

Figure 16:
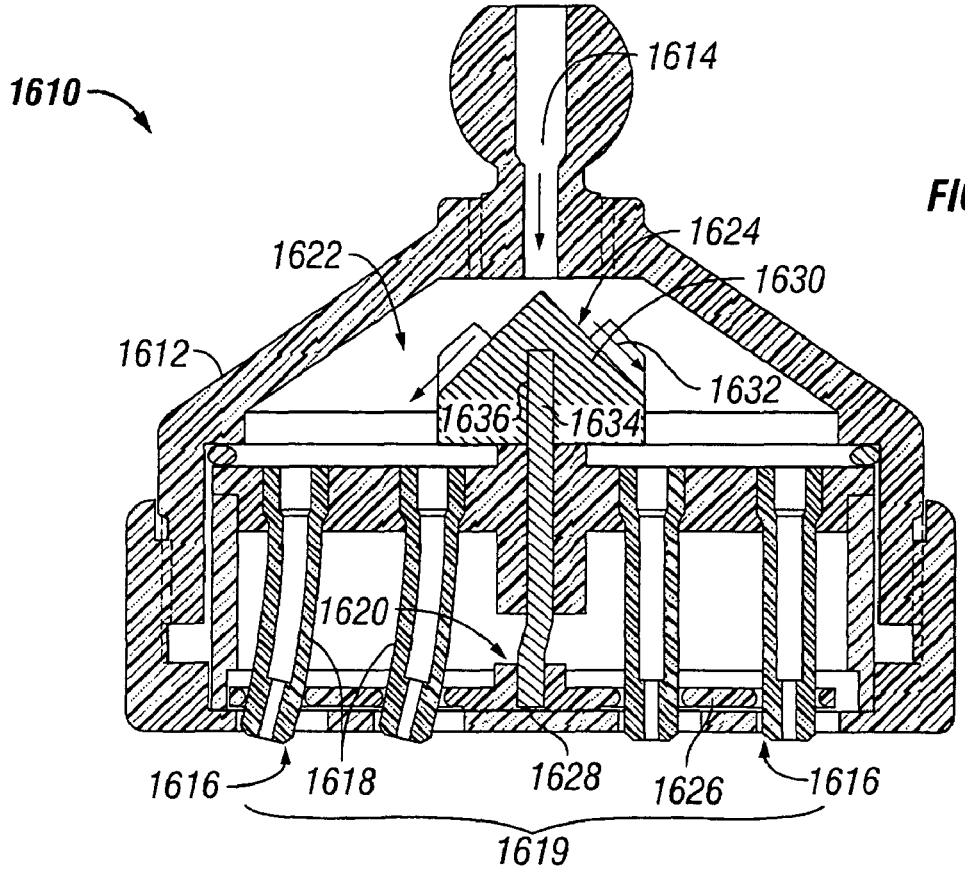
FIG. 16 shows a sectional side view of another embodiment of a spray apparatus that is similar to that of FIG. 12, but employing a semi-open turbine design instead of an enclosed turbine design, in accordance with the present invention.
Figure 17A:
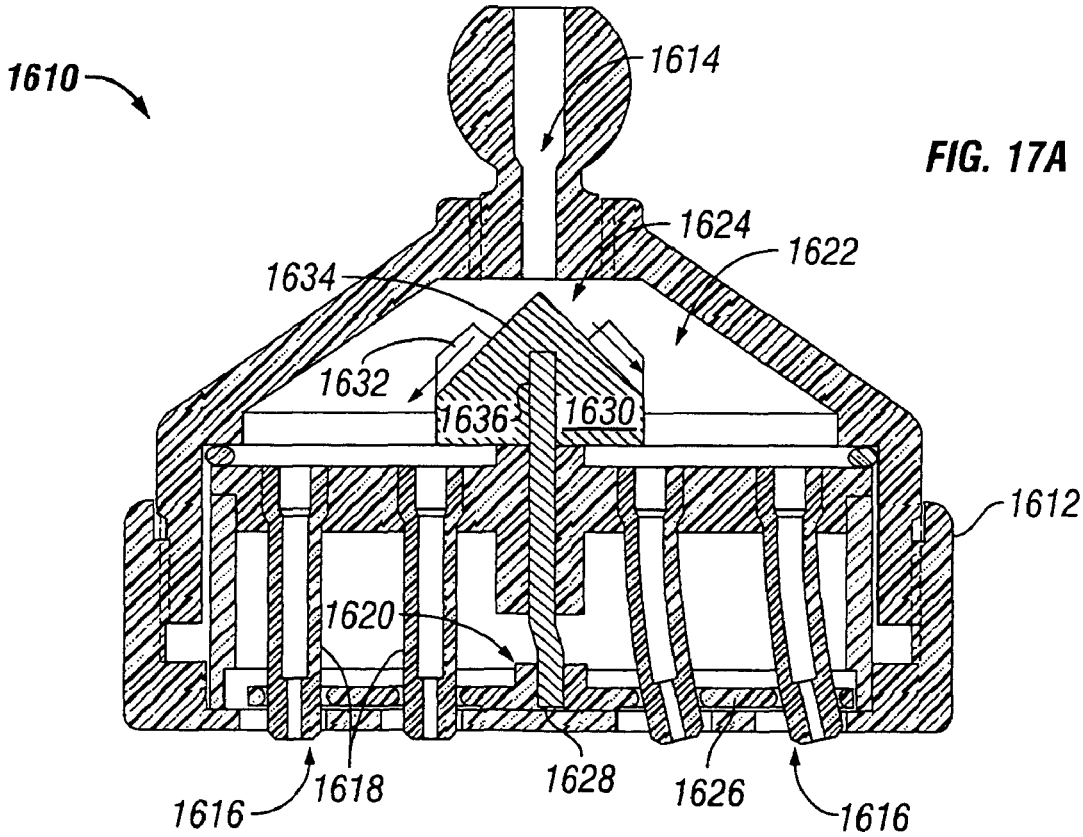
FIGS. 17A-B are sequential views of the spray apparatus of FIG. 16, showing the movement of the fluid-dispensing tubes under rotation of the turbine crankshaft and oscillation of the integrating member.
Figure 17B:
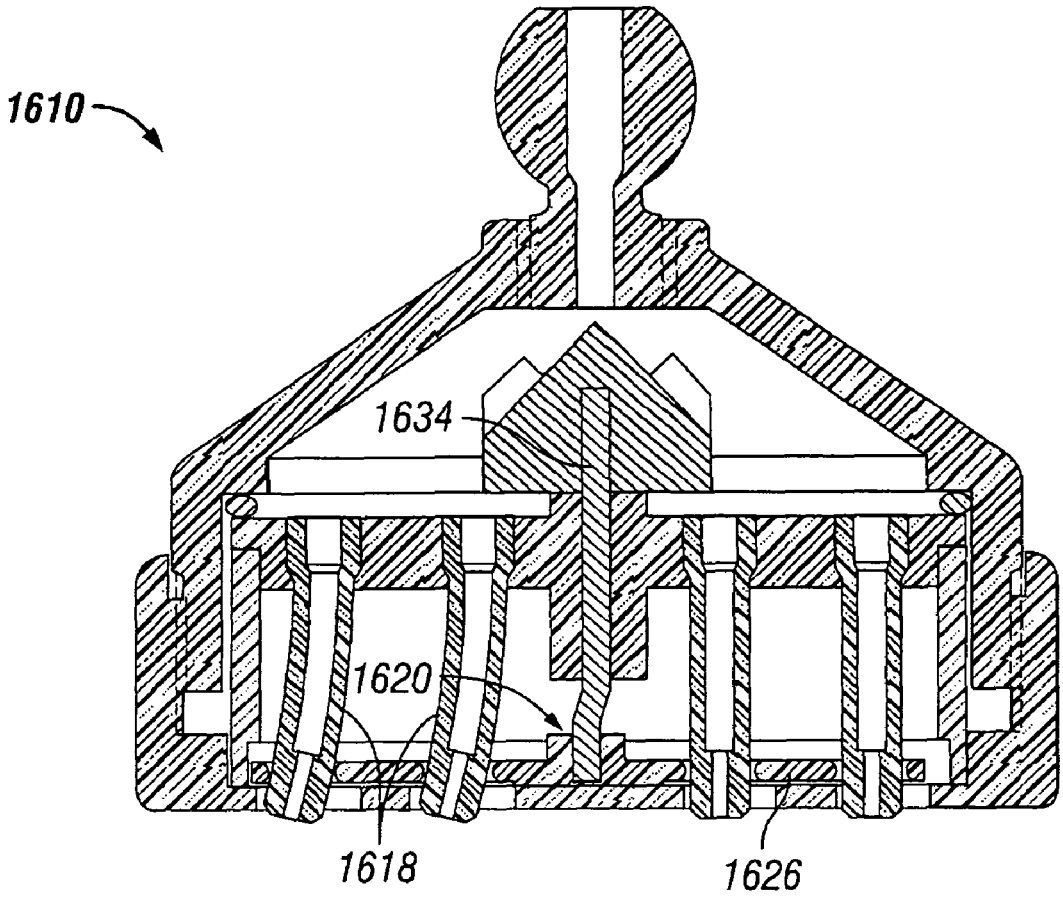
Figure 18:
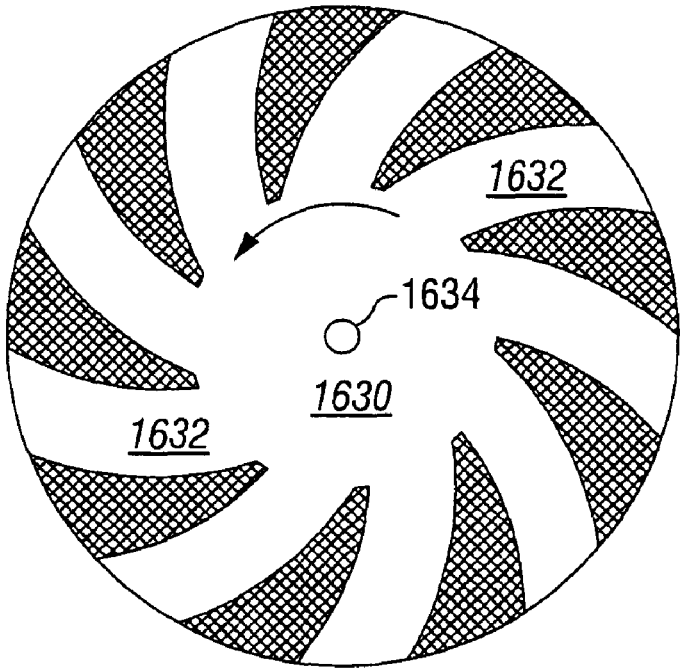
FIG. 18 shows a top view of the turbine employed by the spray apparatus of FIG. 16.

FIG. 16 shows a sectional side view of another embodiment of a spray apparatus 1610 that is similar to that of FIG. 12, but employing a semi-open turbine 1624 instead of an enclosed turbine design like the design of turbine 1224. FIGS. 17A-B are sequential views of the spray apparatus 1610 of FIG. 16, showing the movement of the fluid-dispensing tubes 1618 under rotation of the turbine crankshaft 1634 and oscillation of the integrating member 1620. In this manner, a "sweeping" shower effect is achieved. FIG. 18 shows a top view of the turbine employed by the spray apparatus of FIG. 16. The multiple angled or curved vanes 1632 of the turbine head 1630 are clearly visible.

Figure 19:
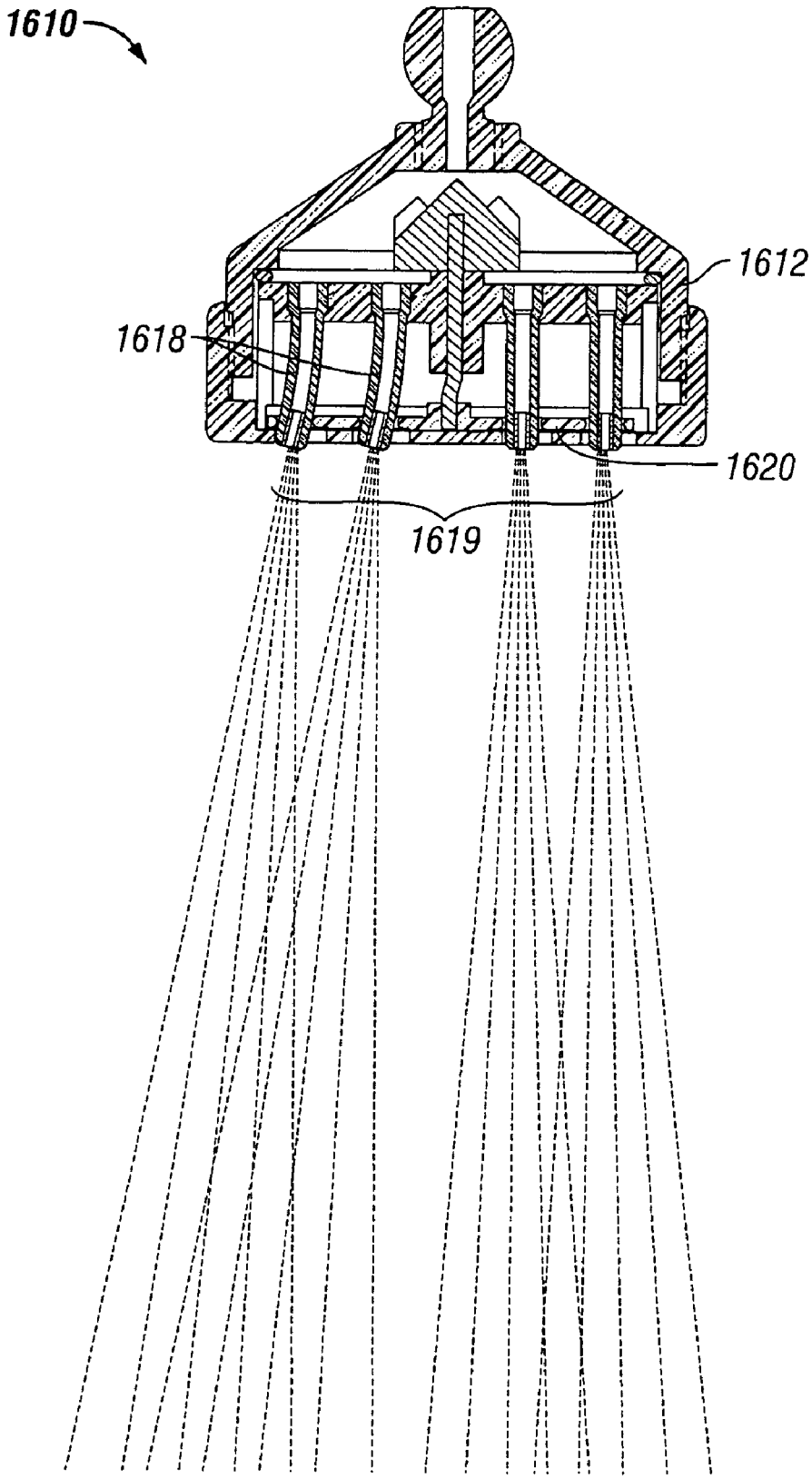
FIG. 19 shows an example of a typical conical spray pattern achievable with the fluid-dispensing tubes of the spray apparatus of FIG. 16.

FIG. 19 shows an example of a typical conical spray pattern achievable with the fluid-dispensing tubes 1618 of the spray apparatus of FIG. 16. As the integrating member 1620 oscillates within the housing 1612, each of the conical spray patterns emerging from the downstream end portions of the coupled tubes 1619 will also move in an oscillating pattern (i.e., sweep).

Figure 20:
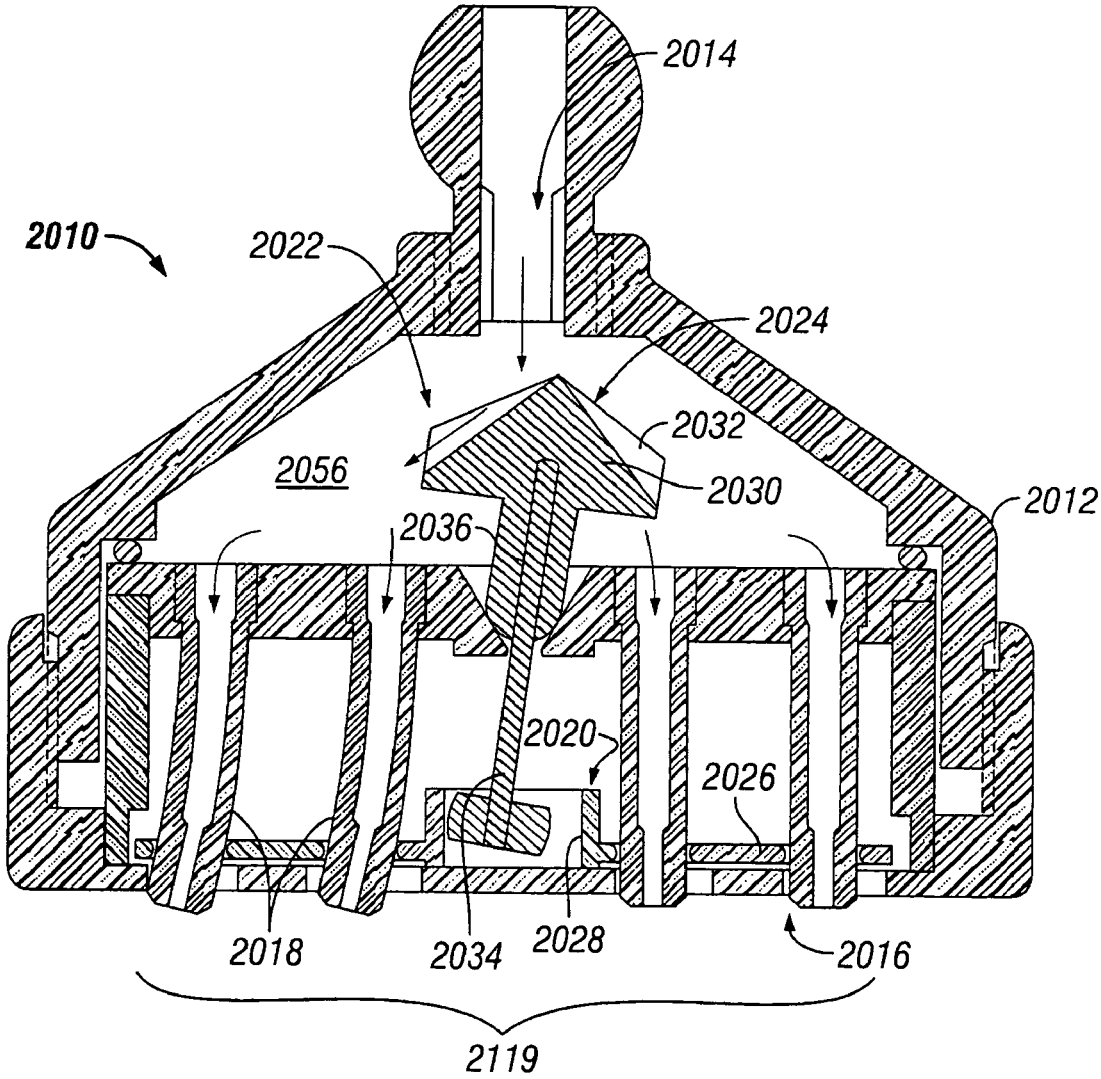
FIG. 20 shows a sectional side view of another embodiment of a spray apparatus employing a wobble turbine for oscillation of an integrating member positioned beneath the apparatus's flow chamber in accordance with the present invention.

FIG. 20 shows a sectional side view of another embodiment of a spray apparatus 2010 employing a wobble turbine 2024 for oscillation of an integrating member 2020 positioned beneath the apparatus's flow chamber 2056 in accordance with the present invention. In this embodiment, the turbine shaft 2034 is disposed for nutation within the flanged orifice 2028 of the integrating member's first planar member 2026.

Figure 21:
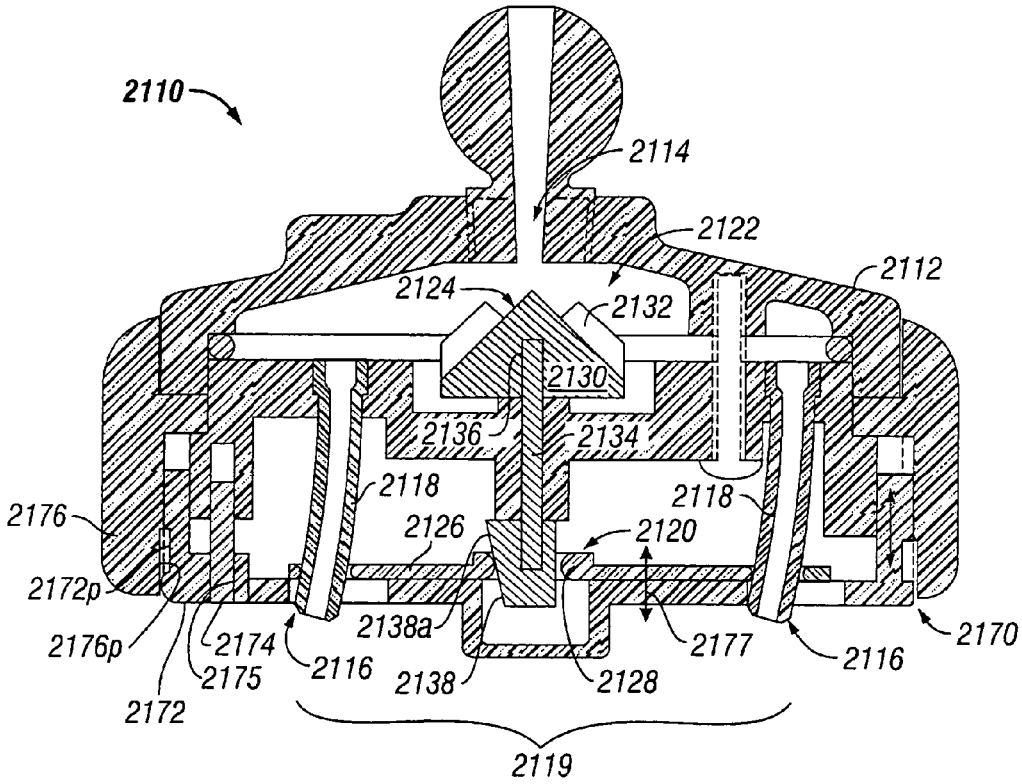
FIG. 21 shows a sectional side view of another embodiment of a spray apparatus that is similar to FIG. 16, except a camshaft is employed instead of a crankshaft and being further equipped with a system for varying the degree of oscillation by the integrating member and the resulting sprays from the fluid-dispensing tubes.

FIG. 21 shows a sectional side view of another embodiment of a spray apparatus 2110 that is similar to FIG. 16, except a camshaft 2134 is employed instead of a crankshaft. This embodiment is further equipped with a system 2170 for varying the degree of oscillation by the integrating member 2120 and the resulting sprays from the coupled fluid-dispensing tubes 2119. A cam member 2138 has a sloping vertical profile 2138*a*. The system 2170 presents a means for adjusting the elevation of the integrating member 2120 relative to the cam member 2138 so as to induce engagement of the integrating member 2120 with varying elevations of the sloping vertical profile 2138*a* of the cam member 2138. This permits the range of oscillation of the integrating member resulting from rotation of the turbine to be adjusted. More particularly, the system 2170 includes a base plate 2172 that is threaded on its periphery 2172*p*, and is prevented from rotating by one or more alignment pins 2174 disposed in one or more complementing orifices 2175 through the base plate 2172. Threads 2176*p* on the inner periphery of an adjusting sleeve 2176 engage base plate threads 2172*p*, so that rotation of the adjusting sleeve 2176 moves the base plate 2172 up or down as indicated by two-way directional line 2177. As the base plate 2172 moves up, it positions the integrating member 2120 higher on the cam profile 2138*a*, oscillating the resulting spray pattern over a wider area. Conversely, downward movement of the base plate 2172 results in a narrower oscillating range of the spray pattern. When the base plate 2172 reaches its bottom position, the rotating cam 2138 makes no contact with the integrating member 2120, and the coupled fluid-dispensing tubes 2119 have no movement. It will be further appreciated by those having skill in the art that this embodiment does not produce a change in the overall spray pattern, but is useful for varying the radius of oscillation by the integrating member 2120 so as to vary the overall shower width (i.e., oscillation area of the spray pattern).

Figure 22A:
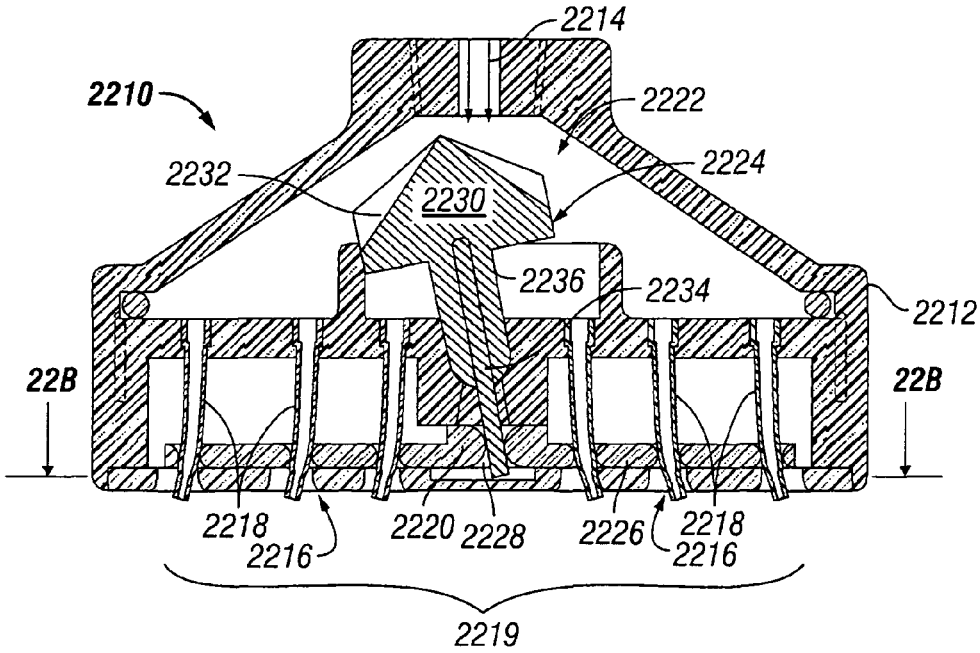
FIGS. 22A-B show sectional side and top views of another embodiment of a spray apparatus that is similar to that of FIG. 20, but employing a different wobble turbine.
Figure 22B:
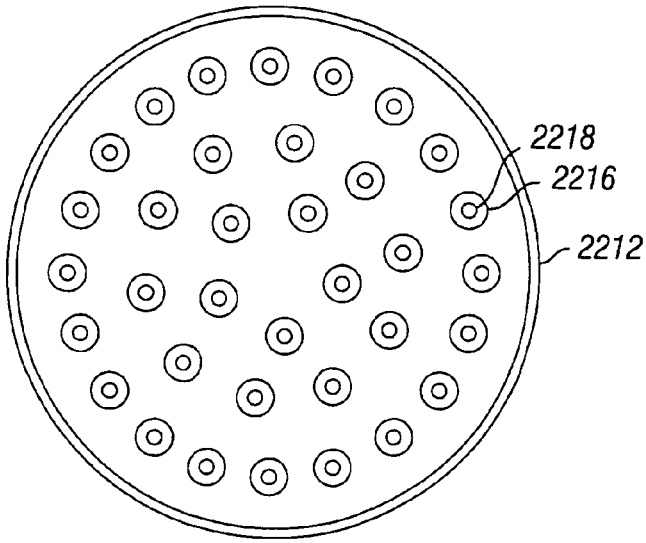

FIGS. 22A-B show sectional side and top views of another embodiment of a spray apparatus 2210 that is similar to that shown in FIG. 20, but employing a different wobble turbine 2224. The turbine shaft 2234 is disposed for nutation within the orifice 2228 of the integrating member 2220, so as to oscillate the integrating member 2220 and induce movement of the coupled fluid-dispensing tubes 2219.

Figure 23A:
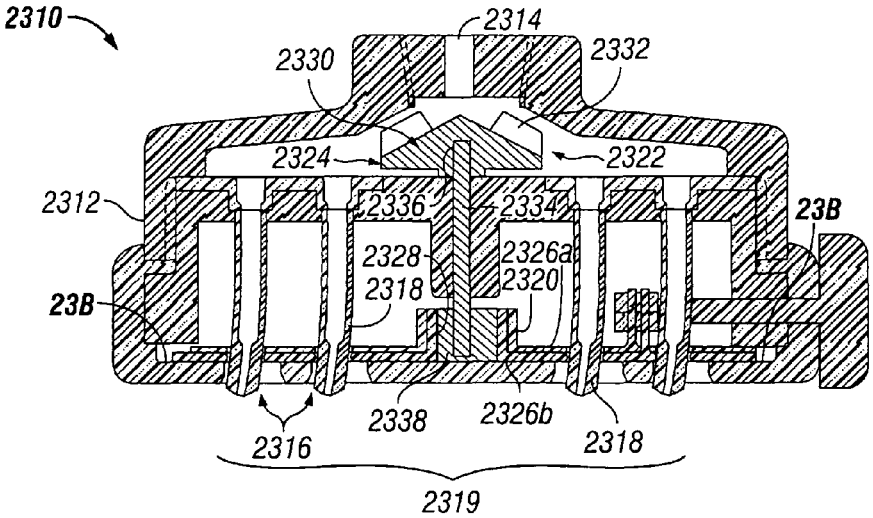
FIGS. 23A-B show sectional side and top views of another embodiment of a spray apparatus that employs an integrating member having two slotted plates for pointing the fluid-dispensing tubes to one of a plurality of nominal radial positions.
Figure 23B:
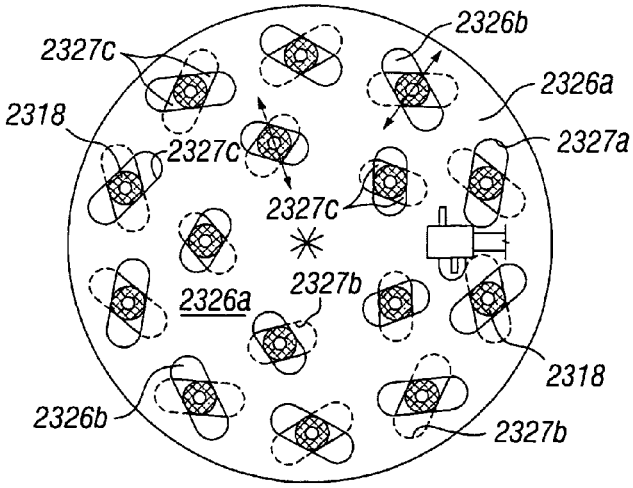

FIGS. 23A-B show sectional side and top views of another embodiment of a spray apparatus 2310 that employs an integrating member 2320 having two stacked complementary upper and lower plates 2326*a*, 2326*b* each having a plurality of slots therein for pointing the coupled fluid-dispensing tubes 2319 to one of a plurality of nominal radial positions. The slots 2327*a* of the upper plate 2326*a* overlie and are conversely oriented to respective slots 2327*b* of the lower plate 2326*b*, so as to effect a plurality of common constricted slot areas 2327*c* through the upper and lower plates for engaging the respective coupled fluid-dispensing tubes 2318 by the extension of portions of the respective coupled tubes through the common slot areas 2327*c*. Preferably, at least one of the complementary plates is rotatable with respect to the other of the complementary plates for moving the coupled tubes inwardly or outwardly with respect to the central axis.

Although the plates 2326*a*, 2326*b* of the integrating member 2320 are shown being positioned at or near the bottom of the housing 2312, an alternative embodiment of the inventive spray apparatus (not shown) positions such a control member at an elevated location within the housing, much like the location for the planar member 2482 in FIGS. 24-26 (described below). Such embodiments will employ another member to serve as the integrating member (like the integrating member 2420 of FIGS. 24-26), while the member 2320 serves to point or focus the fluid dispensing tubes 2318 without oscillating (much like the additional planar member 2482 of FIGS. 24-26).

Figure 23C:
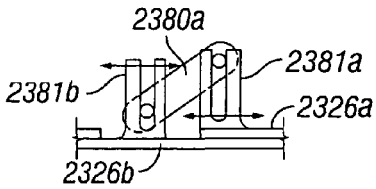
FIGS. 23C-D show alternative embodiments of cam configurations for achieving the pointing function with the two plates of the integrating member of FIG. 23A.
Figure 23D:
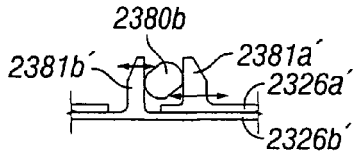

FIGS. 23C-D show alternative embodiments of cam configurations for inducing rotation of the plates 2326*a*, 2326*b* in relation to each other for achieving the desired pointing function. The respective cam configurations include cams 2380*a*, 2380*b* for engaging and adjusting the separation distance between respective boss members 2381*a-b* (FIG. 23C) and 2381*a'-b'* (FIG. 23D). As the plates 2326*a*, 2326*b* rotate in relation to each other, the tubes 2318 are moved (i.e., pointed) either toward or away from the center of the housing 2312. When pointed inwardly, the steams emerging from the fluid-dispensing tubes 2318 are focused to a relatively narrow diameter, thereby achieving a massage effect. When the tubes 2318 are pointed outwardly, the resulting streams are moved outwardly to a diameter preferred by the bather.

Particular embodiments of the inventive spray apparatus include an additional planar member supported for limited rotation about the central axis within the housing. Thus, with reference first to FIGS. 24-26, the additional planar member 2482 includes a plurality of noncentral angularly-oriented, inner and outer slots 2483, 2484 for engaging portions 2418*c* of the respective coupled fluid-dispensing tubes 2419 intermediate the downstream and upstream portions of the tubes 2419 by the extension of the coupled tube portions 2418*c* through the plurality of noncentral slots 2483, 2484 of the additional planar member 2482—which may also be considered an additional integrating member in view of (first) integrating member 2420. The additional planar member 2482 is rotatable with respect to the housing 2412 for moving the coupled tube portions 2418*c* inwardly or outwardly with respect to the central axis of the housing 2412. Upper retaining sleeves 2450*a* depend from the second planar member 2450 for constraining the motion of the tubes 2418 to radially inward or radially outward motion (as opposed to tangential motion) under engagement with the additional planar member 2482. This rotation is preferably achieved using an actuator 2485 carried on the housing. The actuator 2485 includes a handle 2486 connected to a shaft 2487 extending through a slot 2412*a* in the body 2412 and carrying a key 2488. The key 2488 is disposed in a further slot 2482*s* in the planar member 2482, such that sliding movement of handle 2486 sideways along the periphery of the body 2412 (i.e., in or out of the page in FIG. 25) induces rotation of the planar member 2482 about a central axis within the housing 2412.

Figure 24A:
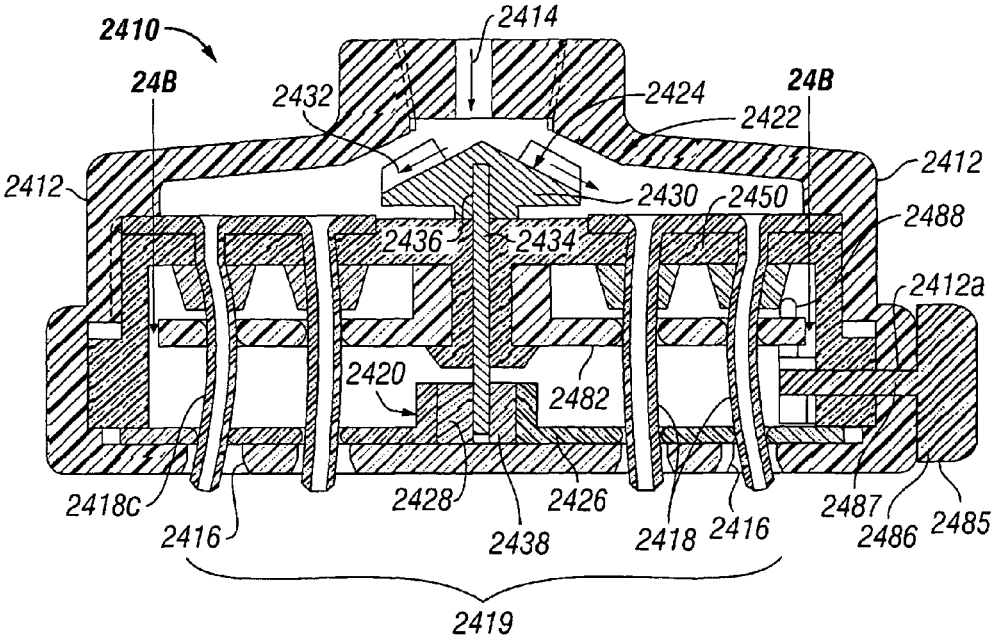
FIGS. 24A-B show sectional side and top views of another embodiment of a spray apparatus that employs an integrating member having a slotted plate for pointing the fluid-dispensing tubes to one of a plurality of nominal radial positions in accordance with the present invention.
Figure 24B:
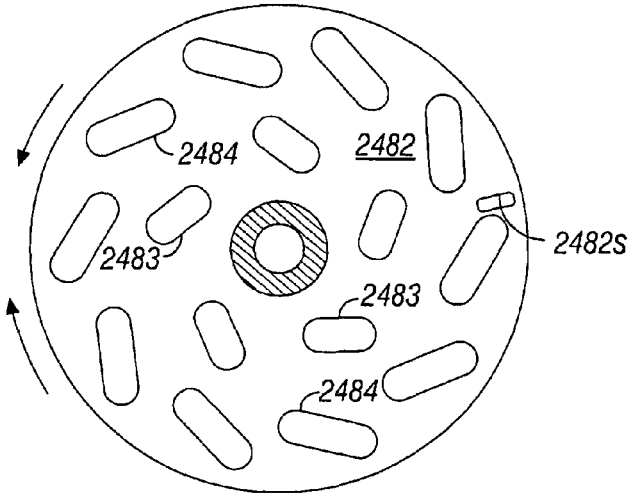
Figure 25:
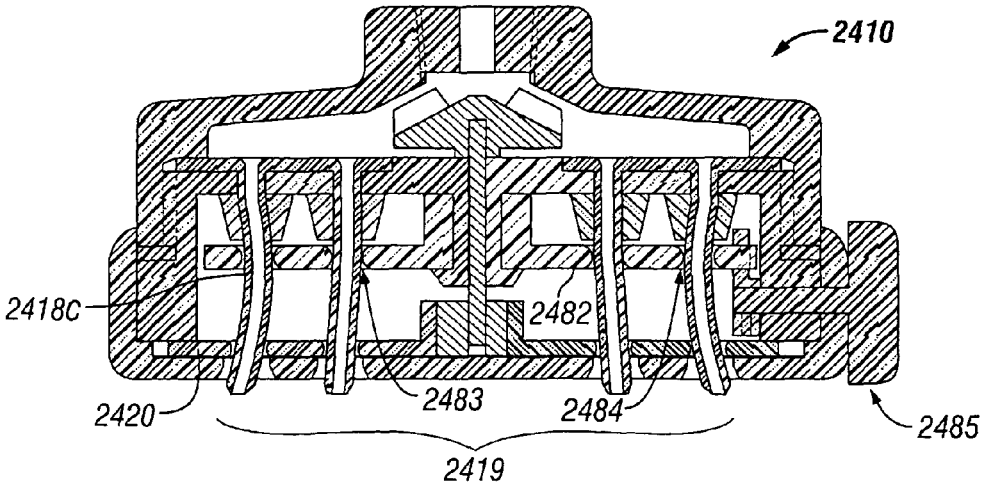
FIGS. 25-26 show the spray apparatus of FIG. 24 wherein the fluid-dispensing tubes are pointed to achieve wide (FIG. 25) and narrow (FIG. 26) nominal spray widths.
Figure 26:
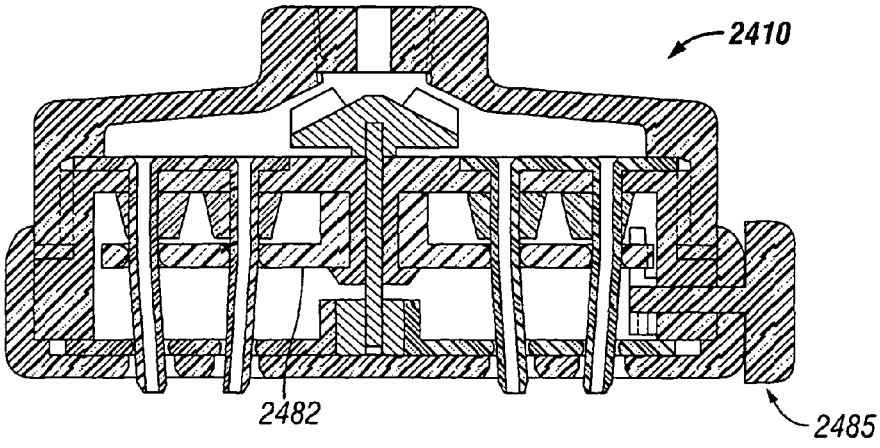
Figure 27:
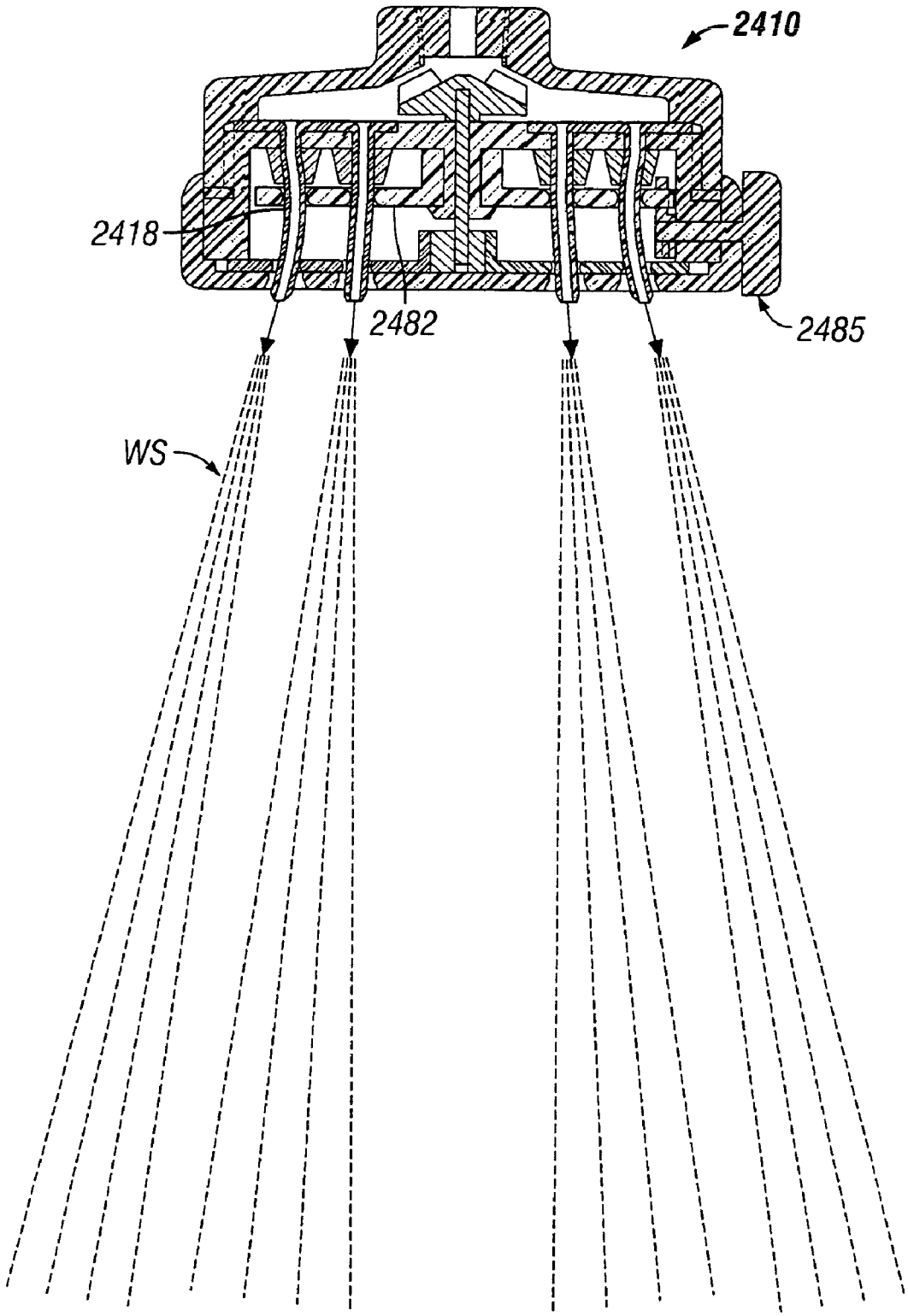
FIGS. 27-28 show the respective wide and narrow nominal spray widths achievable with the spray apparatus of FIG. 24.
Figure 28:
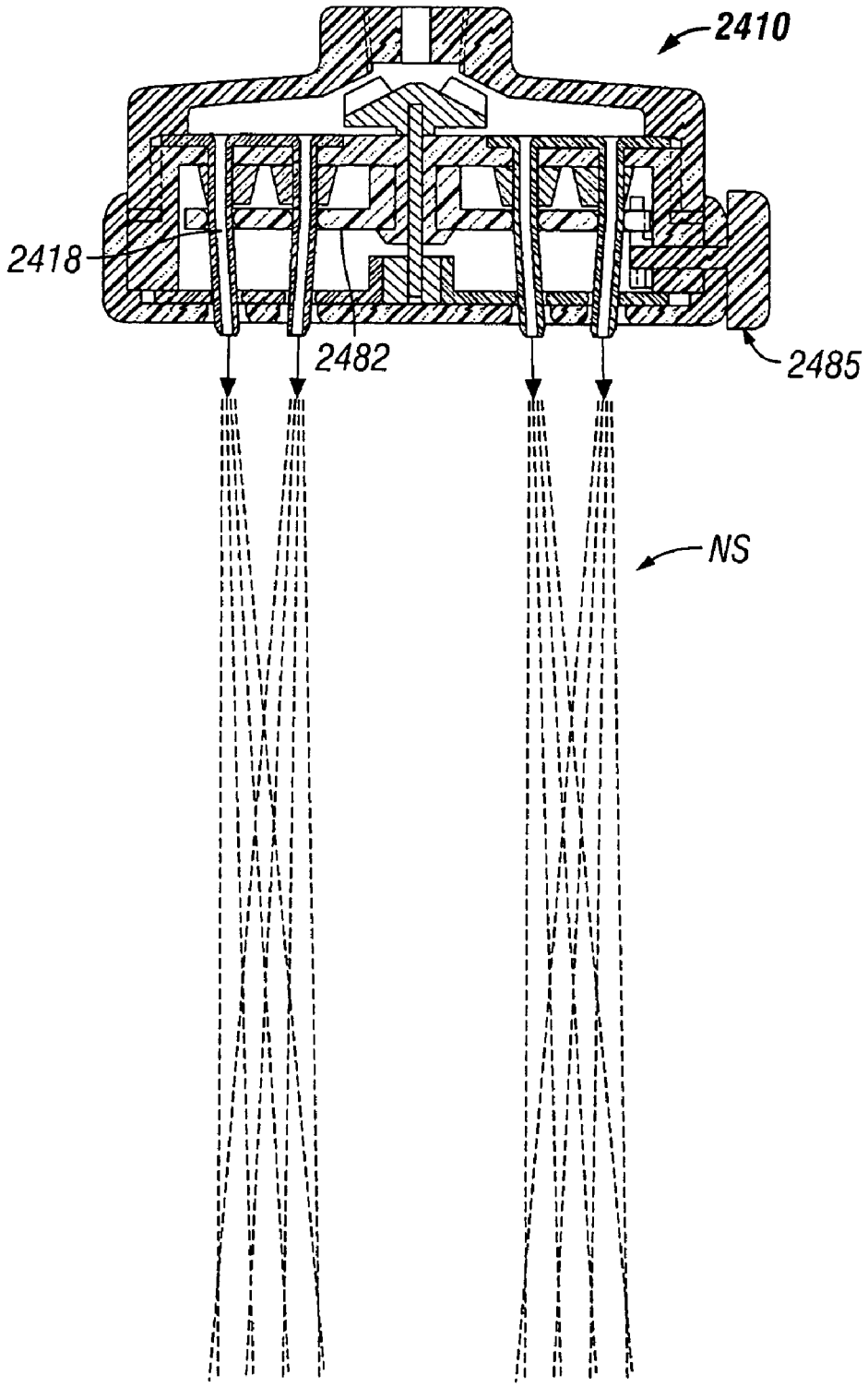

FIGS. 25-26 show the spray apparatus of FIG. 24 wherein the fluid-dispensing tubes are pointed, or focused, by selective rotation of the additional planar member 2482 with the actuator 2485 to achieve wide (FIG. 25) and narrow (FIG. 26) nominal spray widths from the tubes 2418. FIGS. 27-28 show the respective wide and narrow nominal spray widths WS, NS achievable with the spray apparatus of FIG. 24.

Figure 29A:
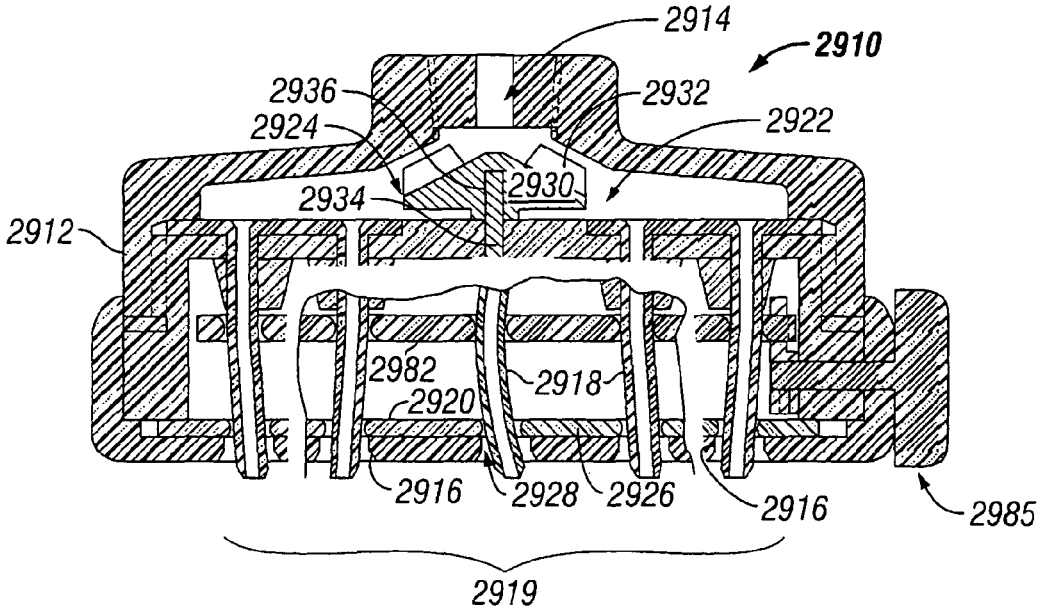
FIGS. 29A-B show sectional side views, in respective wide and narrow spray positions, of another embodiment of a spray apparatus that is similar to FIG. 24, except the fluid-dispensing tubes are not equipped with upper retaining sleeves as in FIG. 24, in accordance with the present invention.
Figure 29B:
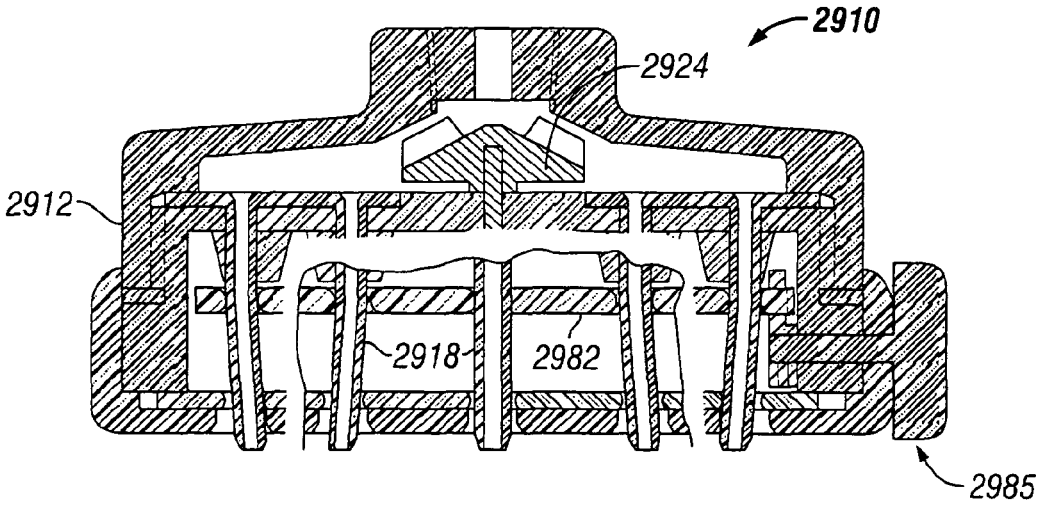
Figure 30:
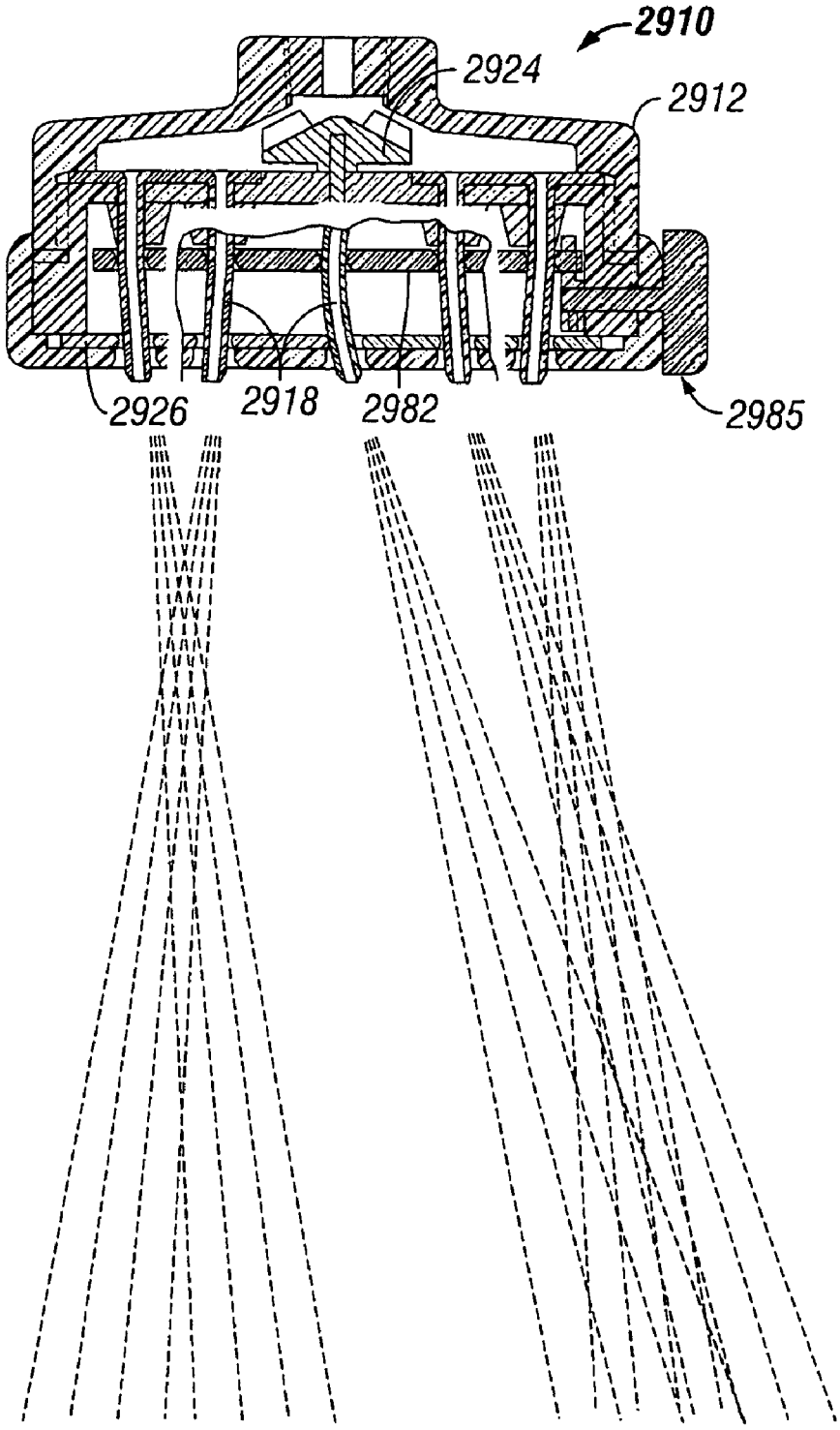
FIG. 30 is similar to FIG. 29A, but showing the spray patterns emerging from various fluid-dispensing tubes.

FIGS. 29A-B show sectional side views, in respective wide and narrow spray positions, of another embodiment of a spray apparatus 2910 that is similar to the embodiment of FIG. 24, except the fluid-dispensing tubes are not equipped with upper retaining sleeves 2450*a* as in FIG. 24. The embodiment of FIGS. 29A-B is therefore adapted for applying a particular tangential force component to the fluid-dispensing tubes 2918 via the additional planar member 2982 and actuator 2985 for width adjustment of the resulting spray. In the nominal position, when the tubes 2918 have no tangential force component applied, the resulting spray exhibits its minimum width, focusing to the preferred cross section (similar to that shown in FIG. 28). Rotation of the focusing disk puts a tangential component on the nozzles, whereby the spray may be set to its maximum width as shown in the expanded view of FIG. 30.

In a further alternative embodiment (not shown) to the embodiment described above, the additional planar member 2982 is eliminated and the integrating member 2920 is relocated to a more centrally elevated position within the housing 2912 (i.e., to the position of the eliminated planar member 2982). In this embodiment, the outlets 2916 would be sized and shaped to fit snugly about the tubes 2918 so as to ensure that the downstream ends of the tubes are pointed in the desired direction under engagement by the elevated integrating member 2920.

Figure 31A:
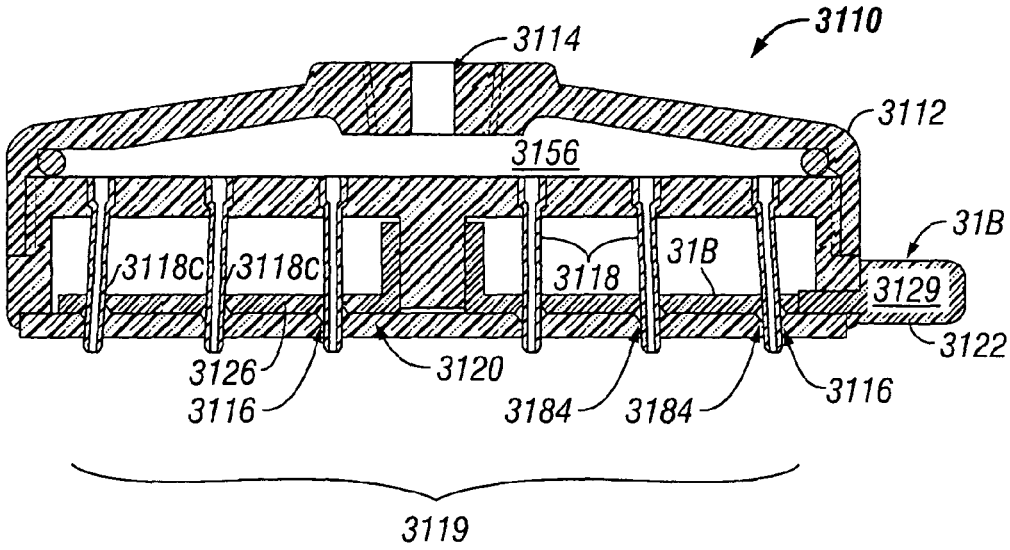
FIGS. 31A-B show sectional side and (partial) top views another embodiment of a spray apparatus employing an integrating member positioned beneath the apparatus's flow chamber, but having no turbine, in accordance with another aspect the present invention.
Figure 31B:
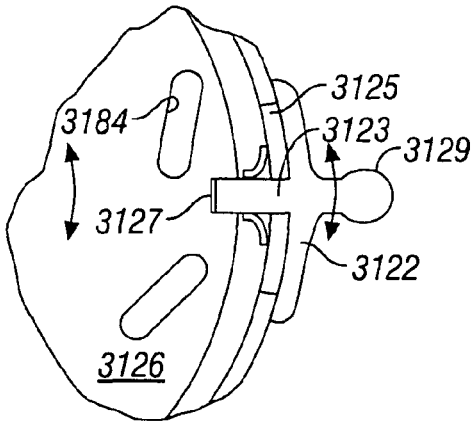

FIGS. 31A-B show sectional side and (partial) top views another embodiment of a spray apparatus 3110 employing an integrating member 3120 positioned beneath the apparatus's flow chamber 3156, but having no turbine, in accordance with another aspect the present invention. The spray apparatus 3110 includes a housing 3112 having a fluid inlet 3114 and a plurality of fluid outlets 3116. A plurality of tubes 3118 are each disposed in one of the fluid outlets 3116 for dispensing fluid from the housing 3112. The integrating member 3120 is operatively coupled to at least a subset 3119 of the plurality of tubes 3118 at locations 3118*c* between the fluid inlet 3114 and fluid outlets 3116 for effecting coordinated movement of the coupled tubes 3119 in the respective plurality of fluid outlets 3116 in response to movement of the integrating member 3120. An actuator 3122 is also provided for inducing movement of the integrating member.

The first planar member 3126 of the integrating member 3120 includes a plurality of angularly-oriented slots 3184 for engaging portions 3118*c* of the respective coupled tubes 3119 by the extension of the coupled tube portions 3118*c* through the plurality of angularly-oriented slots 3184. The integrating member 3120 is rotatable by the actuator 3122 with respect to the housing 3112 for moving the coupled tube portions 3118*c*. The actuator 3122 preferably includes a slidable lever 3129, best shown in FIG. 31B, extending through a slot 3125 formed in a side wall of the housing 3112. The lever 3129 is disposed outside the housing 3112, and has an inner portion 3123 that engages the first planar member 3126 of the integrating member 3120 at a peripheral slot 3127.

Figure 32:
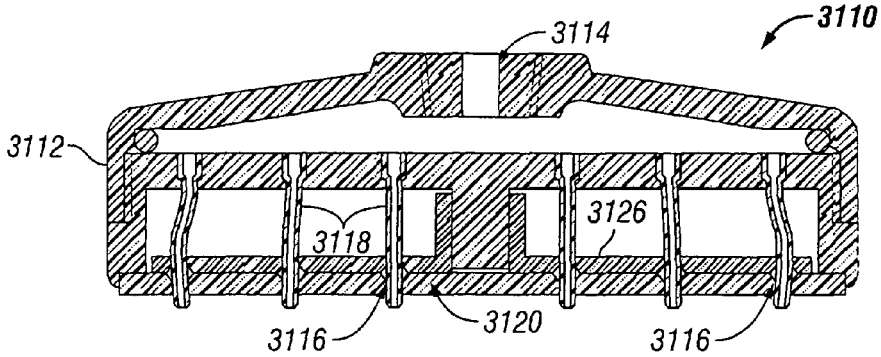
FIG. 32 shows the spray apparatus of FIG. 31A set in a narrow spray position, as contrasted with the normal spray position of FIG. 31A.

FIG. 32 shows the spray apparatus of FIG. 31A set in a narrow spray position using the actuator 3122 (not shown in FIG. 32), as contrasted with the nominal (wide) spray position of FIG. 31A. Other than movement provided by the actuator 3122, the fluid-dispensing tubes 3118 of this embodiment are stationary since there is no other continuous actuation like that provided by the turbine of the other embodiments described herein.

Figure 33A:
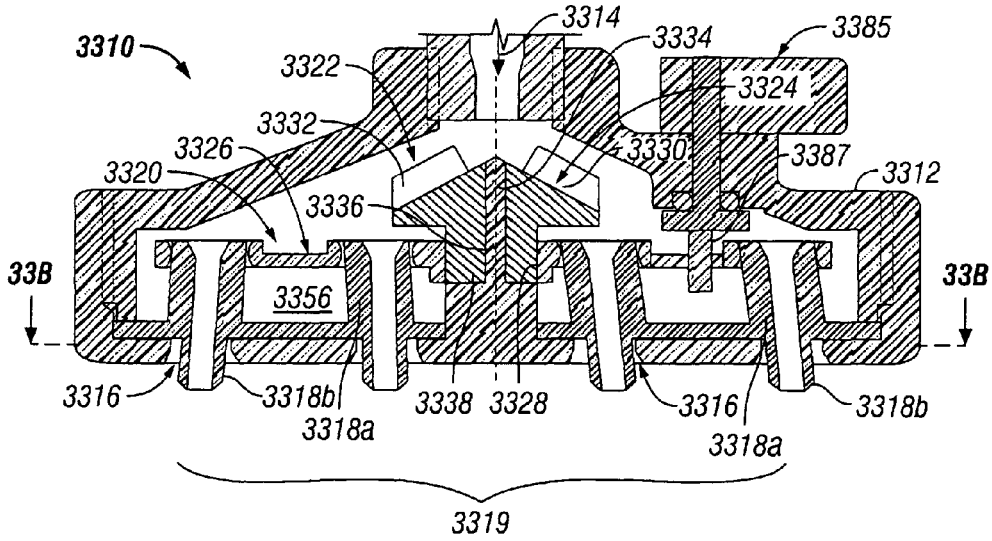
FIGS. 33A-B show sectional side and top views of an alternative embodiment of a spray apparatus employing an integrating member disposed inside the flow chamber in accordance with the present invention.
Figure 33B:
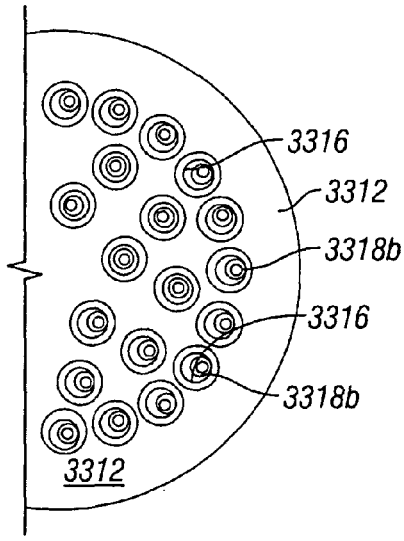

FIGS. 33A-B show sectional side and top views of an alternative embodiment of a spray apparatus 3310 employing an integrating member 3320 disposed inside the flow chamber 3356 of the housing 3312. The fluid-dispensing tubes 3318 are integrally formed, preferably by a single elastomer molding, so as to have upper wider portions 3318*a* and lower narrower portions 3318*b*. The thicker section of elastomer at tube portions 3318*a* provides sufficient stiffness to reliably move the thinner section of rubber at the tube portions 3318*b* and maintain a substantially straight centerline for each tube 3318. A supplemental actuator 3385 employs a rotatable lever 3387 to selectively stop or freeze the movement of the coupled tubes 3319. More particularly, the actuator 3385 restricts oscillatory movement of the integrating member 3320 so as to restrict movement of the coupled tubes 3319 when the bather desires non-moving (i.e., non-sweeping) shower streams.

Figure 34:
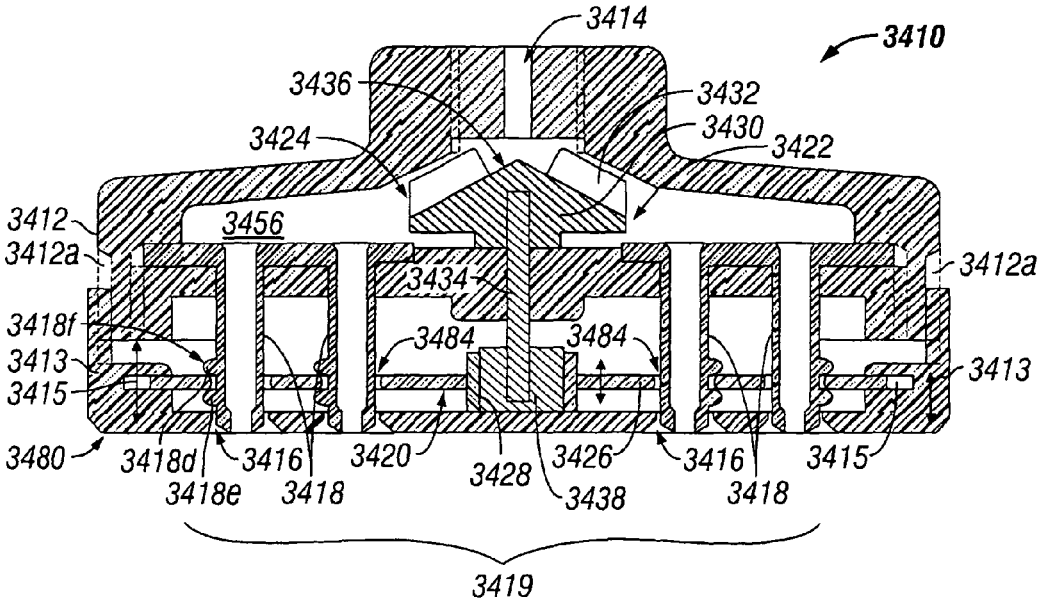
FIG. 34 shows a sectional side view of an alternative embodiment of a spray apparatus employing an integrating member disposed beneath the flow chamber and an alternative system for pointing the fluid-dispensing tubes in accordance with the present invention.

FIG. 34 shows a sectional side view of an alternative embodiment of a spray apparatus 3410 employing an integrating member 3420 disposed beneath the flow chamber 3456. The turbine 3424 includes an eccentric member or cam portion 3438 affixed about the turbine shaft 3434 opposite the turbine head 3430 such that the cam portion 3438 rotates with the turbine head 3430. The cam portion 3438 is carried within the orifice 3428 of the first planar member 3426 of the integrating member 3420, and is nutated by rotation of the turbine head 3430 to induce orbiting of the integrating member 3420.

Figure 34A:
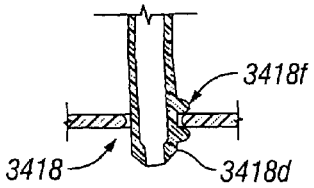
FIGS. 34A-B show detailed sectional side views of a fluid-dispensing tube being positioned for respective widened and narrowed spray patterns.
Figure 34B:
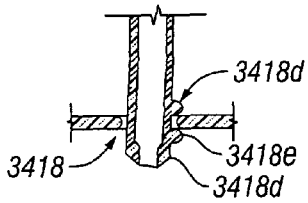

A means 3480 is further provided in this embodiment of the present invention for selectively pointing downstream end portions 3418*d* of the plurality of coupled tubes 3419. Accordingly, each of the coupled tubes 3419 preferably includes an elastomeric material such as a suitable rubber material. The pointing means 3480 preferably includes a set of spaced-apart protuberances 3418*d-e* on an outer surface of each of the coupled tubes 3419 defining a side recess 3418*f* between the protuberances. Each of the coupled tubes 3419 is disposed in one of a plurality of noncentral orifices 3484 formed in the first planar member 3426, in such a manner that the first planar member 3426 is connected to the plurality of coupled tubes 3419 via the side recesses 3418*d-e*. An internally-threaded sleeve 3413 is carried for rotation about an externally-threaded sidewall portion 3412*a* of the housing 3412. The sleeve 3413 has an annular groove 3415 formed in an inner surface thereof within which the first planar member 3426 is circumferentially carried. Thus, rotation of the sleeve 3413 induces vertical movement of the first planar member 3426 that applies a vertical force to the coupled tubes 3419 at the respective side recesses 3418*f*. FIGS. 34A-B show detailed sectional side views of a fluid-dispensing tube 3418 being positioned for respective widened and narrowed spray patterns.

Figure 35:
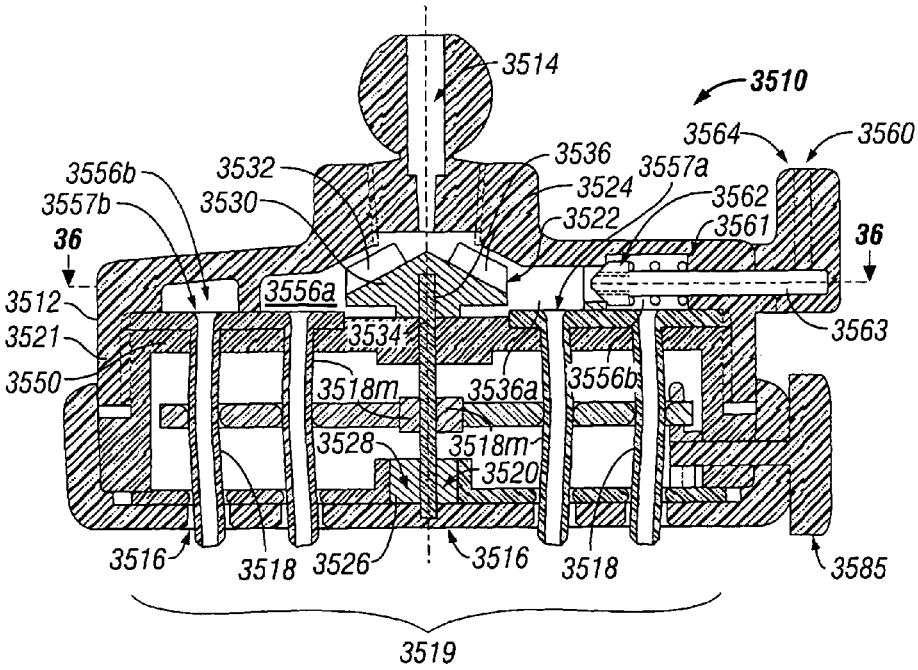
FIG. 35 shows an alternative embodiment of a spray apparatus that is similar to that of FIG. 29, but being further equipped with a diverter system for achieving a massage effect.
Figure 36:
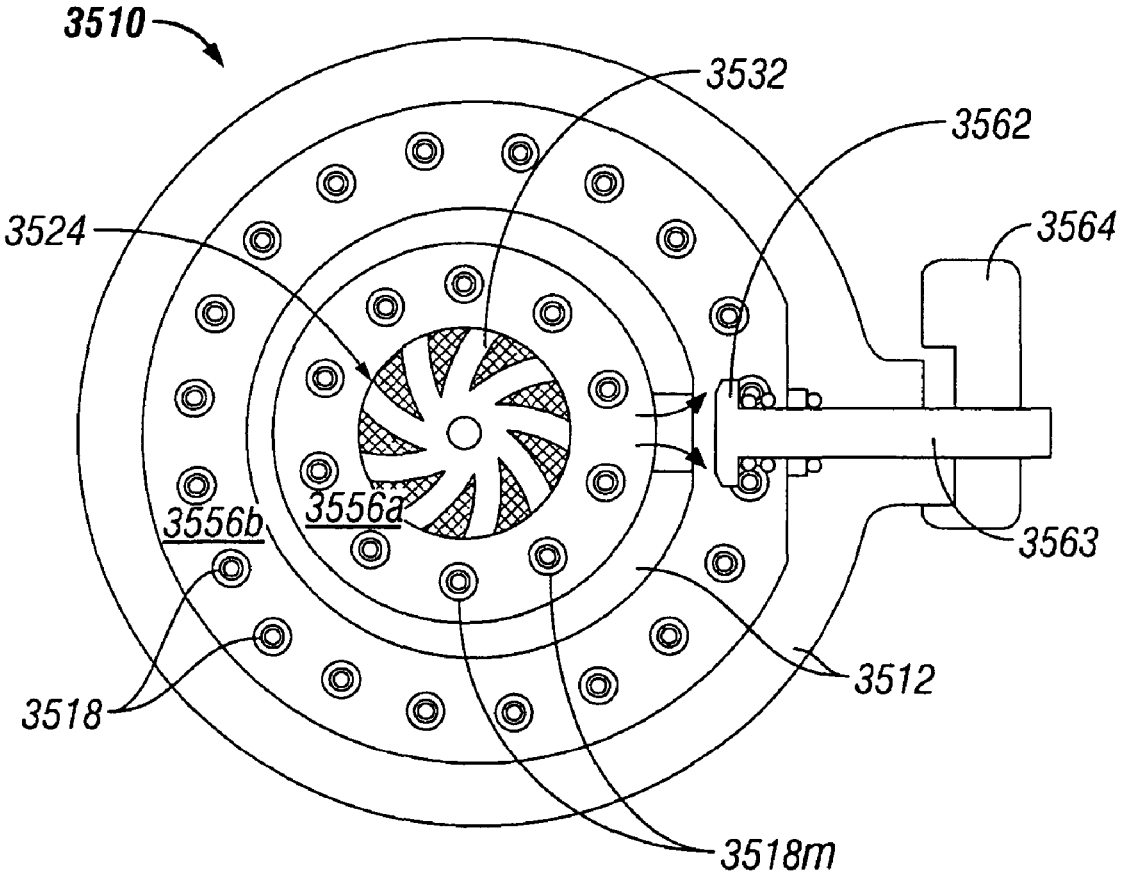
FIG. 36 is a sectional top view of the spray apparatus of FIG. 35.

FIGS. 35-36 show an alternative embodiment of a spray apparatus 3510 that is similar to that of FIG. 29, but being further equipped with a diverter system 3560 for achieving a massage effect. The housing 3512 defines inner and outer flow chambers or passages 3556*a-b* for communicating with inner and outer sub-pluralities of the noncentral orifices 3557*a-b* of the second planar member 3550. The diverter system 3560 includes a valve assembly 3561 for directing fluid through the flow passages 3556*a-b* to either: the outer sub-plurality of the noncentral orifices 3557*b* of the second planar member 3550; the inner sub-plurality of the noncentral orifices 3557*a* of the second planar member 3550; or a combination thereof. The valve assembly preferably includes a stop valve 3562 having a movable stem 3563 for closing flow passage 3556*b* off from flow passage 3556*a*. An actuator lever 3564 is useful for moving the valve stem 3563 and stop valve 3562 as desired to direct the fluid flow. This embodiment uses the center tubes 3518*m* fed by inner orifices 3557*a* for achieving a massage effect. When the valve 3561 is closed, no water reaches the outer tubes fed by the outer orifices 3557*b*. As a result, pressure builds up on the inner tubes. Accordingly, when the tubes 3518 are focused to achieve a narrow spray using actuator 3585 (as in FIG. 28) while the valve 3561 is closed, the inner tubes will experience relatively high water pressure to create a focused massage effect.

Figure 37:
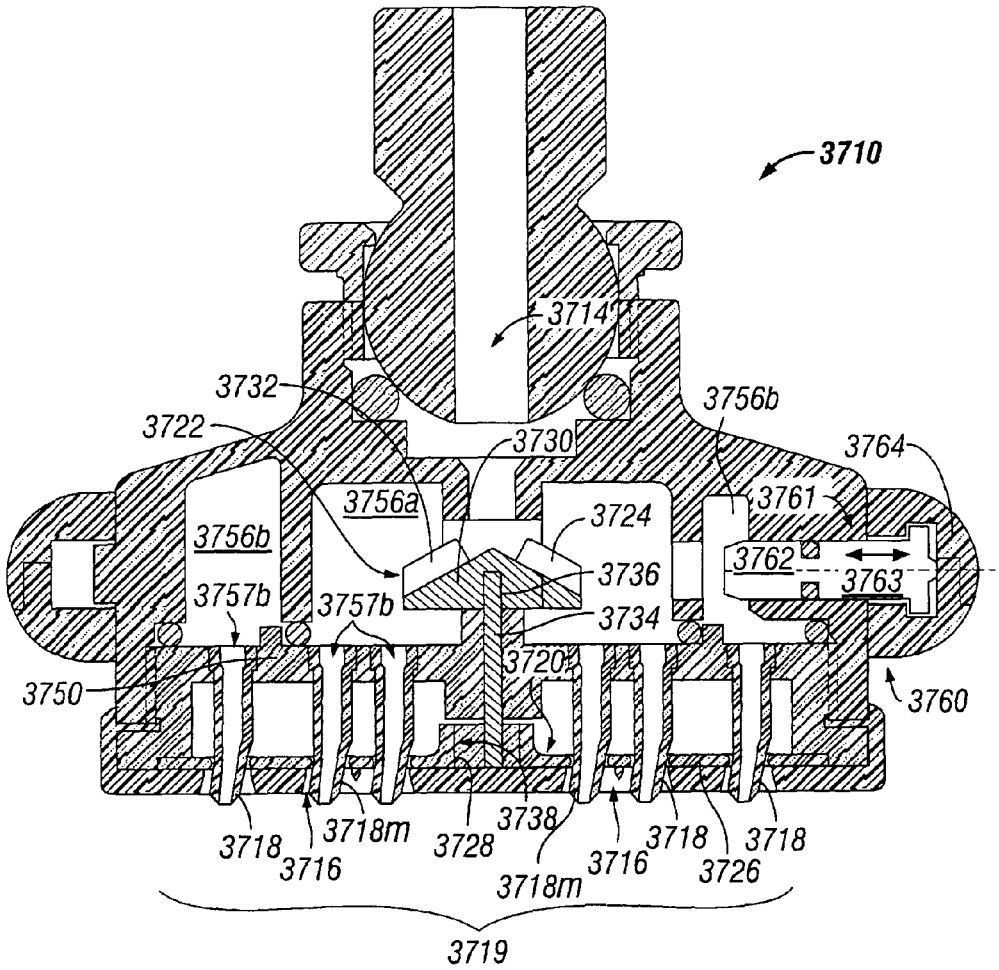
FIG. 37 shows a sectional side view of another embodiment of a spray apparatus that is similar to that of FIG. 15, but employing an alternative flow diverter system for achieving a massage effect in accordance with the present invention.

FIG. 37 shows a sectional side view of another embodiment of a spray apparatus 3710 that is similar to that of FIG. 15, but employing an alternative flow diverter system 3760 for achieving a massage effect in accordance with the present invention. The flow diverter system 3760 is analogous to that shown in FIG. 35, and includes a valve assembly 3761 for directing fluid through the flow chambers or passages 3756*a-b* to either: an outer sub-plurality of noncentral orifices 3757*b* of the second planar member 3750; an inner sub-plurality of noncentral orifices 3757*a* of the second planar member 3750; or a combination thereof. The valve assembly preferably includes a stop valve 3762 having a movable stem 3763 for closing flow passage 3756*b* off from flow passage 3756*a*. An actuator ring 3764 is useful for moving the valve stem 3763 and stop valve 3762 as desired to direct the fluid flow. The actuator ring 3764 has an inside track with a smoothly-varying radius (like that of FIG. 40C), which forces the valve stem 3763 inwardly or outwardly as the ring 3764 is rotated. This embodiment thus uses the center tubes 3718*m* fed by inner orifices 3757*a* for achieving a massage effect. When the valve 3761 is closed, no water reaches the outer tubes fed by the outer orifices 3757*b*. As a result, pressure builds up on the inner tubes 3718*m*.

Figure 38:
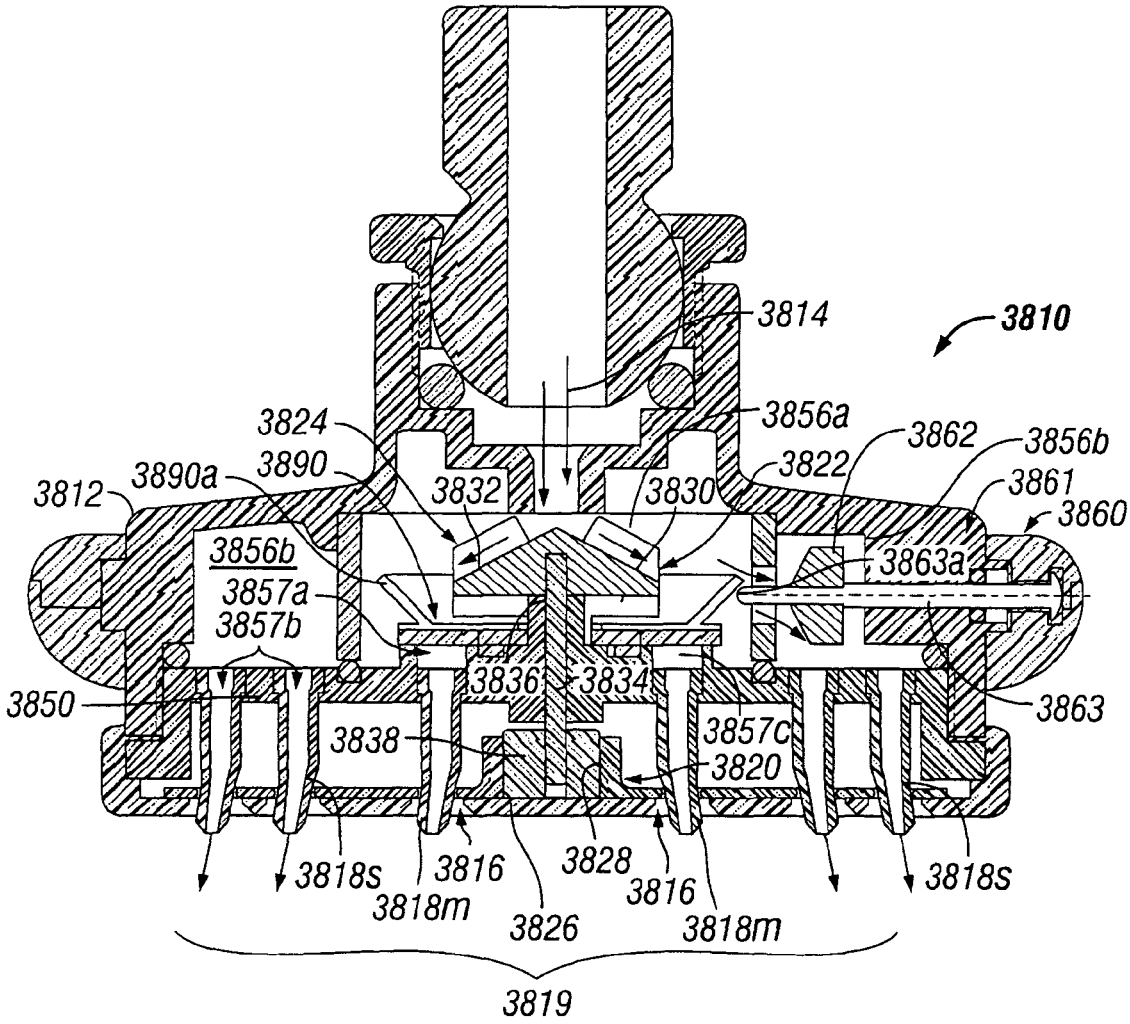
FIGS. 38-39 show sequential, sectional side views of another embodiment of a spray apparatus that is similar to that of FIG. 37, but employing an alternative flow diverter system for achieving a massage effect in accordance with the present invention.
Figure 39:
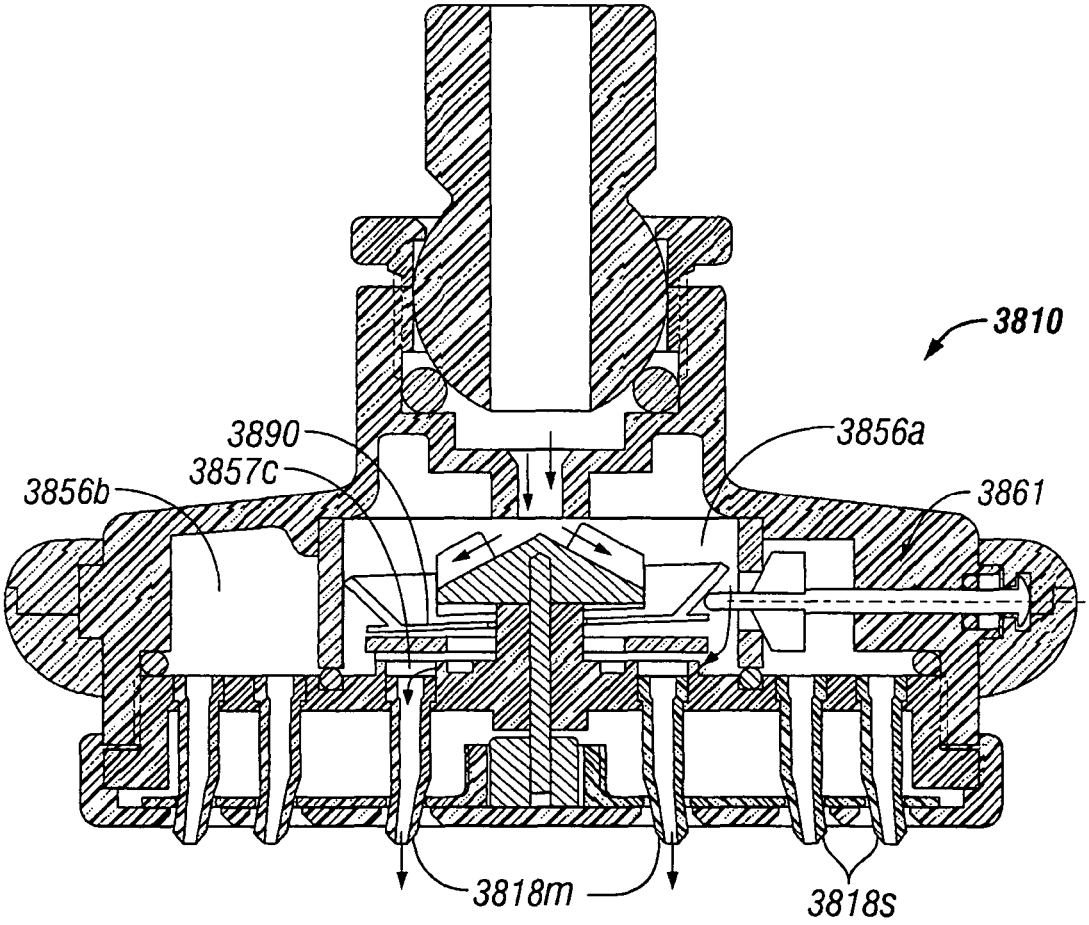

FIGS. 38-39 show sequential, sectional side views of another embodiment of a spray apparatus 3810 that is similar to that of FIG. 37, but employing an alternative flow diverter system 3860 for achieving a massage effect in accordance with the present invention. In this embodiment, the inventive spray apparatus further includes a third planar member 3890 for removably covering the inner sub-plurality of noncentral orifices 3857*a*—interconnected by a channel 3857*c*—of the second planar member 3850. The third planar member 3890 has a sloped rim 3890*a* about at least a portion thereof. A valve system 3861 includes a movable valve stem 3863 equipped with a plug 3862 and a distal end 3863*a*, such that movement of the valve stem 3863 in a radially-inward direction results in the plug 3862 closing off the fluid chamber or passage 3856*b* communicating fluid to the outer sub-plurality of noncentral orifices 3857*b* of the second planar member 3850. This movement of the valve stem 3863 in a radially-inward direction also results in the distal valve stem end 3863*a* engaging the sloped rim 3890*a* so as to remove the third planar member 3890 from the inner sub-plurality of noncentral orifices 3857*a* and channel 3857*c* of the second planar member 3850. This occurs prior to the plug 3862 closing off the fluid chamber or passage 3856*b* communicating fluid to the outer sub-plurality of noncentral orifices 3857*b* of the second planar member 3850, so that transition from the shower mode to the massage mode is gradual. When the third planar member 3890 is down, water pressure in the flow chamber or passage 3856*a* applies a downward force to the third planar member, preventing water from entering, whereby only the outer sub-plurality of noncentral orifices 3857*b* are exposed to the water pressure. When the shower valve 3861 is closed (see FIG. 39), the distal valve stem end 3863*a* tips the third planar member 3890 upwardly, opening the water supply in flow chamber 3856*a* to the inner sub-plurality of noncentral orifices 3857*a* and the massage tubes 3818*m* and closing the flow to outer orifices 3857*b*. Since there are substantially fewer of the inner orifices 3857*a* than of the outer orifices 3857*b*, the water pressure in central tubes 3818*m* (during massage mode) will be correspondingly higher than the water pressure in outer tubes 3818*s* (during shower mode).

Figure 40A:
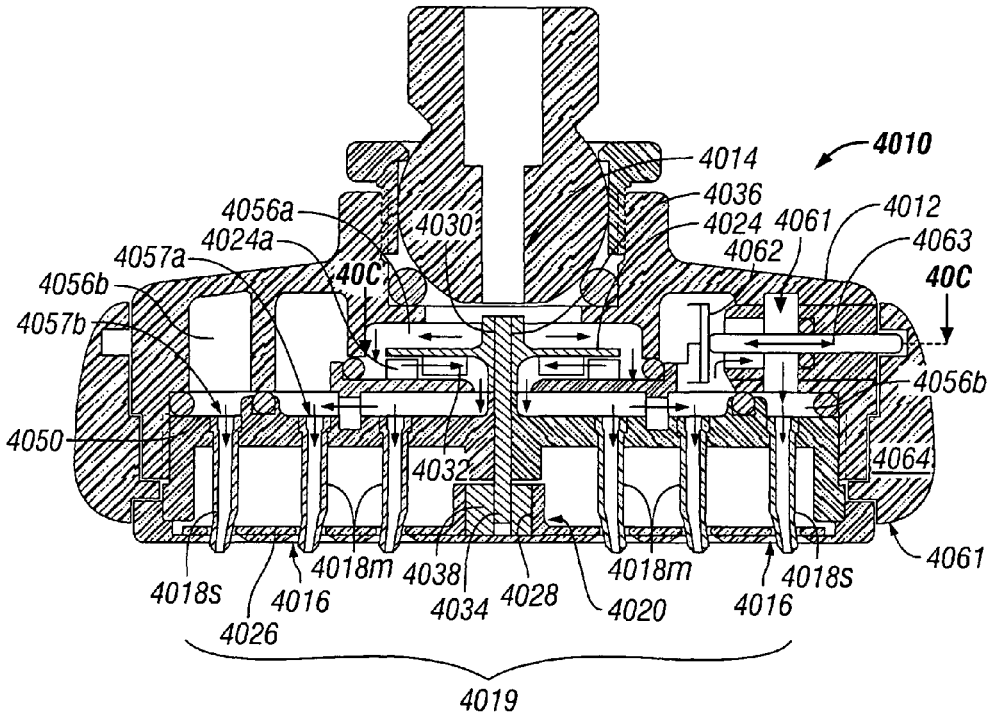
FIGS. 40A-B show sequential, sectional side views of an alternative spray apparatus employing an enclosed, peripherally-driven turbine and an alternative flow diverter system for achieving a massage effect in accordance with the present invention.
Figure 40C:
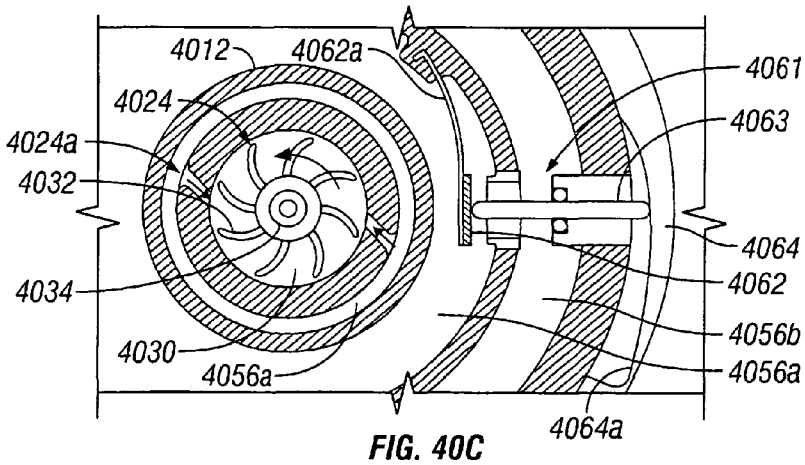
FIG. 40C shows a sectional top view of the spray apparatus of FIGS. 40A-B.
Figure 40B:
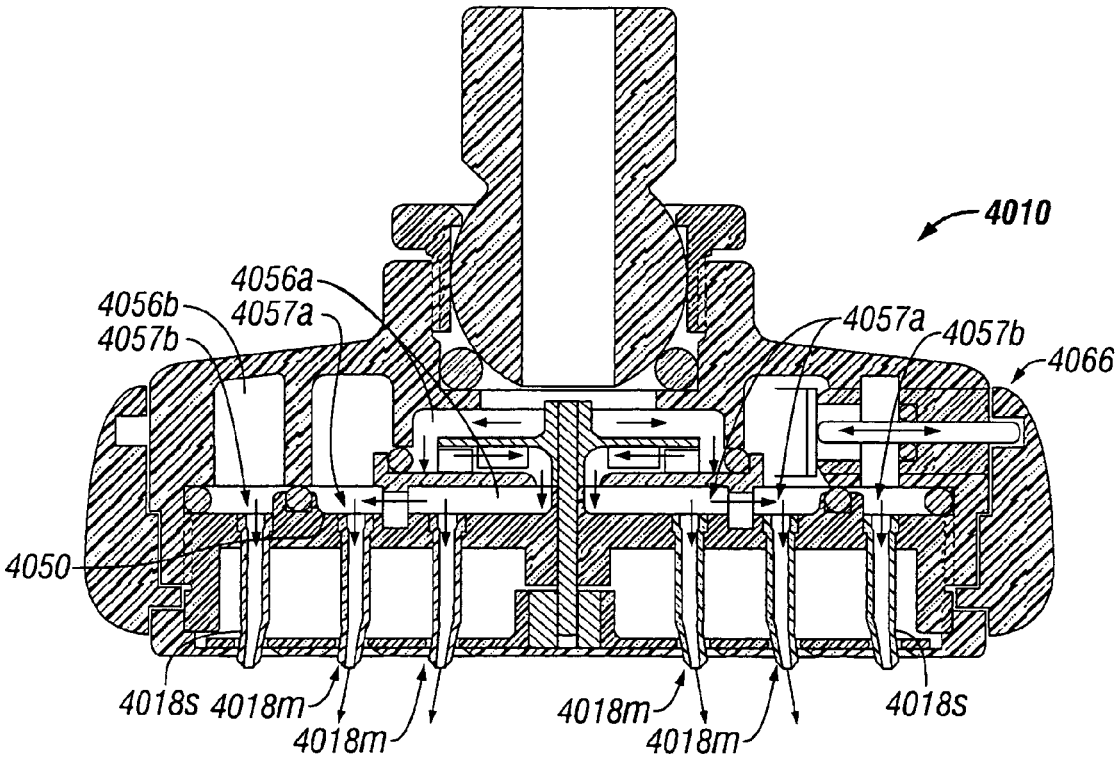
Figure 40D:
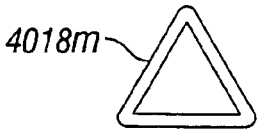
FIGS. 40D-E show cross-sections of a central fluid-dispensing tube according to the spray apparatus of FIGS. 40A-B, in respective shower and massage settings.
Figure 40E:
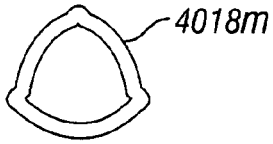

FIGS. 40A-B show sequential, sectional side views of an alternative spray apparatus 4010 employing an enclosed, peripherally-driven turbine 4024 and an alternative flow diverter system 4060 for achieving a massage effect in accordance with the present invention. FIG. 40C shows a sectional top view of the spray apparatus of FIGS. 40A-B. The housing 4012 of the spray apparatus 4010 includes a flow chamber or passage 4056*a* that is shaped to deliver water from fluid inlet 4014 to the turbine feed channels 4024*a* for energizing the multiple angled or curved vanes 4032 and creating torque at the turbine shaft 4034. The flow diverter system 4060 is analogous to that shown in FIG. 37, and includes a valve assembly 4061 for directing fluid through the flow chambers or passages 4056*a-b* to either: an outer sub-plurality of the noncentral orifices 4057*b* of the second planar member 4050; an inner sub-plurality of the noncentral orifices 4057*a* of the second planar member 4050; or a combination thereof. The valve assembly 4061 preferably includes a valve gate 4062 biased by a spring arm 4062*a* (see FIG. 40C) towards a closed position. A movable valve stem 4063 is provided for selectively opening flow passage 4056*b* to flow passage 4056*a* (as shown in FIGS. 40A and 40C). An actuator ring 4064 is useful for moving the valve stem 4063 and valve gate 4062 between the open and closed positions as desired to direct the water flow for shower and/or massage effects. The actuator ring 4064 has an inside track 4064*a* with a smoothly-varying radius (see FIG. 40C), which forces the valve stem 4063 inwardly or outwardly (under the force of spring arm 4062*a*) as the ring 4064 is rotated. This embodiment thus uses the center tubes 4018*m* fed by inner orifices 4057*a* for achieving a massage effect. The center tubes 4018*m* are (nominally) slightly smaller in cross-sectional flow area than the outer tubes 4018*s*, so as to regulate the water pressure flowing through the center tubes 4018*m*—which might otherwise exhibit a pressure higher than desired for bather comfort. The water flowing into the center tubes 4018*m* would otherwise tend to be at higher pressure than the water flowing into outer tubes 4018*s*, because of the shorter flow path and fewer frictional losses between the fluid inlet 4014 and the tubes 4018*m*. When the valve 4061 is closed, no water reaches the outer tubes 4018*s* fed by the outer orifices 4057*b*. As a result, pressure builds up on the inner tubes 4018*m*, and flexes the walls of the inner tubes 4018*m* from the nominal shape shown in FIG. 40D to the expanded shape shown in FIG. 40E.

Figure 41:
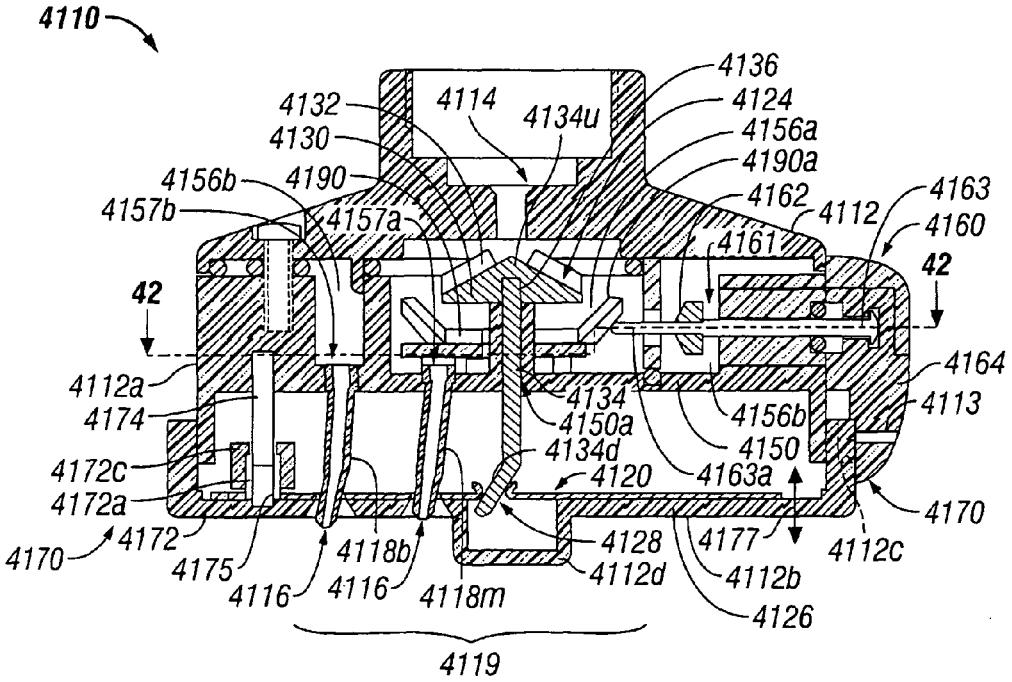
FIGS. 41-42 show sectional side and top views of an alternative spray apparatus that is similar to that of FIGS. 38-39, but employing a crankshaft instead of a camshaft and an alternative diverter system for achieving a massage effect in accordance with the present invention.
Figure 42:
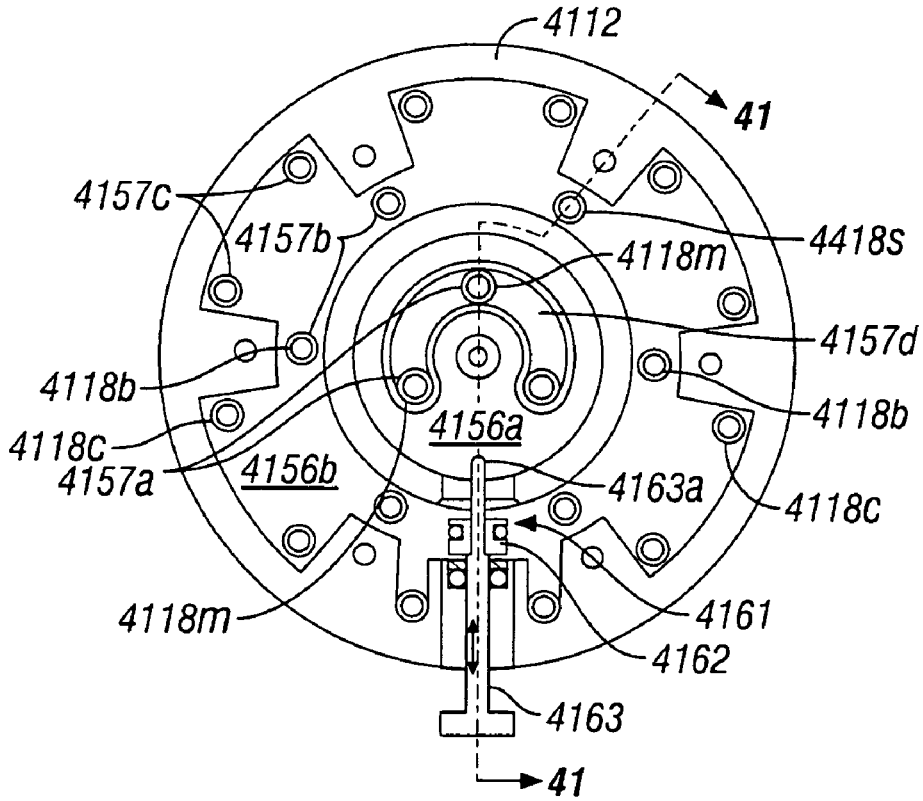

FIGS. 41-42 show sectional side and top views of an alternative spray apparatus 4110 that is similar to that of FIGS. 38-39, but employing a crankshaft 4134 instead of the camshaft 3834 (see FIG. 38) and an alternative diverter system 4160 for achieving a massage effect in accordance with the present invention. The crankshaft 4134 has a first end portion 4134*u* mounted to the turbine head 4130 and a second end portion 4134*d* rotatably carried within the substantially central orifice 4128 in the first planar member 4126 of the integrating member 4120. The second end portion 4134*d* of the crankshaft 4134 is axially offset from the axis of the crankshaft 4134 by a bend in the crankshaft intermediate the first and second end portions 4134*u-d*. The crankshaft 4134 is supported for rotation about a central axis within the housing 4112 by a second planar member 4150 sealingly mounted against rotation within the housing 4112 between the integrating member 4120 and the turbine head 4130.

The second planar member 4150 includes a substantially central orifice 4150*a* within which the crankshaft 4134 is carried for rotation, and a plurality of inner, intermediate, and outer noncentral orifices 4157*a*, 4157*b*, and 4157*c* (see FIG. 42) therein. An upstream portion of each of the tubes 4118*m*, 4118*b*, and 4118*c* is affixed in one of the respective noncentral orifices 4157*a*, 4157*b*, and 4157*c* of the second planar member 4150. A downstream portion of each of the tubes 4118 extends at least partially through one of the fluid outlets 4116. Accordingly, fluid flowing into the fluid inlet 4114 is directed through the tubes 4118*m,b,c* via the noncentral orifices 4157*a,b,c*.

The diverter system 4160 includes a rotating control ring 4164 that is useful for sequentially changing the resulting shower from a wide shower to a narrow shower, then to a shower/massage combination, then to a wide massage setting, and then to narrow massage setting. A third planar member 4190 removably covers the inner sub-plurality of noncentral orifices 4157*a*—interconnected by a channel 4157*d*—of the second planar member 4150. The third planar member 4190 has a sloped rim 4190*a* about at least a portion thereof. A valve system 4161 includes a movable valve stem 4163 equipped with a sealable plug 4162 and a distal end 4163*a*, such that movement of the valve stem 4163 in a radially-inward direction results in the plug 4162 closing off the fluid chamber or passage 4156*b* communicating fluid to the outer sub-pluralities of noncentral orifices 4157*b-c* of the second planar member 4150. More particularly, movement of the valve stem 4163 in a radially-inward direction results in the distal valve stem end 4163*a* first engaging the sloped rim 4190*a* so as to begin removing the third planar member 4190 from the inner sub-plurality of noncentral orifices 4157*a* and channel 4157*d* of the second planar member 4150. This initiates the massage effect and occurs prior to the plug 4162 closing off the fluid chamber or passage 4156*b* communicating fluid to the outer sub-plurality of noncentral orifices 4157*b* of the second planar member 4150. As the plug 4162 is moved towards its closing position, the shower effect is diminished and the massage effect increases. When the third planar member 4190 is completely opened, the massage effect via tubes 4118*m* is maximized. When the third planar member 4190 is down, water pressure in the flow chamber or passage 4156*a* applies a downward force to the third planar member, preventing water from entering and disabling the massage effect.

Figure 41A:
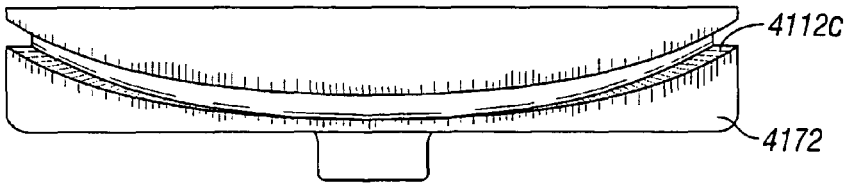

The spray apparatus 4110 further includes a means 4170 for adjusting the elevation of the integrating member 4120 relative to the crankshaft end 4134*d* so as to induce engagement of the integrating member 4120 with varying elevations of the sloping profile adjacent the crankshaft end 4134*d*. This permits the range of oscillation of the integrating member 4120 resulting from rotation of the turbine 4124 to be adjusted. More particularly, the system 4170 includes a substantially cylindrical base plate 4172 that is fitted about the substantially cylindrical upper portion 4112*a* of the housing 4112, so as to define the lower portion 4112*b* of the housing. The base plate 4172 includes a groove or recess 4112*c* for receiving a retaining pin 4113 carried in the control ring 4164. The groove 4112*c* is shaped (see FIG. 41A) such that rotation of the control ring 4164 about the upper housing portion 4112*a* imparts a force to the walls of the groove 4112*c*, via the retaining ring 4113, for selectively raising or lowering the base plate 4172 as indicated by two-way directional line 4177. As the base plate 4172 moves up, it positions the integrating member 4120 higher on the crankshaft profile 4134*d*, oscillating the resulting spray pattern over a narrower area. Conversely, downward movement of the base plate 4172 results in a wider oscillating range of the spray pattern. When the base plate 4172 reaches its upper-most position, the crankshaft profile 4134*d* makes no contact with the integrating member 4120, and the coupled fluid-dispensing tubes 4119 have no movement. Thus, rotation of the control ring 4164 affects the degree of oscillation by the integrating member 4120 as well as the shower/massage effect produced using valve assembly 4161 (described above). The base plate 4172 is prevented from rotating by one or more alignment pins 4174 disposed in one or more complementing orifices 4175 formed in a flanged portion 4172*a* of the base plate 4172. A collar 4172*c* is affixed to the flange 4172*a* for preventing separation of the integrating member 4120 from the base plate 4172 under the force applied by crankshaft end 4134*d*. It will be further appreciated by those having skill in the art that this embodiment does not produce a change in the overall spray pattern, but is useful for varying the radius of oscillation by the integrating member 4120 so as to vary the overall shower width (i.e., oscillation area of the spray pattern).

Figure 41B:
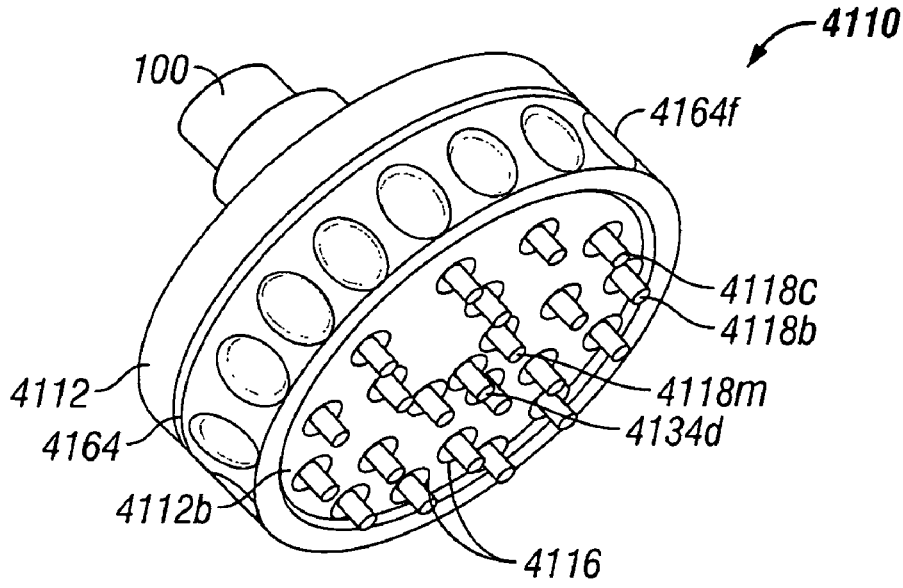

FIG. 41B shows a perspective view of the housing 4112 of the spray apparatus 4110, with a shower pipe or neck 100 delivering water into the fluid inlet 4114 (not shown in FIG. 41B) in a conventional manner. The outer control ring 4164 is shown being radially symmetrical and generally cylindrically-shaped, and includes finger indentions 4164*f* for easy gripping and rotating by a bather. The ends of the fluid dispensing tubes 4118*m*, 4118*b*, 4118*c* are shown extending partially through the fluid outlets 4116 formed in the lower portion 4112*b* of the housing. The lower housing extension 4112*d* (see FIG. 41) is removed in FIG. 41B for clarity, thereby showing the end 4134*d* of the crankshaft 4134 protruding slightly through the lower housing portion 4112*b*.

Figure 43:
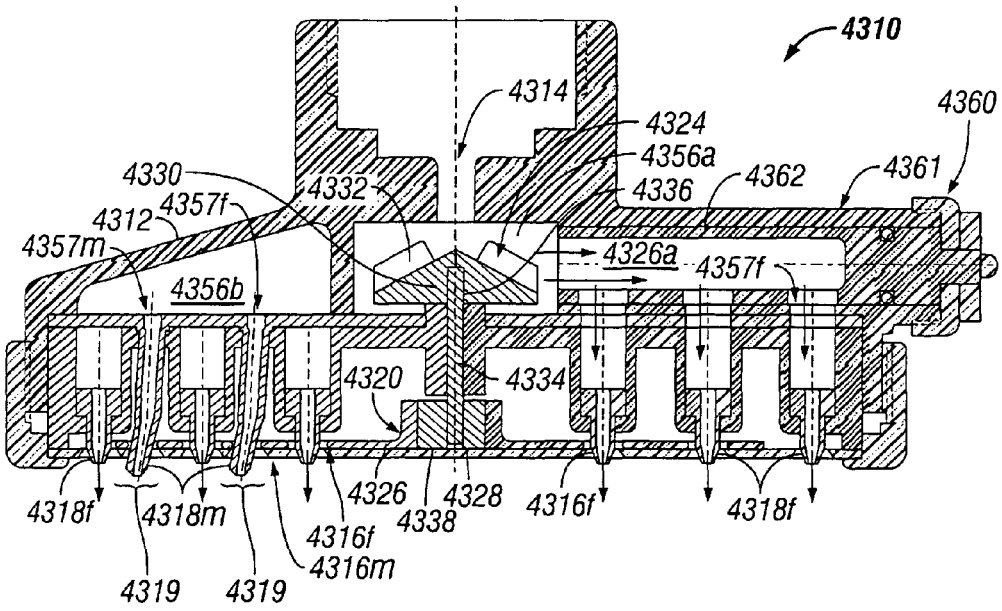
FIGS. 43-44 show sequential, sectional side views, in respective fixed and sweeping spray modes, of an alternative spray apparatus employing a combination of fixed and movable fluid-dispensing tubes and an alternative flow diverter system for achieving a massage effect in accordance with the present invention
Figure 44:
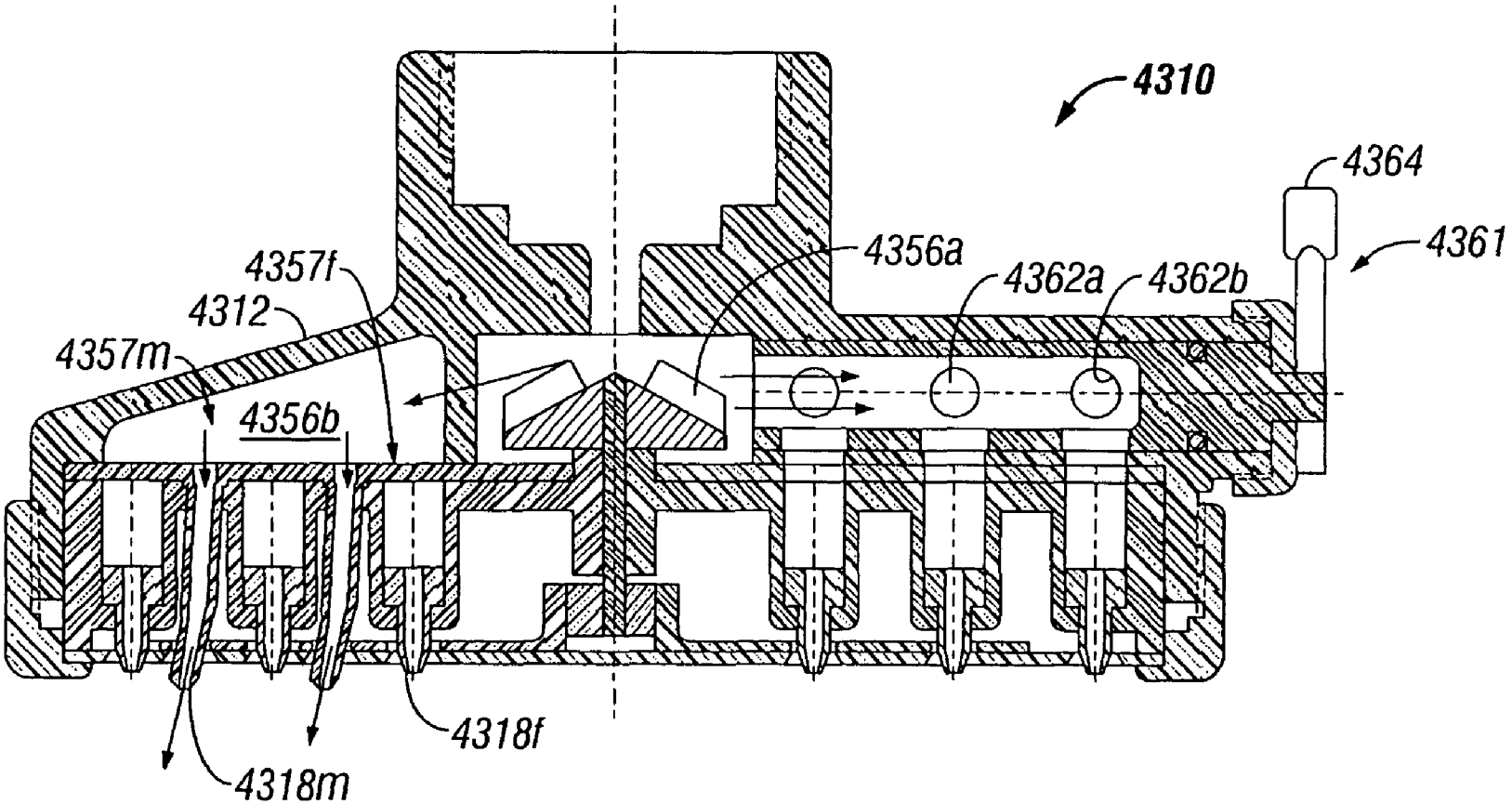

FIGS. 43-44 show sequential, sectional side views, in respective fixed and sweeping spray modes, of an alternative spray apparatus 4310 employing a combination of fixed and movable fluid-dispensing tubes 4318*f*, 4318*m* and an alternative flow diverter system 4360 for achieving a massage effect in accordance with the present invention. The movable fluid-dispensing tubes are those tubes 4319 that are coupled to the integrating member 4320. In this embodiment, tubes 4318*m* are integrally formed with the second planar member 4350, e.g., by a single rubber molding.

The fixed fluid-dispensing tubes 4318*f* are not coupled to the integrating member 4320. Each of the non-coupled tubes 4318*f* has an upstream portion affixed in one of a second set of orifices 4357*f* of the second planar member 4350, and a downstream portion that extends at least partially through one of the fluid outlets 4316. Accordingly, water flowing into the fluid inlet 4314, when the diverter system is positioned as shown in FIG. 43, is directed through the non-coupled tubes 4318*f* via the second orifices 4357*f*. The housing preferably defines flow chambers or passages 4356*a*-*b* for selectively communicating with the first and second orifices 4357*m*,*f* of the second planar member 4350. Accordingly, the diverter system 4360 includes a valve assembly 4361 for directing fluid in the flow chamber or passage 4356*a* to at least one of the first orifices 4357*m* or the second orifices 4357*f* of the second planar member 4350. The valve assembly 4361 includes a plug valve body 4362 actuated by a handle 4364 (see FIG. 44) that selectively rotates that valve body 4362 about its axis to achieve the desired flow configuration. In the valve position of FIG. 44, water is directed from flow chamber or passage 4356*a* into the valve chamber 4362*a* for delivery to flow chamber or passage 4356*b*, whereby the water passes through the first orifices 4357*m* into fluid-dispensing tubes 4318*m* for producing a sweeping spray. When the valve 4361 is moved to the position of FIG. 43, water is directed from flow chamber or passage 4356*a* into the valve chamber 4362*a* for delivery through valve orifices 4362*b* to second orifices 4357*f* and into fluid-dispensing tubes 4318*f* (i.e., bypassing flow chamber or passage 4356*b*) for producing a fixed spray. Accordingly, the bather can achieve a fixed or sweeping shower spray with this embodiment.

Figure 45:
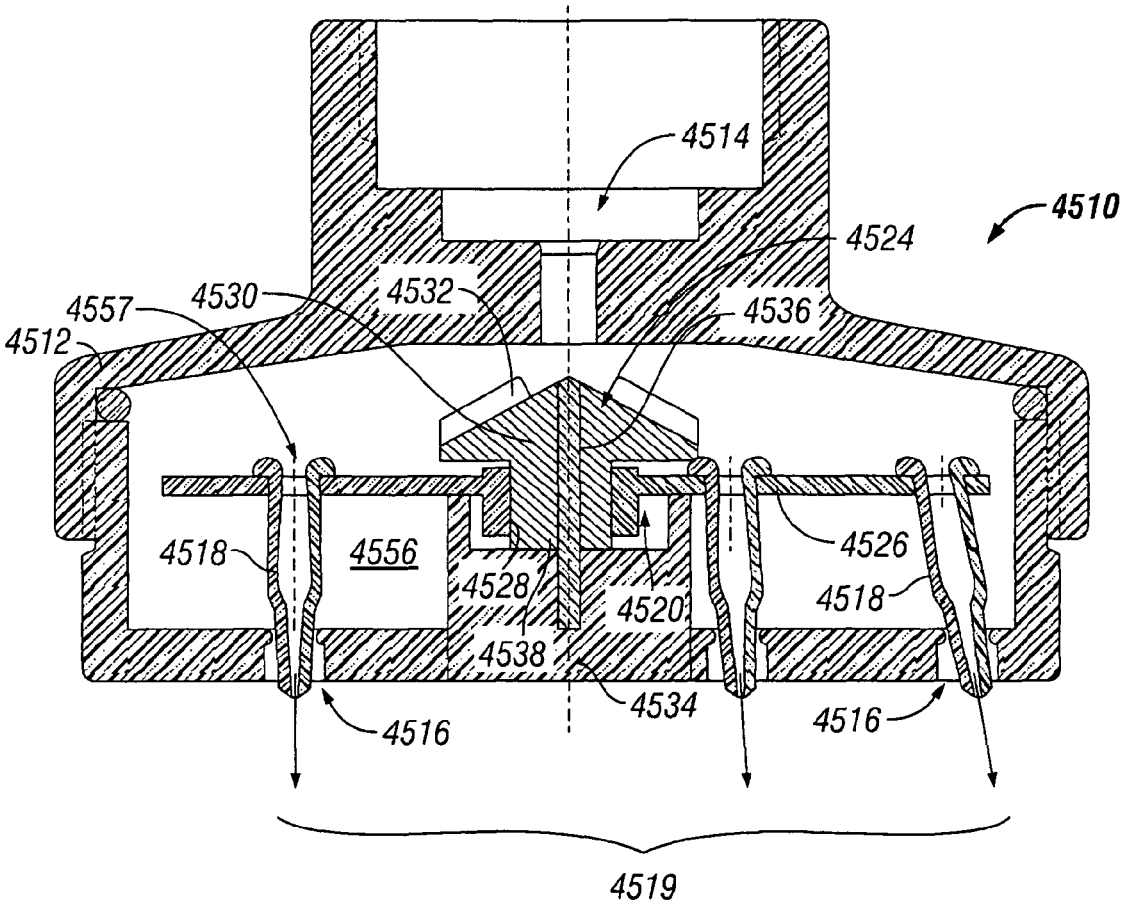
FIG. 45 shows a sectional side view of another, simplified alternative embodiment of a spray apparatus employing an integrating member disposed within the flow chamber.

FIG. 45 shows a sectional side view of another, simplified alternative embodiment of a spray apparatus 4510 employing an integrating member 4520 disposed within the flow chamber 4556. Inside the housing 4512, the first planar member 4526 of the integrating member 4520 carries the fluid-dispensing tube entrances 4557. The turbine 4524, cam member 4538, and turbine shaft 4534 are all integrally formed, preferably of a plastic material. No seals are presently provided around the tubes 4518 at the outlets 4516, although that is an option. Leakage joins the shower stream exiting the tubes 4518.

Figure 46:
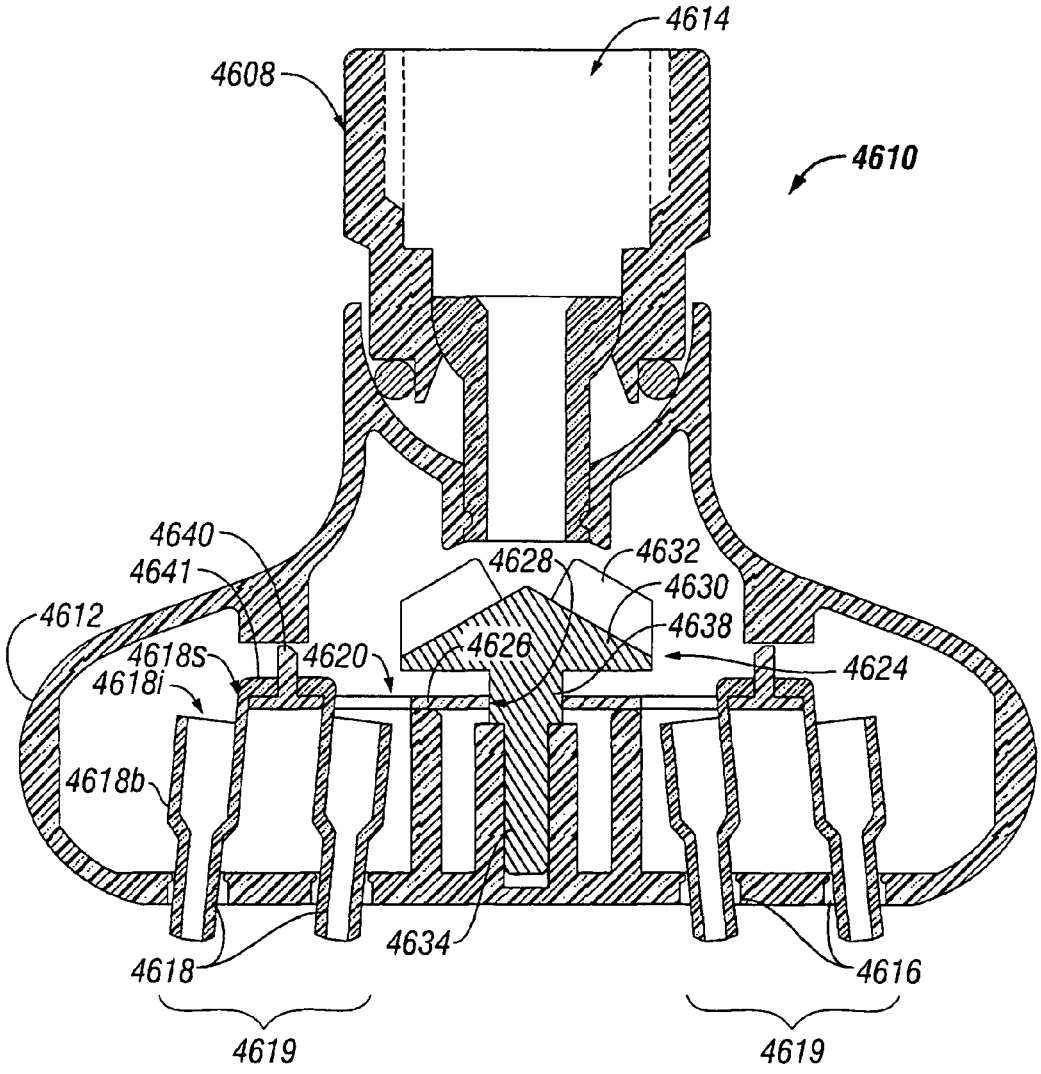
FIG. 46 is a sectional representation of a spray apparatus employing a cammed turbine to oscillate a plurality of fluid-dispensing tubes in coordinated fashion via an integrating member.

FIG. 46 is a sectional representation of a plastic, universal shower head ball joint 4608 (hereafter numbered as X08 in the figures, wherein X is the figure number; e.g., the ball joint of FIG. 47 is labeled as 4708) mounted in the housing 4612 of an alternative spray apparatus 4610 for delivering water to the housing inlet 4614 of the apparatus. The spray apparatus 4610 employs a turbine actuator 4624 to oscillate a plurality of coupled fluid-dispensing tubes 4618 (the coupled tubes also being referenced as 4619) in coordinated fashion via an integrating member 4620. Each dispending tube 4618 is preferably flexible and comprises a strap 4618*s* mounted at or near the inlet 4618*i* of its tubular body 4618*b* for pivotally mounting the tubular body within the housing 4612. The strap 4618*s* pivotally mounts the tubular body 4618*b* of each tube 4618 to the planar member 4626 of the integrating member 4620, by way of a mounting post 4640. FIG. 46 illustrates that pairs of adjacent straps 4618*s* may be integrally formed by way of a common web portion 4641 having an aperture (not numbered) therein for engaging the mounting post 4640 on the integrating member. Each strap 4618*s* may be flexible, or it may be rigid over at least a substantial portion of its length. In the later case, the rigidity of the strap may be provided by a reinforcing member, as is demonstrated by the embodiment of FIG. 55.

The dispensing tubes 4618 of this and the remaining embodiments described below are preferably flexible for the reasons mentioned above. Each flexible dispensing tube comprises a flexible tubular body having an inlet for receiving fluid and an outlet for dispensing fluid. The tubular body is preferably flexible along substantially its entire length, whereby the outlet of the tubular body may be easily pointed under the application of lateral force to the tubular body at one or more locations along the length of the tubular body. The tubular body may comprise a natural polymer, a synthetic polymer, or a combination thereof.

The preferred flexibility of the dispensing tubes (and straps) allows for easy adjustment of the fluid-dispensing direction or shape, and facilitates amplified direction/shape changes (compared to rigid dispensing tubes) in the dispensed fluid streams, e.g., when the tubes are subjected to a lateral force on one side and an opposing pivoting force (axially offset from the lateral force) on the other side. Such a flexible (and simplistic) configuration reduces the energy demands on the turbine, thereby making the spray apparatus generally more efficient than similar devices employing only rigid fluid discharge tubes. It will be appreciated by those skilled in the art that the flexibility of the straps is particularly beneficial in embodiments of the inventive spray apparatus such as those described below in association with FIGS. 47A, 51, and 55-61F.

FIG. 47 is a section representation of a similar spray apparatus 4710 to that of FIG. 46, but employing a different engagement mechanism between the integrating member 4720 and the dispensing tubes 4618. In this instance, each dispensing tube 4718 comprises an elongated flexible strap 4718*s* formed at or near the inlet 4718*i* of its tubular body 4718*b* for pivotally mounting the tubular body 4718*b* within the housing 4712. The strap 4718*s* pivotally mounts the tubular body 4718*b* of each tube 4718 to a second planar member 4750 by way of apertures 4751 in the second planar member 4750 that are sized to receive upper ends of the straps 4718*s*. The second planar member 4750 is sealingly mounted against rotation transversely within the housing 4712 between the turbine head 4730 and the housing inlet 4714.

Figure 47B:
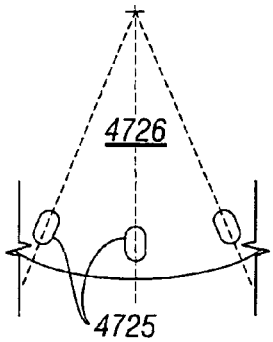
FIG. 47B is a fragmentary sectional representation taken along section line 47B-47B in FIG. 47A.
Figure 47C:
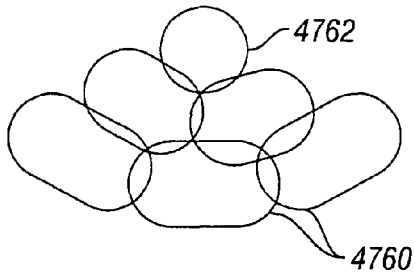
FIG. 47C illustrates respective spray patterns for some of the dispending tubes according to the spray apparatus of FIG. 47A.

FIG. 47B shows the arrangement of a subplurality of the apertures 4725 formed in the planar member 4726 of the integrating member 4720 for receiving the respective straps 4718*s* of the dispensing tubes 4718. The apertures 4725 are substantially oval or elliptical in shape, each having a major axis that is radially aligned with respect to the planar member 4726. This configuration constrains the straps 4718*s* more in the tangential direction than in the radial direction, tending to induce more tangential movement (than radial movement) in the dispensing tubes 4718 under rotation of the turbine head 4730 by water flowing into the housing inlet 4814. Thus, as shown in FIG. 47C, the oscillating paths 4760 of the tubes 4718 (at least the outer tubes) is oval or elliptical in shape with the major axis being tangentially aligned.

Figure 48A:
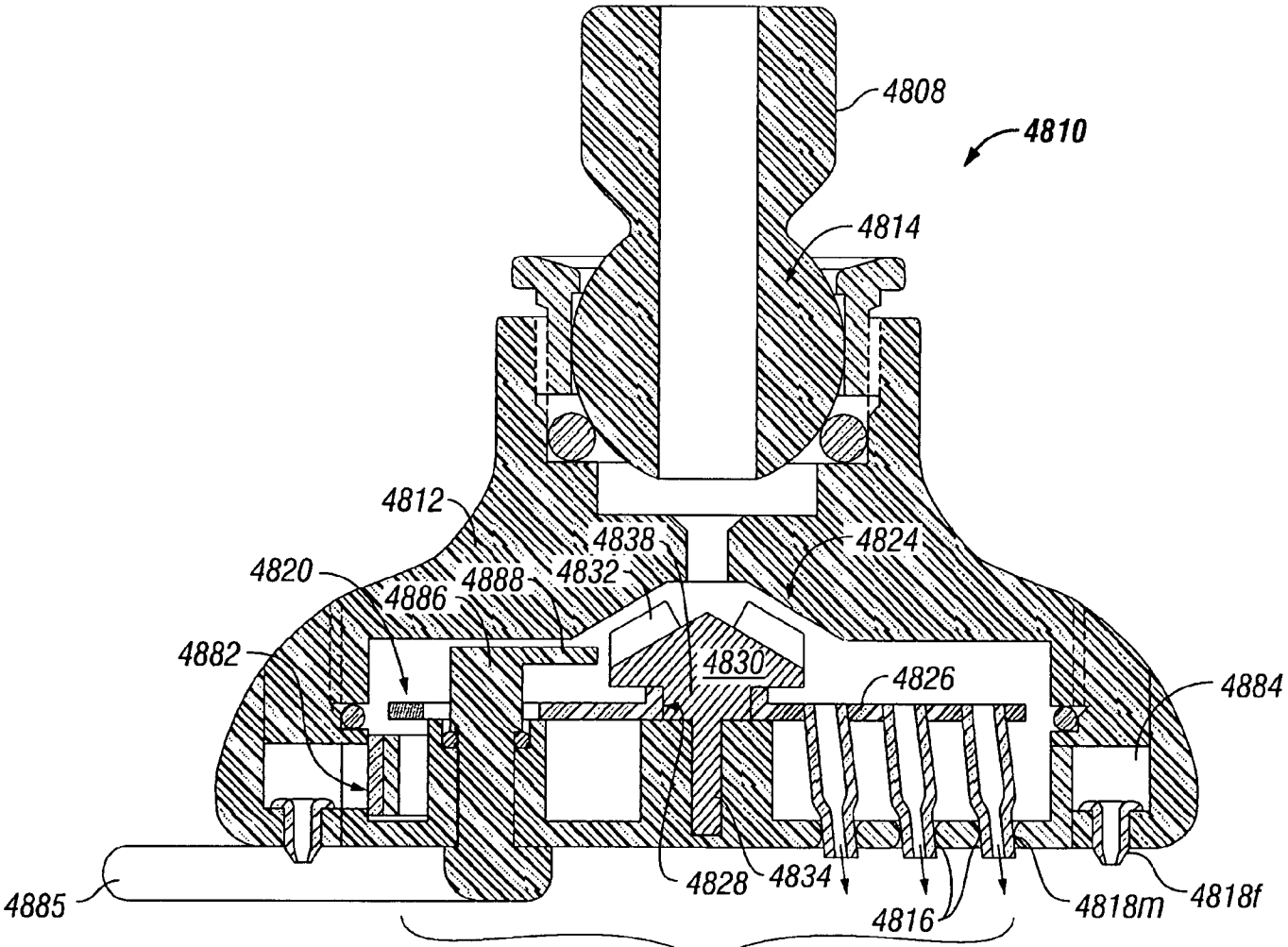
FIGS. 48A-B are sectional representations of an alternative spray apparatus that employs an isolating valve and chamber, as well as a variable turbine-cam interface (in an on/off sense only) for adjusting the degree of oscillation applied by the integrating member to the dispensing tubes.
Figure 48B:
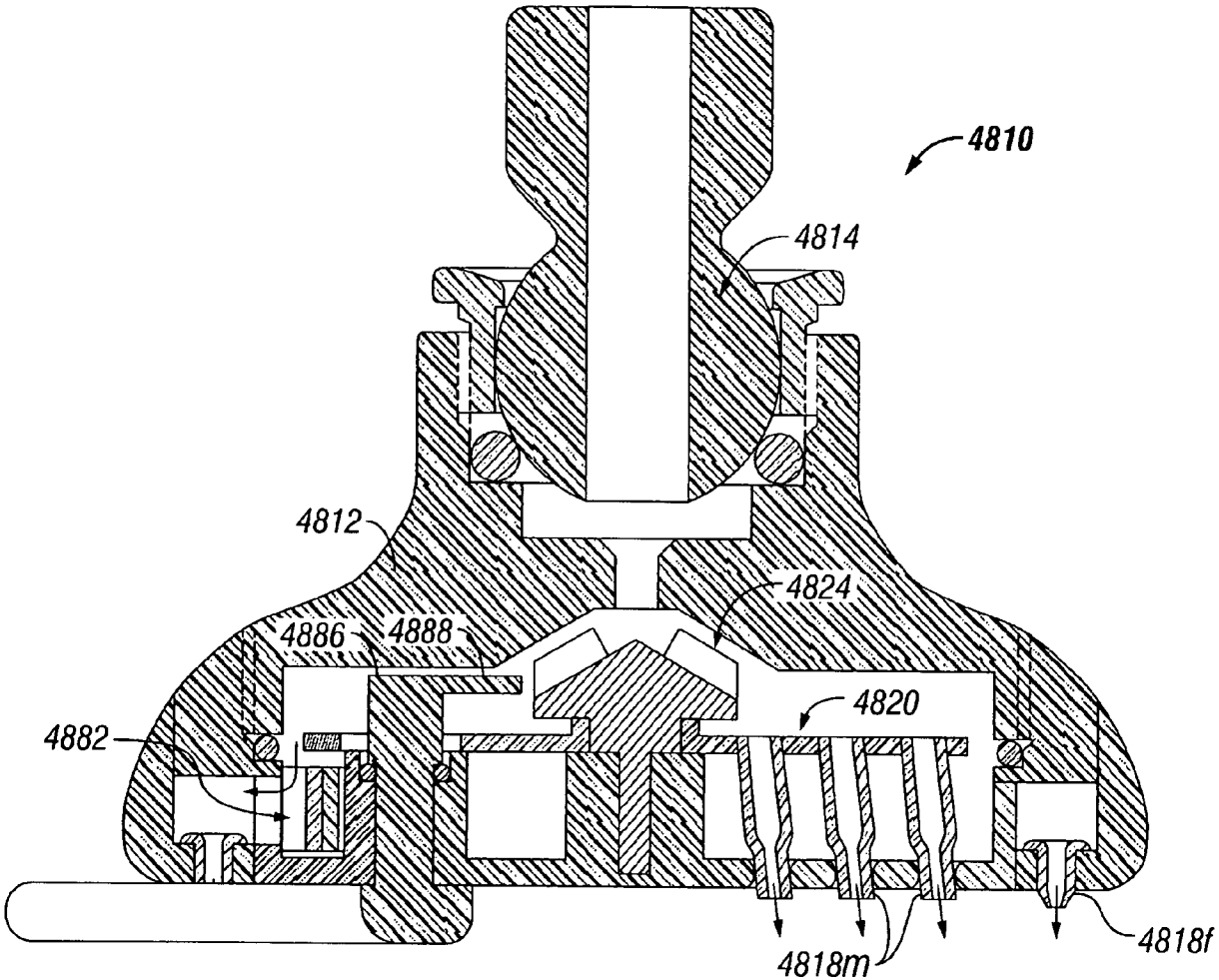

FIGS. 48A-B are sectional representations of an alternative spray apparatus 4810 that employs a lever 4885 that is rotatable outside the housing 4812 to rotate a shaft 4886 about its own axis within the housing 4812. The resulting rotation of the shaft 4886 is effective for moving an isolating valve 4882 between positions closing (see FIG. 48A) and opening (see FIG. 48B) an isolating chamber 4884, thereby selectively delivering water to an outer sub-plurality of fixed fluid-dispensing tubes 4818*f*, and selectively isolating such tubes 4818*f* from an inner sub-plurality of turbine-oscillated fluid-dispensing tubes 4818. The induced rotation of the shaft 4886 is also effective for moving a transverse arm 4888 (secured to the shaft 4886) between positions preventing (FIG. 48B) and permitting (FIG. 48A) oscillation of the inner sub-plurality of fluid-dispensing tubes 4818.

Figure 49A:
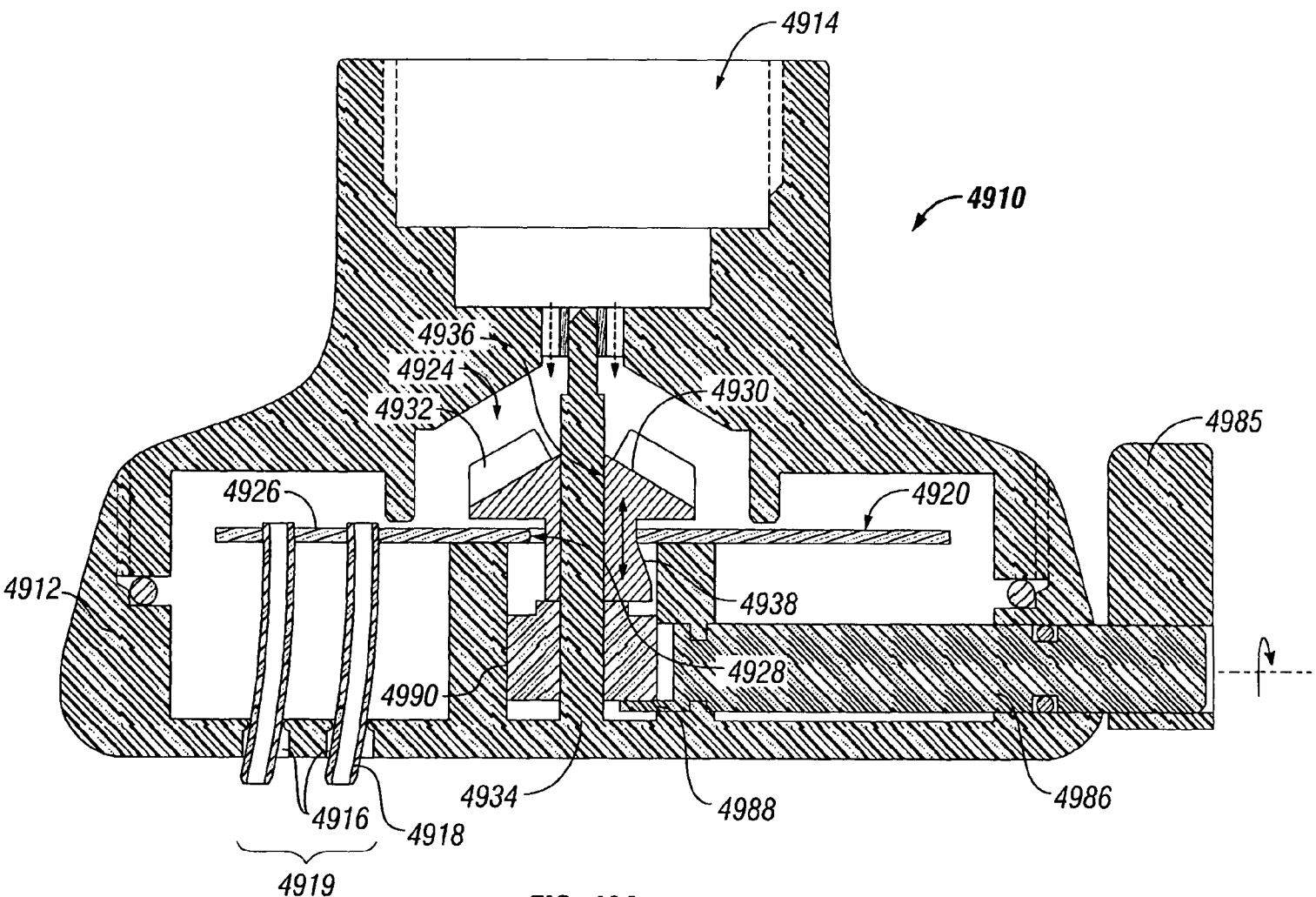
FIGS. 49A-B are sectional representations of an alternative spray apparatus that employs a variable turbine-cam interface for adjusting the degree of oscillation applied by the integrating member to the dispensing tubes.
Figure 49B:
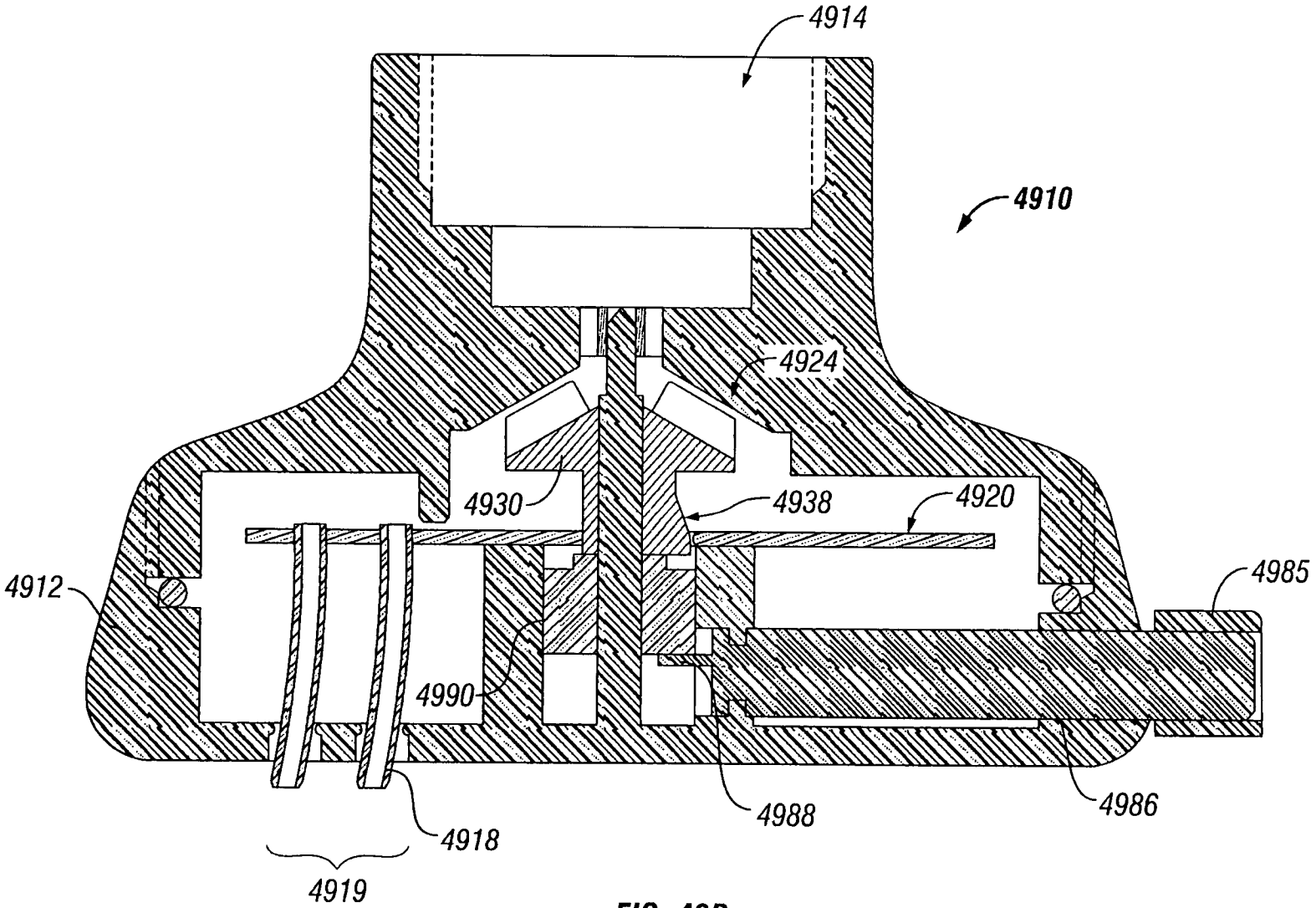
Figure 50:
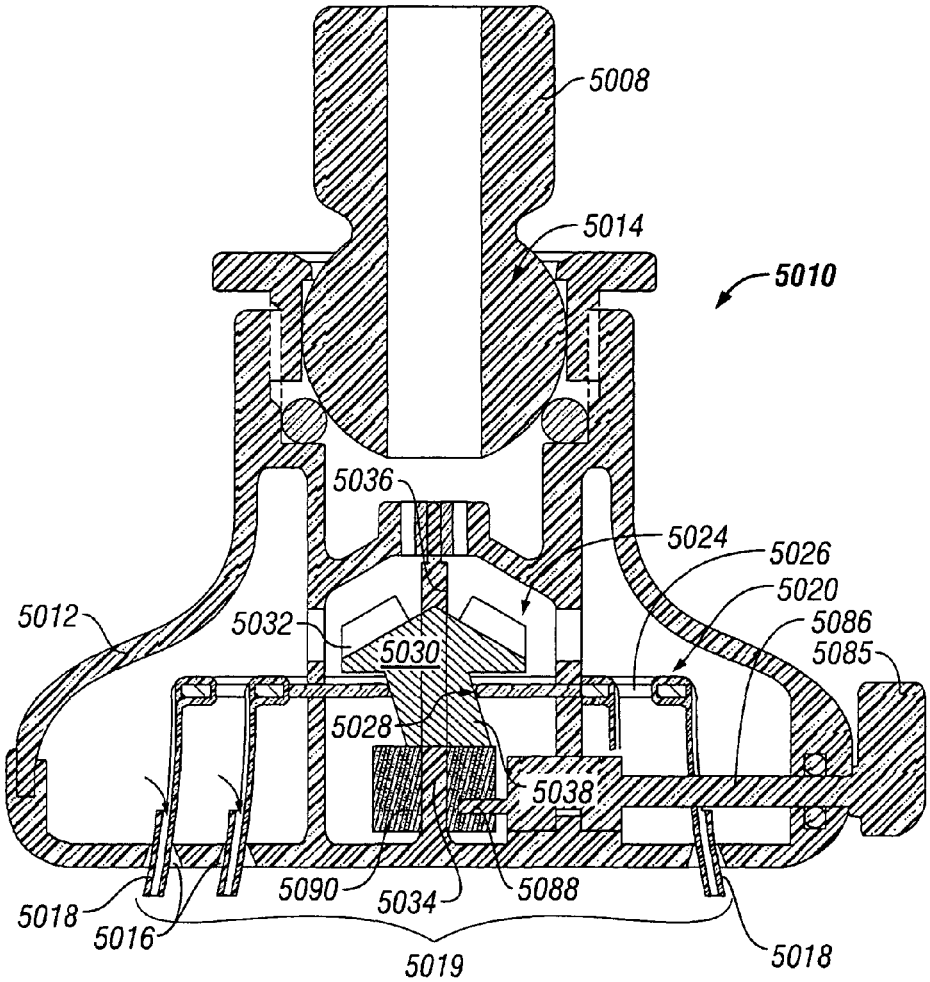
FIGS. 50-52 are sectional representations of alternative spray apparatuses each employing an alternative variable turbine-cam interface for adjusting the degree of oscillation applied by the integrating member to the dispensing tubes.
Figure 51:
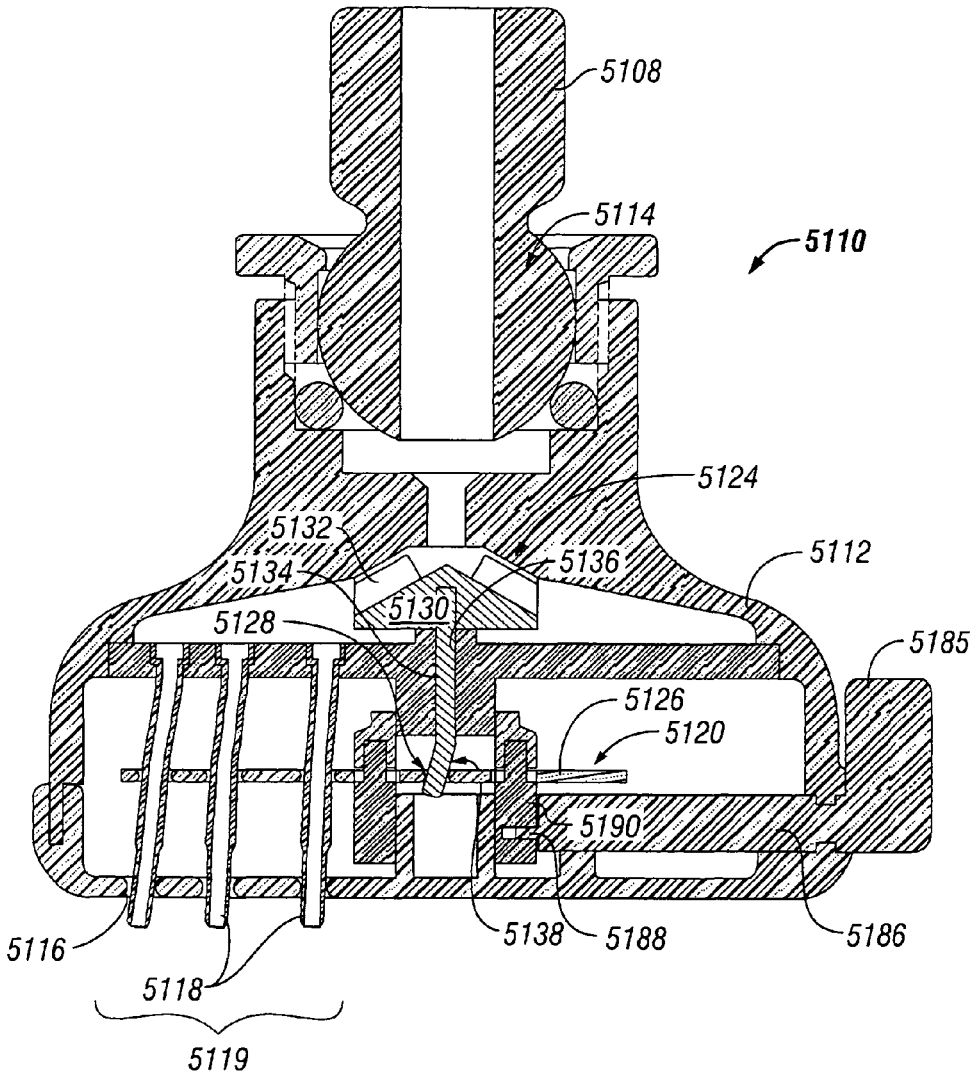
Figure 52:
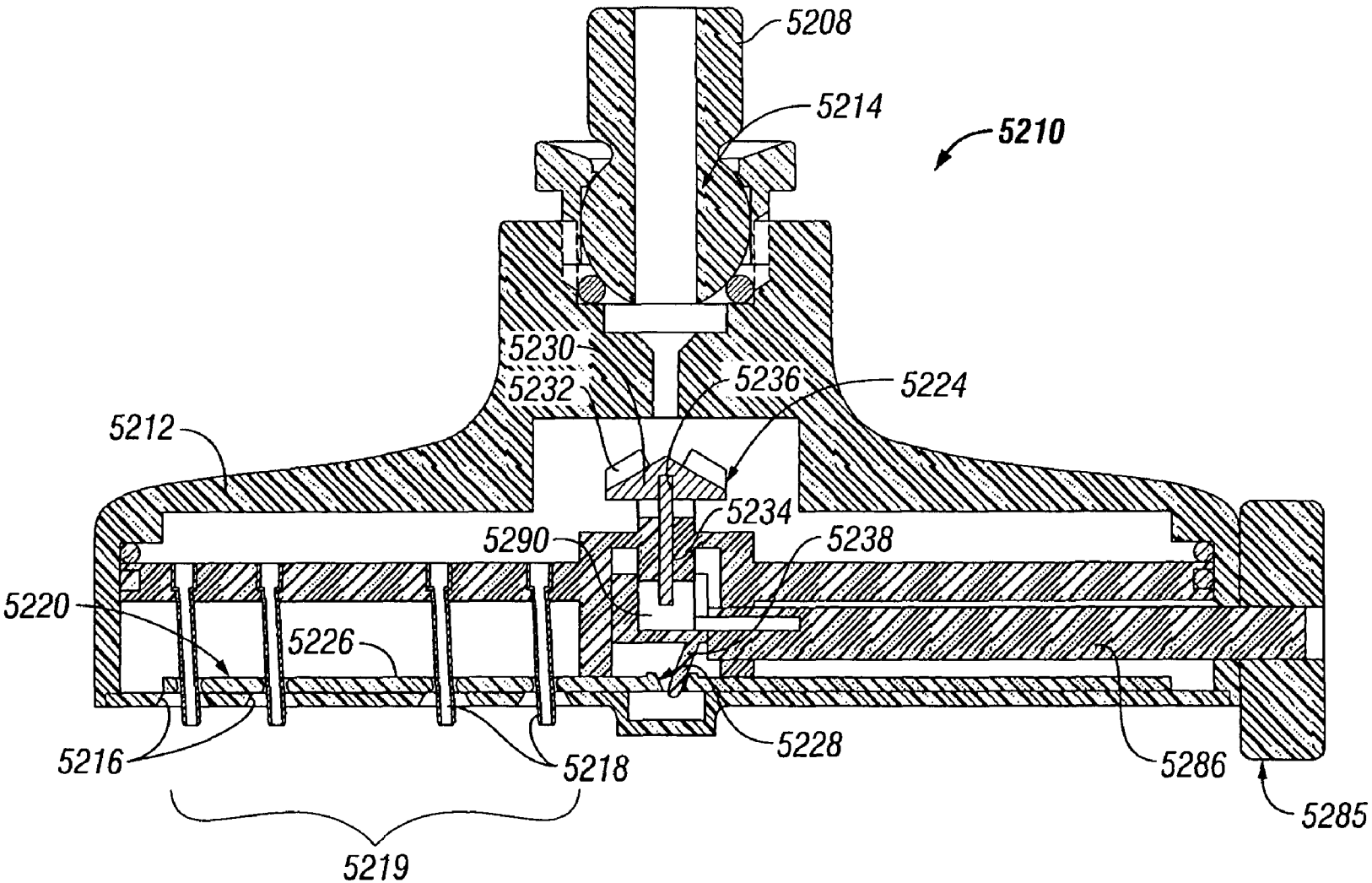

FIGS. 49A-B are sectional representations of an alternative spray apparatus 4910 that employs a lever 4985 that is rotatable outside the housing 4912 to rotate a shaft 4986 about its own axis within the housing 4912. The resulting rotation of the shaft 4986 is effective for moving a transverse arm 4988 (secured to the shaft 4886) between a lower position (FIG. 49A) and a lower position (FIG. 49B) to adjust the elevation of a spacer 4990 that rides up/down about the turbine shaft 4934, and thereby induce elevation adjustments of the turbine head 4930, including the profiled cam surface or portion 4938 thereof. Elevation adjustments of the cam 4938 effect adjustments of the engagement position between the cam 4938 and the integrating member 4920, and thereby alter the degree of oscillation that the cam 4938 applies to the central orifice 4928 of the integrating member 4920—and therefore the coupled dispensing tubes 4918—under rotation of the turbine 4934. Accordingly, FIG. 49A depicts smaller induced oscillations in the tubes 4918, while FIG. 49B depicts larger induced oscillations in the tubes 4918. The lever 4985, shaft 4986, and transverse arm 4988 thereby constitute an integrated mechanism for adjusting the engagement position (e.g., the elevation) of the integrating member 4920 relative to the cam portion 4938. It will be appreciated by those skilled in the art that the use of flexible tubes, as described herein, obviates the need for complex mechanisms that would otherwise be required to maintain rigid tubes in the proper alignment over a range of variable orbits.

FIGS. 50-53 are sectional representations of alternative spray apparatuses 5010, 5110, and 5210 each employing similar mechanisms (i.e., externally-rotatable lever X85, internally rotating shaft X85, transverse arm X88, and spacer X 90) for varying a cam interface so as to adjust the degree of oscillation applied by the integrating member 5020, 5120, and 5220 to the respective coupled dispensing tubes 5018, 5118, and 5218. In the spray apparatuses of FIGS. 50 and 53, the respective turbine heads 5030 and 5330 are freely movable up/down about the turbine shafts 5034 and 5334, and the respective cams 5038, 5338 are moved up/down with respect to the integrating members 5020, 5320. In the spray apparatus 5110 of FIG. 51, the spacer 5190 urges the integrating member 5120 up/down so as to vary its engagement with the cam portion 5138 of the turbine shaft 5134. In the spray apparatus 5220 of FIG. 52, the spacer 5290 urges the cam portion 5238 up/down with respect to the integrating member 5220.

Figure 53:
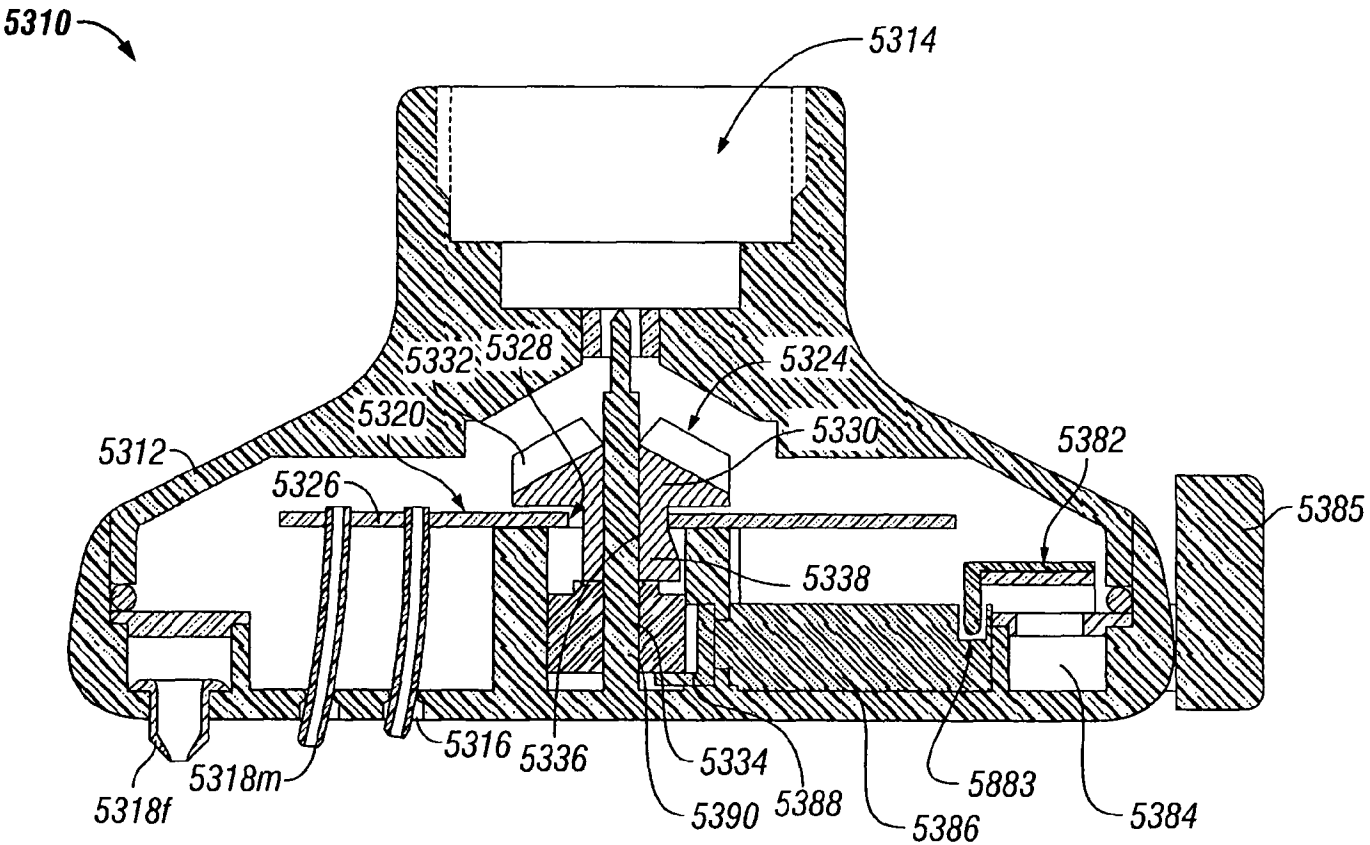
FIG. 53 is a sectional representation of an alternative spray apparatus that is similar to the apparatus of FIGS. 49A-B, but also employs an isolating valve and chamber in similar fashion to the apparatus of FIGS. 48A-B.

The spray apparatus 5310 of FIG. 53 also employs an isolating valve 5382 having a liftable tab 5383, and an isolating chamber 5384, in similar fashion to the spray apparatus 4810 of FIGS. 48A-B.

Figure 54:
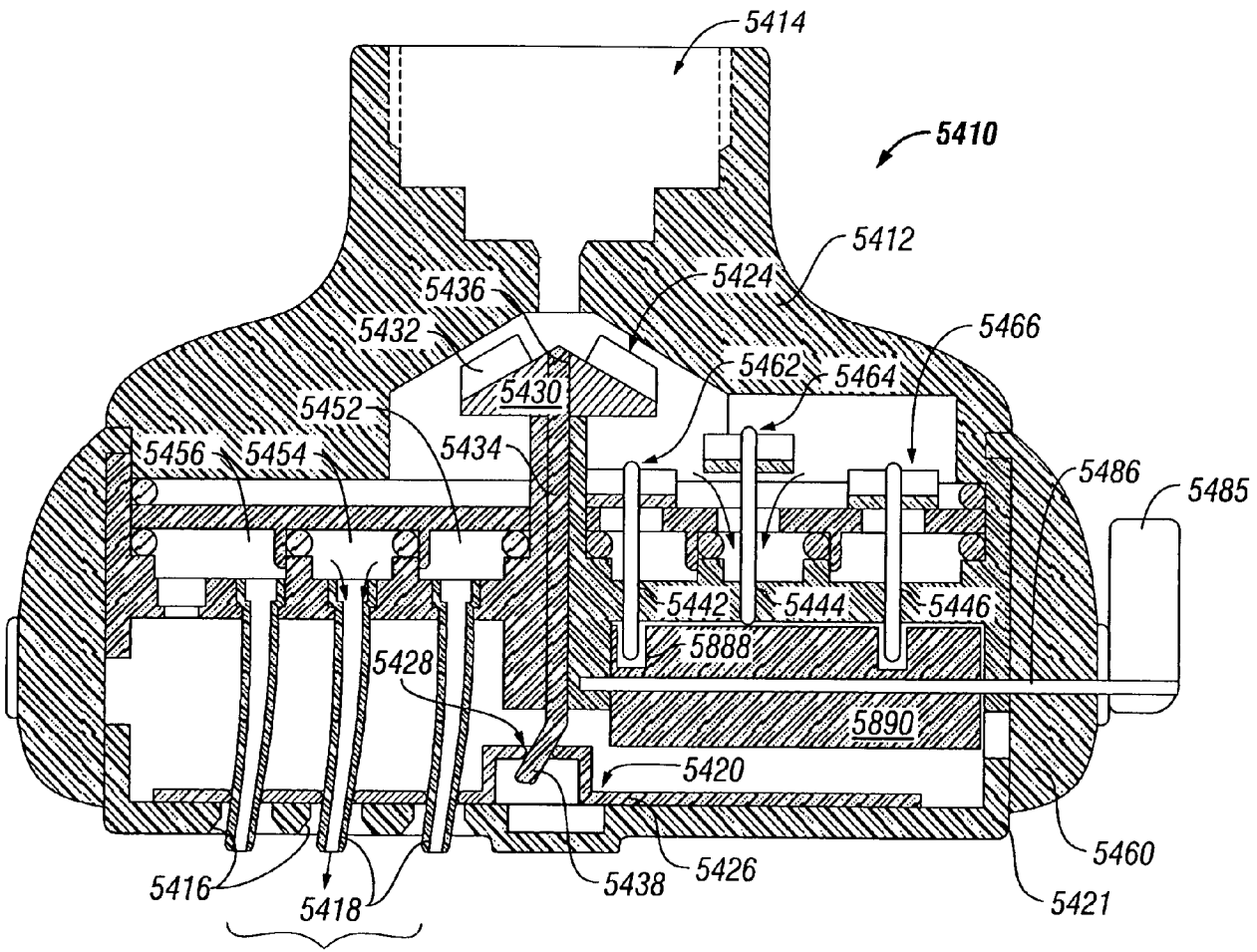
FIG. 54 is a sectional representation of an alternative spray apparatus that employs a valve assembly for controlling fluid entry to respective massage, aeration, and shower chambers, as well as an alternative variable turbine-cam interface for adjusting the degree of oscillation applied by the integrating member to the dispensing tubes.

FIG. 54 is a sectional representation of an alternative spray apparatus 5410 that employs a rotatable lever 5485 for actuating valves 5462, 5464, and 5466 that control fluid entry to respective massage chambers 5452, aeration chambers 5454, and shower chambers 5456. The valves are moved between open and closed positions by the movement of respective valve stems 5442, 5444, and 5446 into peripheral channels 5488 of a barrel-cam 5490 that rotates with the shaft 5486.

The spray apparatus 5410 is further equipped with a rotatable peripheral ring 5460 for adjusting the elevation of an integrating member 5420 relative to the cam portion 5438 of the turbine shaft 5434, whereby the degree of turbine oscillation applied to coupled dispensing tubes 5419 is adjusted. The ring 5460 is equipped with internal thread, tongue, etc. (not shown) that complements an external thread, groove, etc. (not shown) of an external, cylindrical region 5421 of the integrating member 5420, whereby rotation of the ring 5460 about the housing 5412 is translated into movement of the integrating member 5420 up/down relative to the cam portion 5438 of the apparatus 5410.

Figure 55:
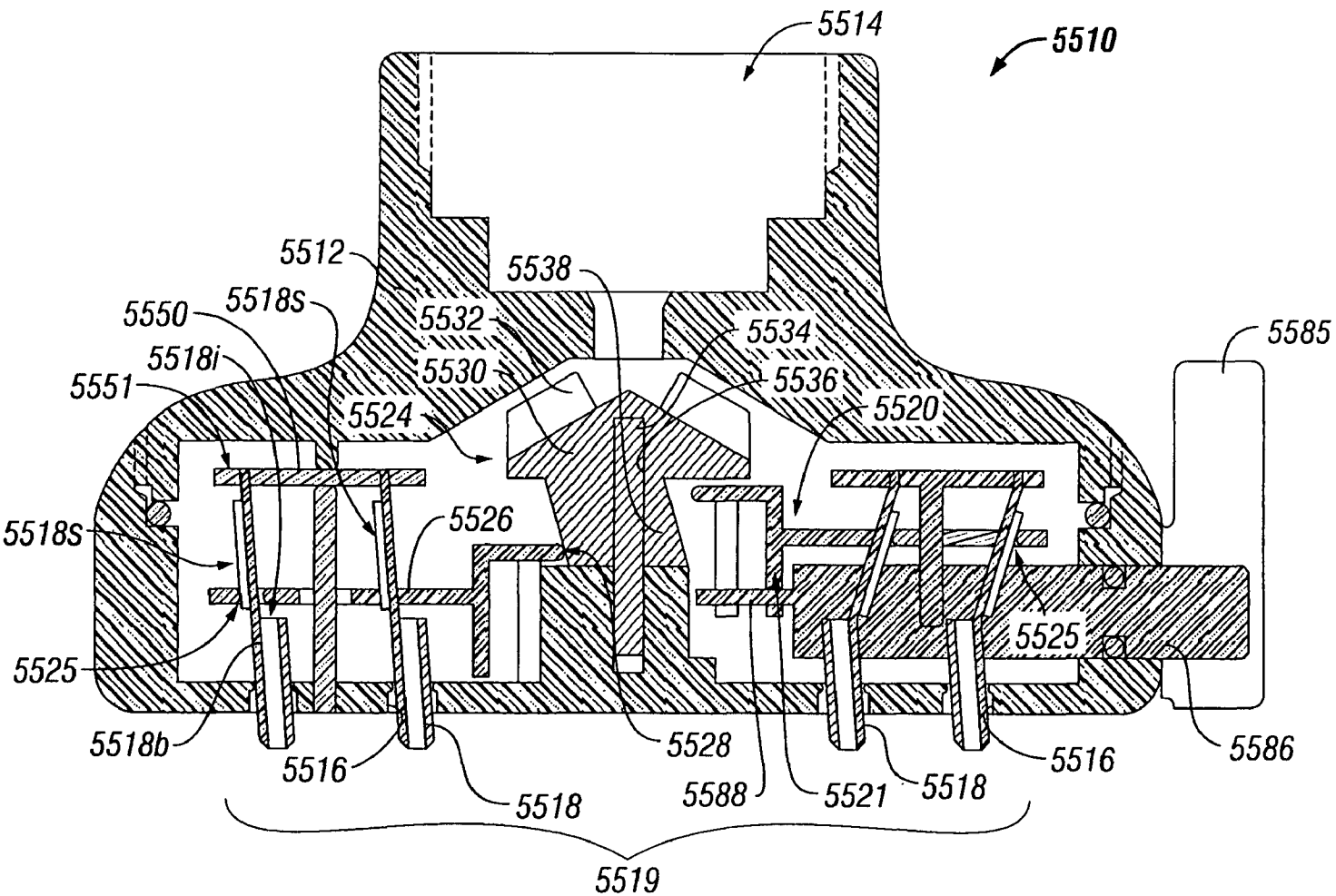
FIG. 55 is a sectional representation of an alternative spray apparatus that employs a variable turbine-cam interface for adjusting the degree of oscillation applied by the integrating member to the dispensing tubes, in coordination with a focusing mechanism for converging/diverging the dispensing tubes in unison to achieve a focusing effect.

FIG. 55 is a sectional representation of an alternative spray apparatus 5510 that employs a lever 5585 that is disposed for rotation outside the housing 5512 so as to adjust the elevation of an integrating member 5520, via a shaft 5586 that is disposed for rotation about its own axis inside the housing 5512. The shaft 5586 comprises an eccentric transverse arm 5588 that is oscillated by rotation of the shaft so as to move the integrating member 5520 up/down by the engagement of the arm 5588 with an aperture 5521 in the integrating member 5520, thereby moving the central orifice 5528 into engagement with differing locations along the cam 5538 of the turbine 5534. Accordingly, the degree of turbine oscillation applied to the dispensing tubes 5518 coupled by the integrating member 5520 is selectively adjusted.

The spray apparatus 5510 further comprises one or more focusing elements, in the form of reinforced straps 5518*s* connected to or integrally formed with the dispensing tubes 5518 at or near the inlet 5518*i* of its tubular body 5518*b* for pivotally mounting the tubular body 5518*b* within the housing 5512. Each strap 5518*s* pivotally mounts the tubular body 5518*b* of each tube 5518 to a second planar member 5550 by way of apertures 5551 in the second planar member 5550 that are sized to receive upper ends of the straps 5518*s*. The second planar member 5550 is mounted against rotation transversely within the housing 5512 generally between the integrating member 5520 and the housing inlet 5514. The focusing elements (i.e., the reinforced straps 5518*s*) engage the integrating member 5520 by way of apertures 5525 therein. The straps 5518*s* are displaced by the above-described adjustment of the engagement position of the integrating member 5520 with the turbine cam 5538 so as to simultaneously adjust the fluid-dispensing direction of the dispensing tubes 5518 in a unified converging (or diverging) manner, i.e., to focus the shape of the shower defined by the fluid streams dispensed from the plurality of dispensing tubes.

Figure 56A:
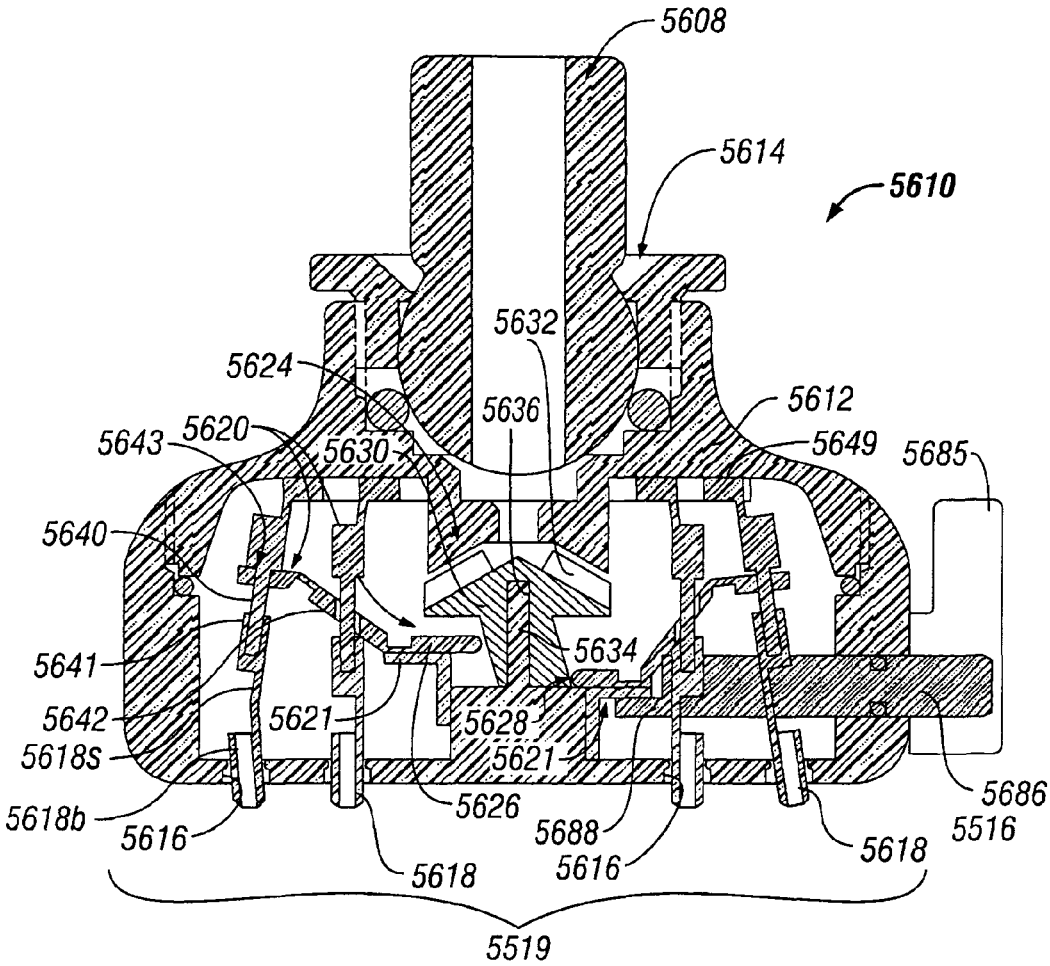
FIG. 56A is a sectional representation of an alternative spray apparatus employing a variable turbine-cam interface for adjusting the degree of oscillation applied to a flexible, spider-like integrating member to the dispensing tubes, which also operates as a focusing mechanism for converging/diverging the dispensing tubes in unison to achieve a focusing effect.

FIG. 56A is a sectional representation of an alternative spray apparatus 5610 that employs a lever 5685 that is disposed for rotation outside the housing 5612 so as to adjust the elevation of an integrating member 5620, via a shaft 5686 that is disposed for rotation about its own axis inside the housing 5612. The shaft 5686 comprises an eccentric transverse arm 5688 that is oscillated by rotation of the shaft so as to move the planar member 5626 of the integrating member up/down by the engagement of the arm 5688 with a lower hub member 5621 beneath the planar member 5626, thereby moving the central orifice 5628 into engagement with differing locations along the cam 5638 of the turbine 5634. Accordingly, the degree of turbine oscillation applied to the dispensing tubes 5618 coupled by the integrating member 5620 is selectively adjusted.

Figure 56B:
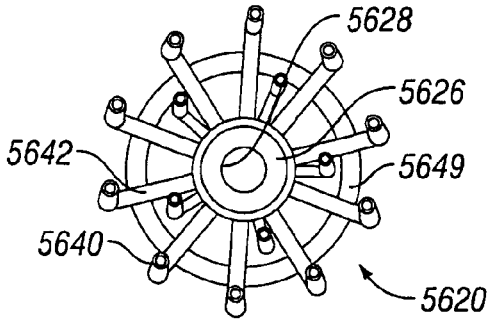
FIG. 56B is a bottom view of the flexible, spider-like integrating member employed by the spray apparatus of FIG. 56A.

The spray apparatus 5610 further comprises one or more focusing elements, in the form of spider-like arms 5642 that constituting portions of the integrating member 5620 (along with pin members 5640), as shown in a bottom view thereof in FIG. 56B. The spider arms 5642 are connected to the dispensing tubes 5618 by way of the engagement of the arms 5642 with the flexible pin members 5640 that are mounted in sockets 5641 of flexible straps 5618*s* that are connected (i.e., integrally formed) at or near the inlet 5618*i* of its tubular body 5618*b* for pivotally mounting the tubular body 5618*b* within the housing 5612. Each strap 5618*s* pivotally "extends" the tubular body 5618*b* of each tube 5618 to one or more upper ring members 5649 that are slidable disposed beneath a transverse portion of the housing 5612 located generally between the turbine head 5630 and the housing inlet 5614. The focusing elements (i.e., the spider arms 5642) engage the pin members 5640 by way of apertures 5643 in the spider arms. The pin members 5640 and straps 5618*s* are displaced by the above-described adjustment of the engagement position of the integrating member 5620 with the turbine cam 5638 so as to adjust the fluid-dispensing direction of the dispensing tubes 5618 in a unified converging (or diverging) manner, i.e., to focus the shape of the shower defined by the fluid streams dispensed from the plurality of dispensing tubes. Accordingly, a focused, narrow spray configuration with smaller turbine-induced oscillations (or none) is depicted on the left half of FIG. 56A, while an unfocused (normal), wide spray configuration with larger turbine-induced oscillations is depicted on the right half of FIG. 56B.

Figure 57:
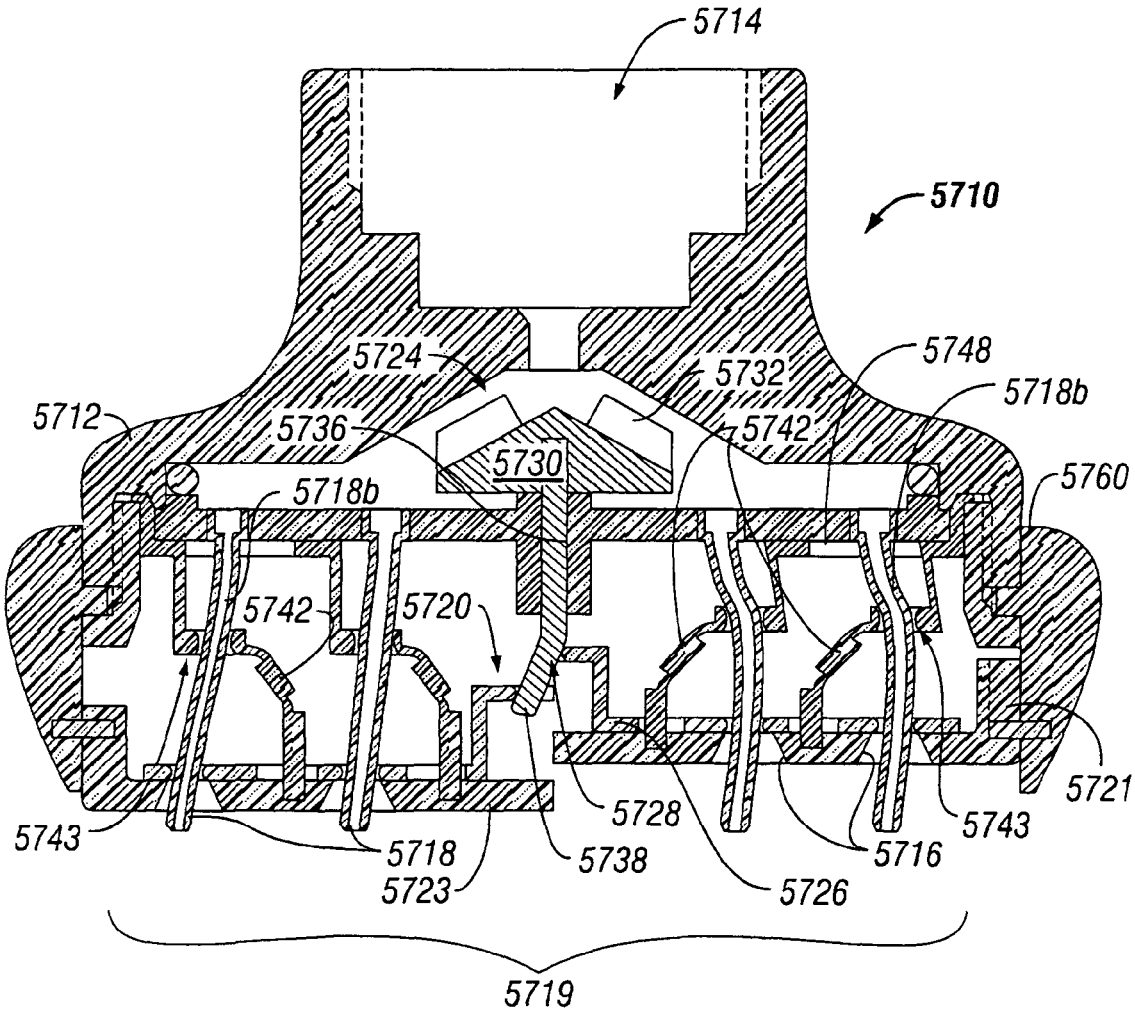
FIG. 57 is a sectional representation of an alternative spray apparatus that employs a variable turbine-cam interface for adjusting the degree of oscillation applied by the integrating member to the dispensing tubes, in coordination with a flexible, spider-like focusing mechanism for converging/diverging the dispensing tubes in unison to achieve a focusing effect.

FIG. 57 is a sectional representation of an alternative spray apparatus 5710 that employs a rotatable peripheral ring 5760 for adjusting the elevation of an integrating member 5720 relative to the cam portion 5738 of the turbine shaft 5734, whereby the degree of turbine oscillation applied to coupled dispensing tubes 5719 is adjusted. The ring 5760 is equipped with internal thread, tongue, etc. (not shown) that complements an external thread, groove, etc. (not shown) of an external, cylindrical region 5721 of an outlet plate 5723 beneath the integrating member 5720, whereby rotation of the ring 5760 about the housing 5712 is translated into movement of the integrating member 5720 up/down relative to the cam portion 5738 of the apparatus 5710.

The spray apparatus 5710 further comprises one or more focusing elements, in the form of flexible spider-like arms 5742 each connected between a fixed ring member 5748 and the movable outlet plate 5723. The ring member 5748 and outlet plate 5723 are mounted against rotation transversely within the housing 5712. The focusing elements (i.e., the spider arms 5742) engage the tubular bodies 5718*b* of the dispensing tubes 5718 by way of apertures 5743 in the spider arms 5742 through which the tubular bodies extend. The spider arm 5742 are flexed and displaced by the above-described adjustment of the engagement position of the integrating member 5720 with the turbine cam 5738 so as to adjust the fluid-dispensing direction of the dispensing tubes 5718 in a unified converging (or diverging) manner, i.e., to focus the shape of the shower defined by the fluid streams dispensed from the plurality of dispensing tubes. Accordingly, a focused, narrow spray configuration with smaller turbine-induced oscillations (or none) is depicted on the right half of FIG. 57, while an unfocused (normal), wide spray configuration with larger turbine-induced oscillations is depicted on the left half of FIG. 57.

Figure 58:
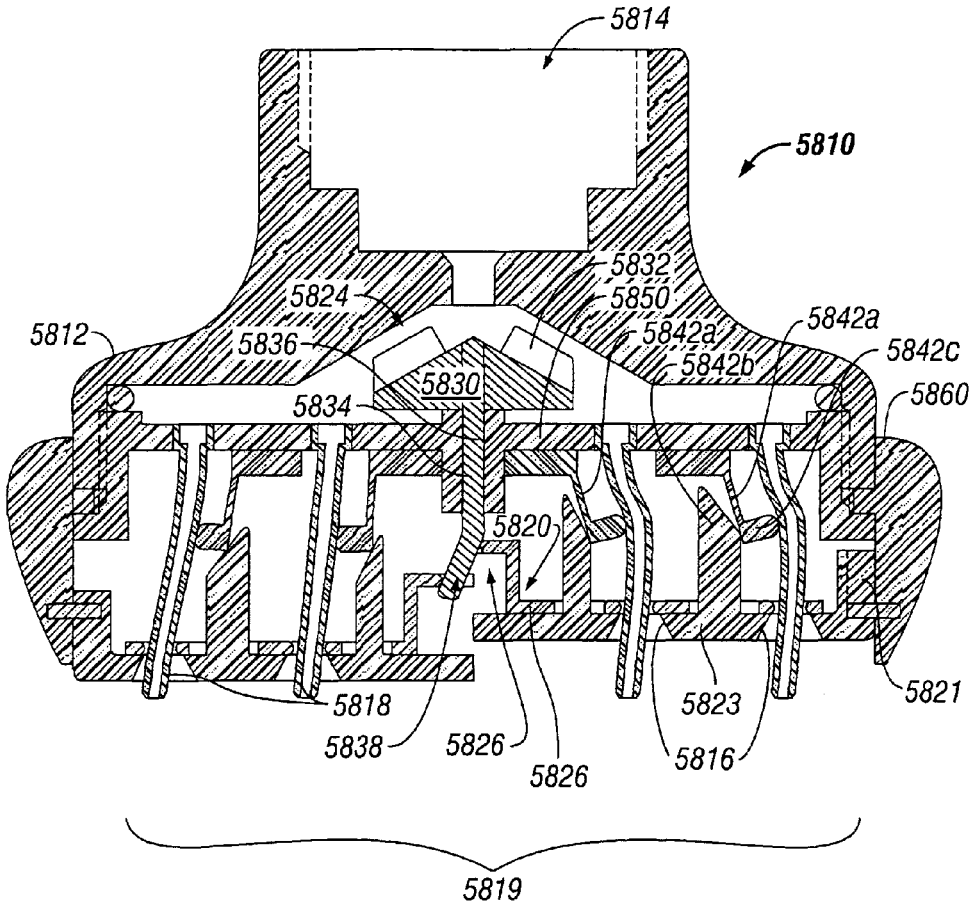
FIG. 58 is a sectional representation of an alternative spray apparatus that employs a variable turbine-cam interface for adjusting the degree of oscillation applied by the integrating member to the dispensing tubes, in coordination with an alternative focusing mechanism for converging/diverging the dispensing tubes in unison to achieve a focusing effect.

FIG. 58 is a sectional representation of an alternative spray apparatus 5810 that employs a rotatable ring 5860 for adjusting the elevation of an integrating member 5820 via a movable outlet plate 5823, whereby the degree of turbine oscillation applied to coupled dispensing tubes 5818 is selectively adjusted. This mechanism is substantially identical to that described above in reference to FIG. 57, and will not be described further.

The spray apparatus 5810 further comprises one or more focusing elements, in the form of flexible focusing arms or straps 5842*a* each connected to a second planar member 5850 mounted transversely across the housing 5812 beneath the turbine head 5830. The focusing arms 5842*a* cooperate with respective focusing cams 5842*b* to laterally displace boot portions 5842*c* of the focusing arms 5842*a* upon movement up/down of the outlet plate 5843 under rotation of the peripheral ring 5860. The boot portions 5842*c* cause flexing of the dispensing tubes 5818 so as to adjust the fluid-dispensing direction of the tubes 5818 in a unified converging (or diverging) manner, i.e., to focus the shape of the shower defined by the fluid streams dispensed from the plurality of dispensing tubes. Accordingly, a focused, narrow spray configuration with smaller turbine-induced oscillations (or none) is depicted on the right half of FIG. 58, while an unfocused (normal), wide spray configuration with larger turbine-induced oscillations is depicted on the left half of FIG. 58.

Figure 59A:
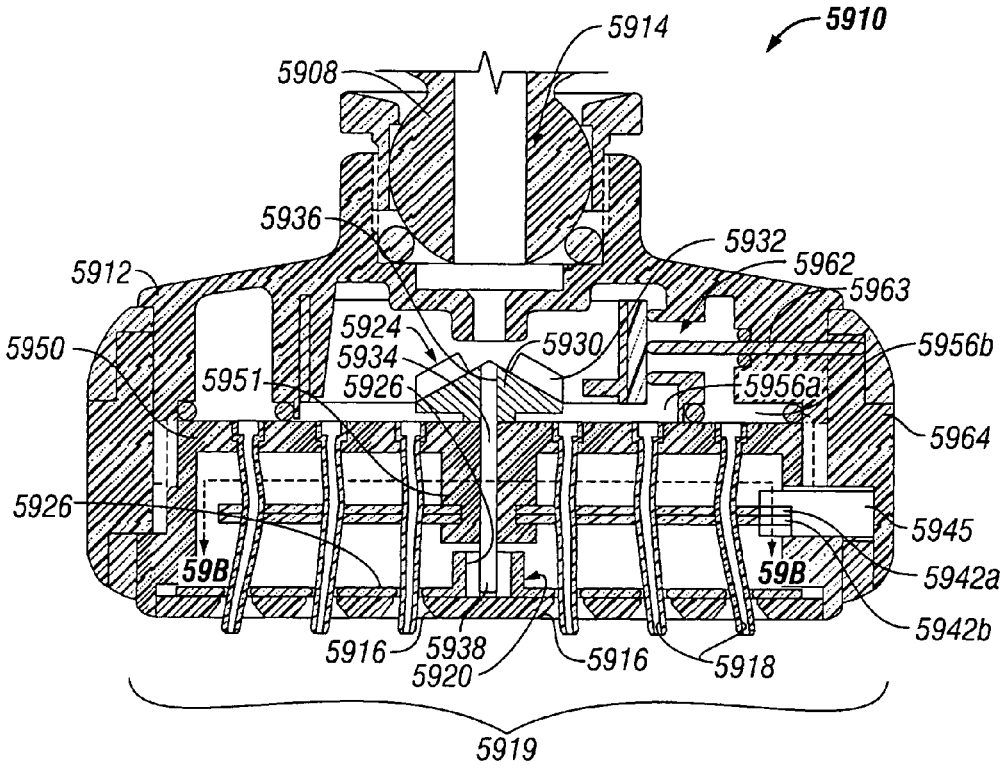
FIG. 59A is a sectional representation of an alternative spray apparatus employing dual focusing disks for converging/diverging the dispensing tubes in unison to achieve a focusing effect.

FIG. 59A is a sectional representation of an alternative spray apparatus employing a peripheral actuator ring 5964 for urging a valve stem 5963 against a valve gate 5962 so as to move the valve gate between positions closing or opening an outer fluid chamber 5956*b* for delivery of water to outer fluid-dispensing tubes 5918 that fluidly communicate with the chamber 5956*b* by way of orifices in a second planar member 5950 sealably mounted transversely within the housing 5912. This mechanism is similar to the valve actuating mechanism described above in reference to FIGS. 40A-C, and will not be described further.

Figure 59B:
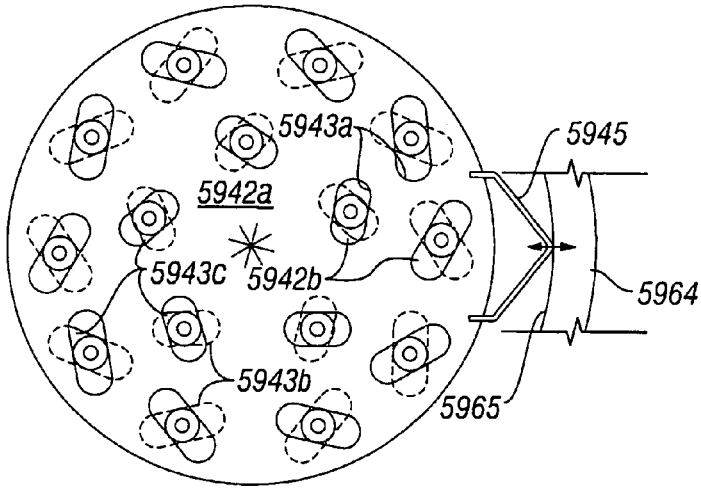
FIG. 59B is a top view of the focusing disks, illustrating the intersecting focusing slots thereof.

With reference to both FIGS. 59A and 59B, the spray apparatus 5910 further comprises a focusing assembly, in the form of stacked, dual focusing disks or plates 5942*a*, 5942*b* carried for relative translational movement about a hub portion 5951 depending from the second planar member 5950. Each of the focusing disks 5942*a*, 5942*b* has a plurality of slots therein for pointing the fluid-dispensing tubes 5918 coupled thereby to one of a plurality of nominal radially-oriented positions. The slots 5943*a* of the upper disk 5942*a* overlie and are conversely oriented to the respective slots 5943*b* of the lower disk 5942*b*, so as to effect a plurality of common constricted slot areas 5943*c* through the upper and lower plates for engaging the respective coupled fluid-dispensing tubes 5918 by the extension of intermediate portions of the respective coupled tubes through the common slot areas 5943*c*. Preferably, at least one of the complementary focusing disks 5942*a*, 5942*b* is rotatable with respect to the other of the complementary disks (e.g., by one or more slide arms 5945 actuated by a sloped inner surface 5965 of the actuator ring 5964) for moving the coupled tubes 5918 inwardly or outwardly with respect to the central axis of the housing 5912. The focusing disks 5942*a*, 5942*b* cooperate to laterally displace and cause flexing of intermediate portions of the dispensing tubes 5918 so as to adjust the fluid-dispensing direction of the tubes 5918 in a unified converging (or diverging) manner, i.e., to focus the shape of the shower defined by the fluid streams dispensed from the plurality of dispensing tubes.

Figure 60A:
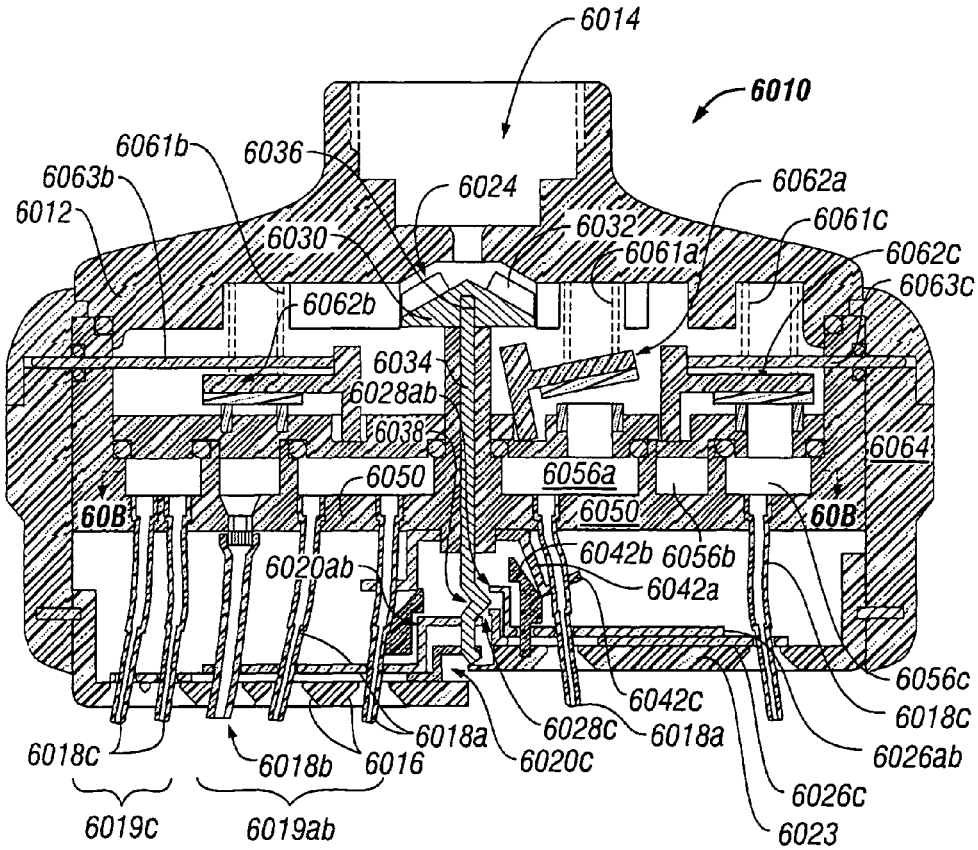
FIGS. 60A-B are axi-sectional and cross-sectional representations of an alternative spray apparatus that employs a variable turbine-cam interface for adjusting the degree of oscillation applied by the integrating member to the dispensing tubes, actuating valves that control fluid entry to respective massage, aeration, and shower chambers, as well as an alternative focusing mechanism for converging/diverging the dispensing tubes in unison to achieve a focusing effect.
Figure 60B:
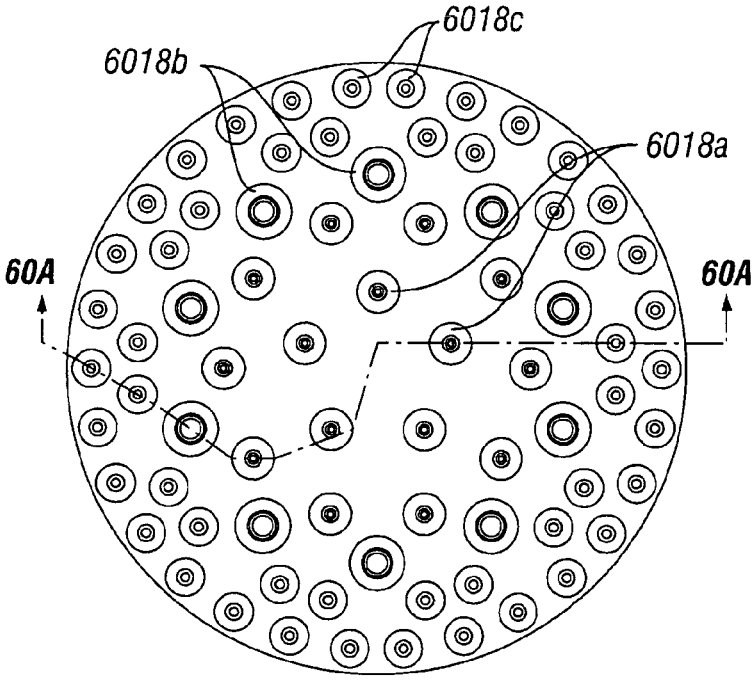

FIGS. 60A-B are axi-sectional and cross-sectional representations of an alternative spray apparatus that employs a rotatable actuator ring 6064 for adjusting the elevation of a dual integrating member, and for actuating valves that control fluid entry to respective massage, aeration, and shower chambers, whereby the degree of turbine oscillation applied to coupled dispensing tubes is adjusted, different showering effects are achieved, and for the dispensing tubes are converged/diverged in unison, via focusing cams and rings, to achieve a focusing effect. The actuator ring 6064 is rotatable about the housing 6012 for sequentially urging three valve stems 6063*a* (not shown), 6063*b*, and 6063*c* against respective valve gates 6062*a*, 6062*b*, and 6062*c* so as to move the valve gates—in cooperation with respective closure springs 6061*a*, 6061*b*, and 6061*c*—between positions closing or opening respective fluid chambers 6056*a*, 6056, and 6056*c* for delivery of water to respective inner (massage) fluid-dispensing tubes 6018*a*, intermediate (aerating) fluid-dispensing tube 6018*b*, and outer (shower/comfort) fluid-dispensing tubes 6018*c* that fluidly communicate with the chambers by way of orifices (not numbered) in a second planar member 6050 sealably mounted transversely within the housing 6012. This mechanism is similar to the valve actuating mechanism described above in reference to FIGS. 40A-C, and will not be described further. The aerating tubes 6018*b* are described further below with reference to FIG. 75A-D.

The rotatable actuator ring 6064 is also operative for adjusting the elevation of stacked, dual integrating members 6020*ab*, 6020*c* via a movable outlet plate 6023, whereby the degree of turbine oscillation applied to coupled dispensing tubes 6018*a* and 6018*b* is selectively adjusted by movement of the upper integrating member 6020*ab* via the outlet plate 6023. Similarly, the degree of turbine oscillation applied to coupled dispensing tubes 6018*c* is selectively adjusted by movement of the lower integrating member 6020*c* via the outlet plate 6023. This mechanism is similar to that described above in reference to FIGS. 57 and 58, and will not be described further, except to note the particular complexity of the turbine cam 6038 which is effective for various degrees of oscillation (or no oscillation) by the integrating members 6020*a*, 6020*b*.

The spray apparatus 6010 further comprises one or more focusing elements, in the form of flexible focusing arms or straps 6042*a* each connected to the second planar member 6050 mounted above the integrating members 6020*ab*, 6020*c*. The focusing arms 6042*a* cooperate with respective focusing cams 6042*b* to laterally displace intermediate portions of the dispensing tubes upon movement up/down of the outlet plate 6043 under rotation of the peripheral ring 6064. The focusing arms comprise flange portions 6042*c* that engage and cause flexing of the dispensing tubes 5818 so as to adjust the fluid-dispensing direction of the tubes (only tubes 6018*a* are shown flexed, but the other tubes 6018*b*, 6018*c* may be similarly flexed) in a unified converging (or diverging) manner, i.e., to focus the shape of the shower defined by the fluid streams dispensed from the plurality of dispensing tubes. Accordingly, a focused, narrow spray configuration is depicted on the right half of FIG. 60, while an unfocused (normal), wide spray configuration is depicted on the left half of FIG. 60.

Figure 61A:
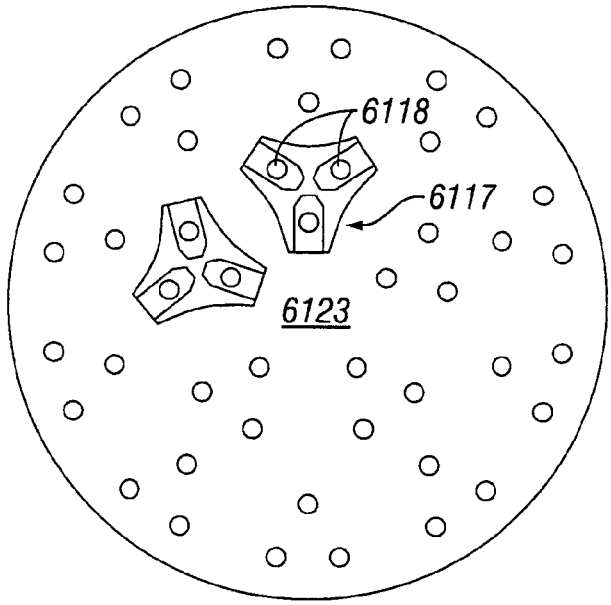
FIG. 61A is a plan-view representation of groups of three fluid-dispensing tubes being clustered for achieving particular tube focusing effects.
Figure 61B:
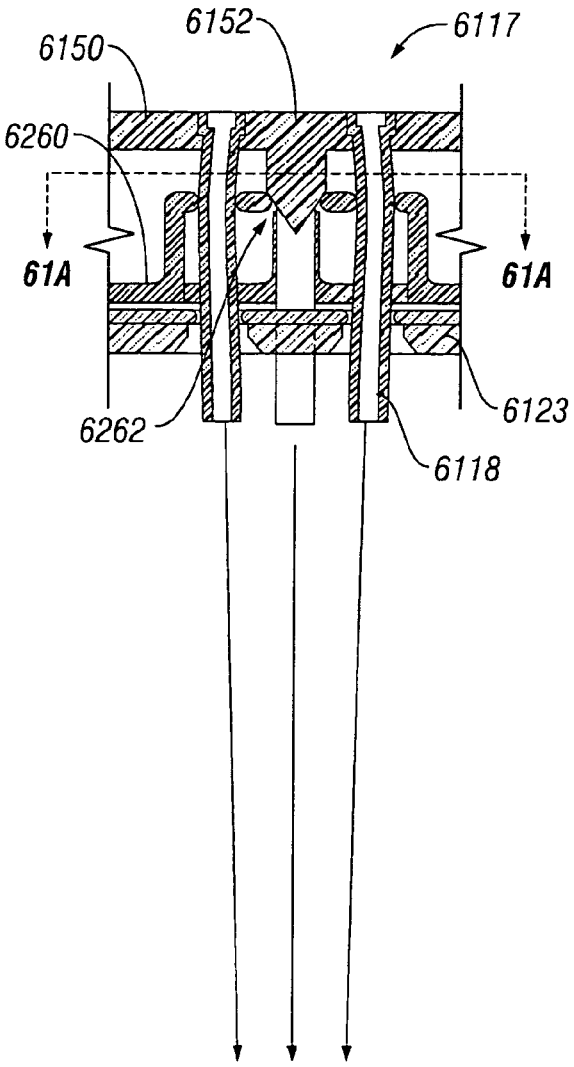
FIGS. 61B-C are sectional representations of the three-tube clusters of FIG. 61A in converged (FIG. 61B) and normal (FIG. 61C) states.
Figure 61C:
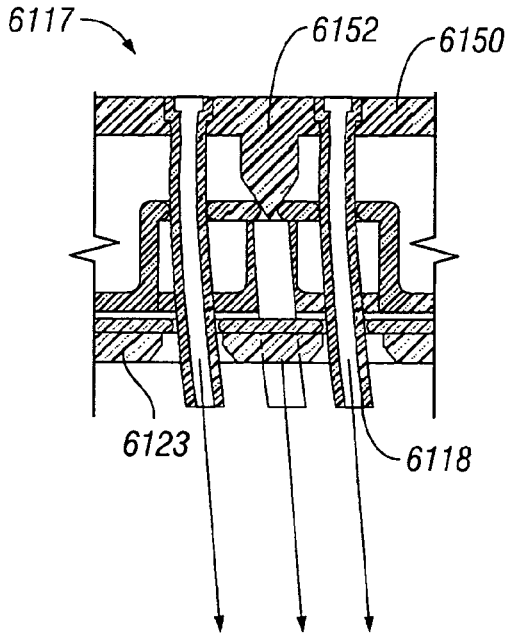

FIG. 61A is a plan-view representation of forty-five fluid-dispensing tubes 6118 that are subject to being grouped in fifteen three-tube clusters 6117 for achieving particular tube focusing effects. FIGS. 61B-C are sectional representations of the three-tube clusters 6117 of FIG. 61A in converged (FIG. 61B) and normal (FIG. 61C) states. The clustered tubes are converged to produce unified fluid-flow streams by upward movement of an outlet plate 6123 (like the above-described movement of outlet plate 6023), which forces an actuator plate 6160, including its central orifice 6162, into engagement with a cam 6152 depending from a second planar member 6150. Accordingly, each focusing element (i.e., the actuator plate 6160) may be operable to adjust the fluid-dispensing direction of the dispensing tubes of the cluster in a unified converging (or diverging) manner. The focusing elements may be integrally formed with the integrating member, as described above. Additionally, each focusing element may be operable to produce a high impact spray, a soft impact spray, or a combination thereof from its associated cluster. Furthermore, a plurality of such focusing elements may be operable in a unified converging manner to produce a high impact shower, a soft impact shower, or a combination thereof from their respective clusters (i.e., the cluster outputs are collectively focused).

Figure 61D:
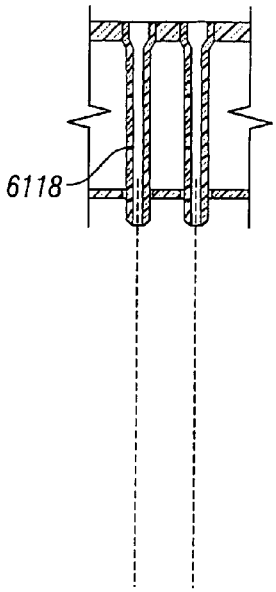
FIGS. 61D, 61E, and 61F are side-view representations of a pair of fluid-dispensing tubes with no focusing (FIG. 61D), some focusing (FIG. 61E), and maximum focusing (FIG. 61F).
Figure 61E:
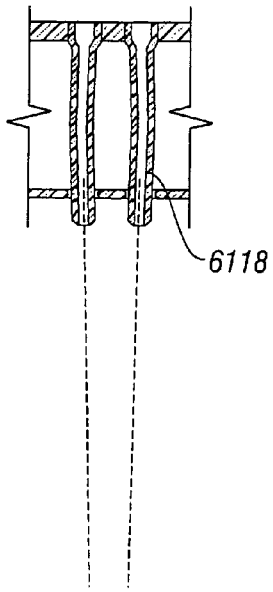
Figure 61F:
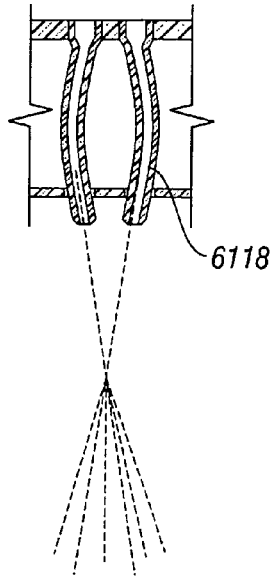

FIGS. 61D, 61E, and 61F are side-view representations of alternative clustered pairs of (rather than three) fluid-dispensing tubes 6118 with no focusing (FIG. 61D), some focusing (FIG. 61E), and maximum focusing (FIG. 61F).

It will be appreciated by those skilled in the art and given the benefit of this disclosure that the dispensing tubes as provided herein may comprise a flexible tubular body having a non-uniform stiffness about its periphery, whereby the application of uniform lateral force about the periphery will produce non-uniform lateral flexing of the tubular body. The non-uniform stiffness may be provided by the tubular body having a non-uniform wall thickness about its periphery. Alternatively, the non-uniform stiffness may be provided by the tubular body having a non-uniform rib distribution about its periphery. It will further be appreciated that the flexible tubular body may have a non-uniform stiffness along its length, whereby the application of lateral force to the tubular body will produce non-uniform flexing of the tubular body along its length. The non-uniform stiffness may be provided by the tubular body having a non-uniform wall thickness along its length. Alternatively, the non-uniform stiffness may be provided by the tubular body having a non-uniform rib distribution along its length.

Figure 62A:
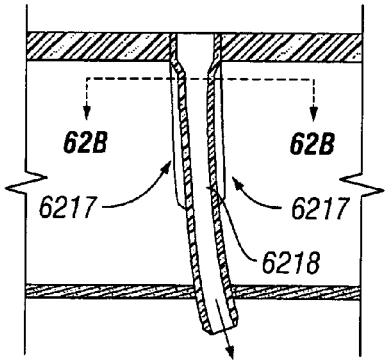
FIGS. 62A-B are side and cross-sectional representations of a fluid-dispensing tube employing a non-uniform distribution of ribs about its periphery (as well as along its length) for achieving non-uniform flexing of the tube.
Figure 62C:
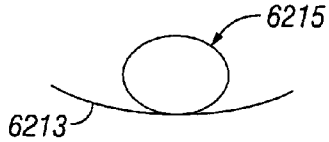
FIG. 62C shows a resulting oval-shaped spray pattern from the non-uniform distribution of ribs according to FIGS. 62A-B.
Figure 62B:
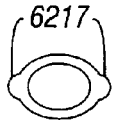
Figure 62D:
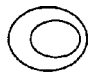
FIG. 62D is a cross-sectional representation of a fluid-dispensing tube having a non-uniform wall thickness about its periphery for achieving non-uniform flexing of the tube.

Thus, FIGS. 62A-B are side and cross-sectional representations of a fluid-dispensing tube 6218 employing a non-uniform distribution of ribs 6217 about its periphery (as well as along its length) for achieving non-uniform flexing of the tube. FIG. 62C shows a resulting oval-shaped spray pattern 6215 within a general shower outline 6213 from the non-uniform distribution of ribs according to FIGS. 62A-B. FIG. 62D is a cross-sectional representation of a fluid-dispensing tube having a non-uniform wall thickness about its periphery for achieving non-uniform flexing of the tube.

Figure 63:
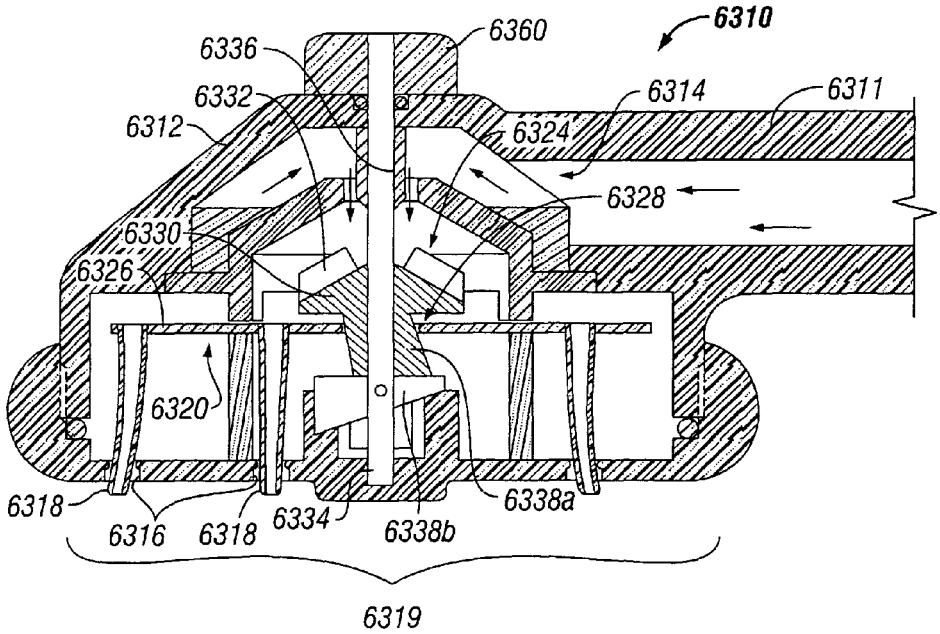
FIGS. 63-64 are sectional representations of alternative hand-held spray apparatuses each employing a cammed turbine to oscillate a plurality of fluid-dispensing tubes in coordinated fashion via an integrating member, and a variable turbine-cam interface for adjusting the degree of oscillation applied by the integrating member to the dispensing tubes thereof.
Figure 64:
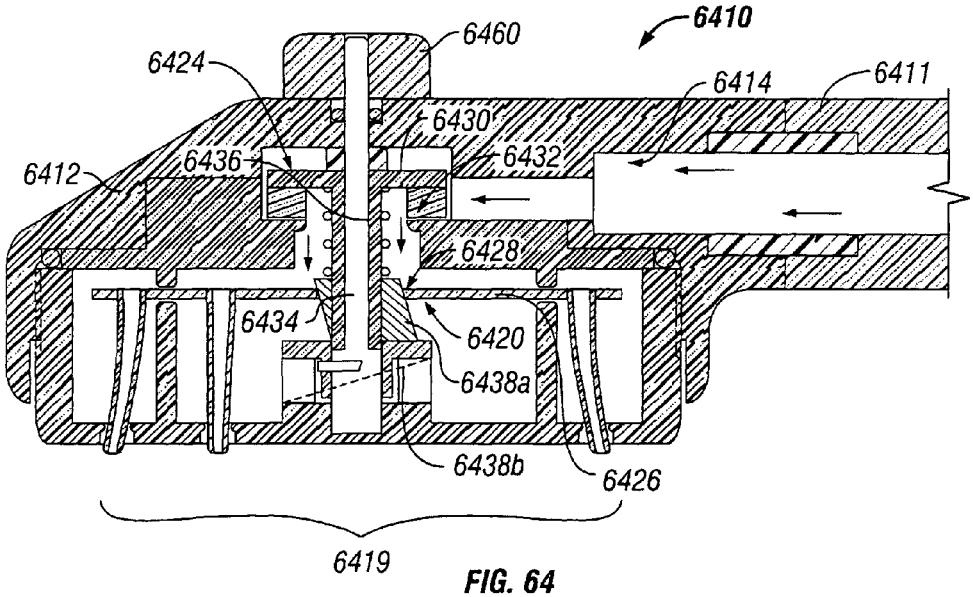

FIGS. 63-64 are sectional representations of alternative hand-held spray apparatuses 6310, 6410 employing rotatable control-cap members 6360, 5460 for adjusting the elevation of turbine-driven horizontal cams 6338*a*, 6438*a* via the respective turbine shafts 6334, 6434 that rotate with the control caps, splined vertical cams 6338*b*, 6438*b* that are pinned for rotation with the turbine shafts, whereby the degree of turbine oscillation applied to coupled dispensing tubes 6319, 6419 by the horizontal cams 6338*a*, 6438*a* that are fixed for rotation with the turbine heads 6330, 6430, is selectively adjusted. The spray housings 6312, 6412 may be integrally formed (or otherwise connected) with respective handles 6311, 6411 for delivering fluid (internally) to the housings and for gripping (externally) by a user, in conventional manners. The apparatuses 6310, 6410 are shown employing respective axially-feed and radial-feed turbines (referenced as 6324, 6424).

Figure 65A:
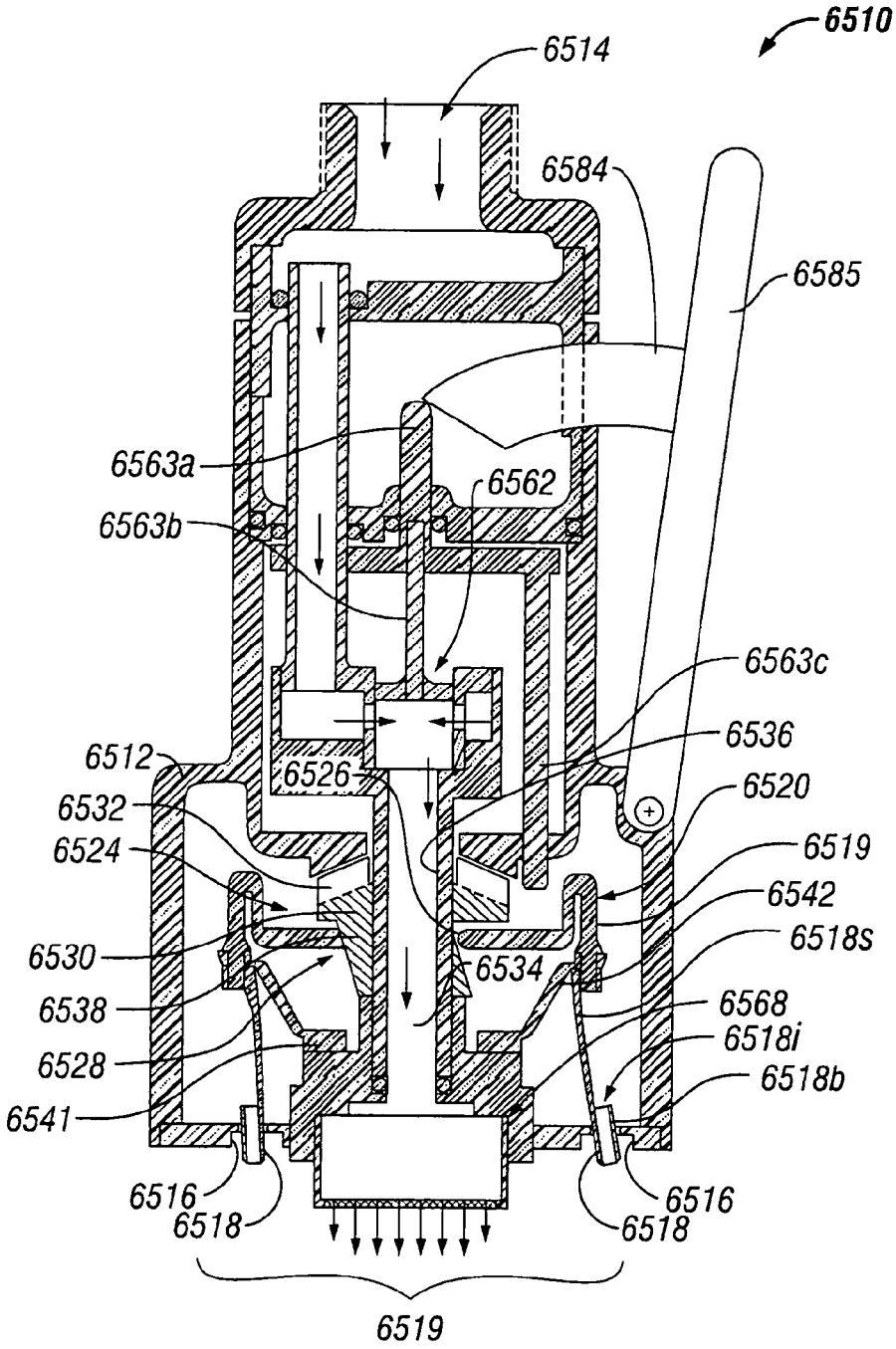
FIGS. 65A-B are sectional representations of a kitchen-faucet spray apparatus that employs a variable turbine-cam interface for adjusting the degree of oscillation applied by an integrating member to coupled dispensing tubes, an actuating valve that diverts fluid flow to an aeration chamber, as well as a focusing mechanism for converging/diverging the dispensing tubes in unison to achieve a focusing effect.
Figure 65B:
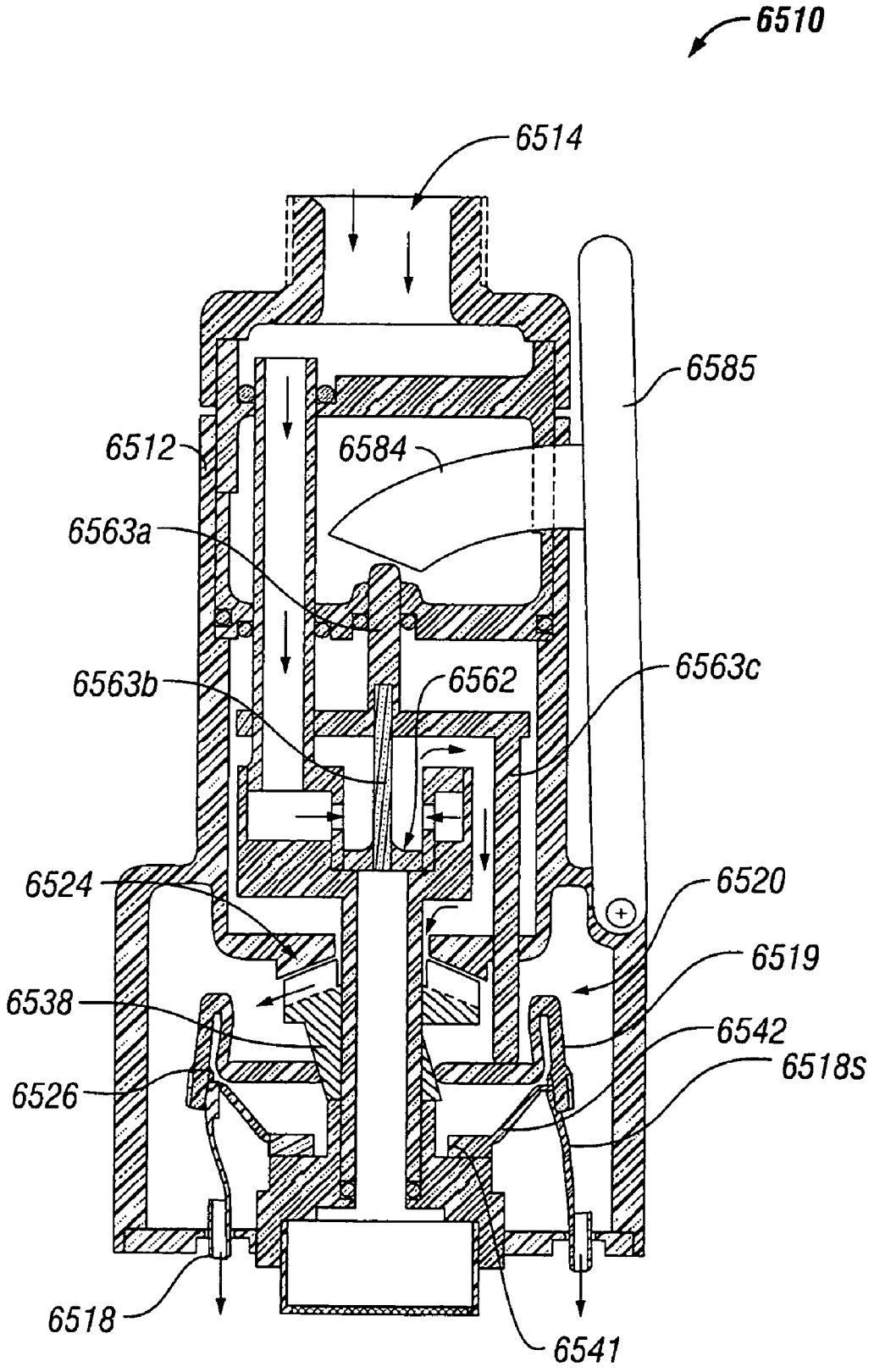

FIGS. 65A-B are sectional representations of a kitchen-faucet spray apparatus 6510 that employs a pivotal lever 6585 for actuating a valve 6562 and for adjusting the elevation of a flexible integrating member 6520, whereby the degree of turbine oscillation (wider in FIG. 65A; narrower in FIG. 65B) applied to coupled dispensing tubes 6518 is adjusted, the dispensing tubes are converged/diverged in unison to achieve a focusing effect (converged in FIG. 65B), and fluid is diverted to either a central aerator (FIG. 65A) or the coupled dispensing tubes (FIG. 65B). Thus, the spray apparatus housing 6512 is preferably adapted for use in a kitchen faucet application (as opposed, e.g., to a wall-mounted or hand-held showering apparatus).

More particularly, the spray apparatus 6510 comprises a housing 6512 having a fluid inlet 6514, a plurality of tubes 6518 for dispensing liquid from the housing, and an aerator 6568 for dispensing an air-liquid mixture from the housing 6512. An integrating member 6520 is operatively coupled to at least a subset of the plurality of tubes 6518 for effecting coordinated movement of the coupled tubes in response to movement of the integrating member. A cammed turbine actuator 6524 is employed for inducing oscillatory movement of the integrating member 6520.

A valve assembly comprising the lever/actuator 6585, a transverse arm 6584, a first valve stem portion 6563*a*, a second valve stem portion 6563*b*, and the valve 6562, is employed for regulating the flow of liquid between the dispensing tubes 6518 and the aerator 6568. The aerator is preferably located centrally with respect to the dispensing tubes. The dispensing tubes are preferably flexible so as to allow for easy adjustment of the fluid-dispensing direction or shape by the application of a lateral force at one or more locations along the length of the tubes.

A further actuator stem 6563*c* is attached to the first valve stem portion 6563*a* for movement therewith. The actuator stem is operable to engage the planar member 6526 of the integrating member 6520 so as to alter the elevation at which the central orifice 6528 of the integrating member engages the turbine cam 6538, thereby providing for selective adjustment of the resulting oscillating effect of the coupled tubes 6518.

The spray apparatus 6510 further comprises one or more focusing elements, in the form of spider-like arms 6542 that constitute portions of the integrating member 6520, along with a ring member 6541 (i.e., the members 6520, 6541, and 6542 are integrally formed) that has an operating clearance about the turbine axle 6534 (which conducts fluid in this embodiment). The spider arms 5642 are connected to the dispensing tubes 5618 by way of the engagement of the arms 5642 with flexible straps 6518*s* that are connected (i.e., integrally formed) at or near the inlet 6518*i* of each tubular body 6518*b* for pivotally mounting the tubular body 6518*b* within the housing 6512. The focusing elements (i.e., the spider arms 6542) also engage outer hub portion 6519 of the integrating member 6520 so that the spider arms 6542 and the straps 6518*s* are both constrained by the movement of the integrating member 6520. The spider arms 6542 and straps 6518*s*, as well as the dispensing tubes 6518, are therefore displaced by the above-described adjustment of the engagement position of the integrating member 6520 with the turbine cam 6538 so as to adjust the fluid-dispensing direction of the dispensing tubes 6518 in a unified converging (or diverging) manner, i.e., to focus the shape of the shower defined by the fluid streams dispensed from the plurality of dispensing tubes. Accordingly, an unfocused (normal), wide spray configuration with wider turbine-induced oscillations is depicted in FIG. 65A, while a focused, narrow spray configuration with narrower turbine-induced oscillations is depicted in FIG. 65B.

Figure 66A:
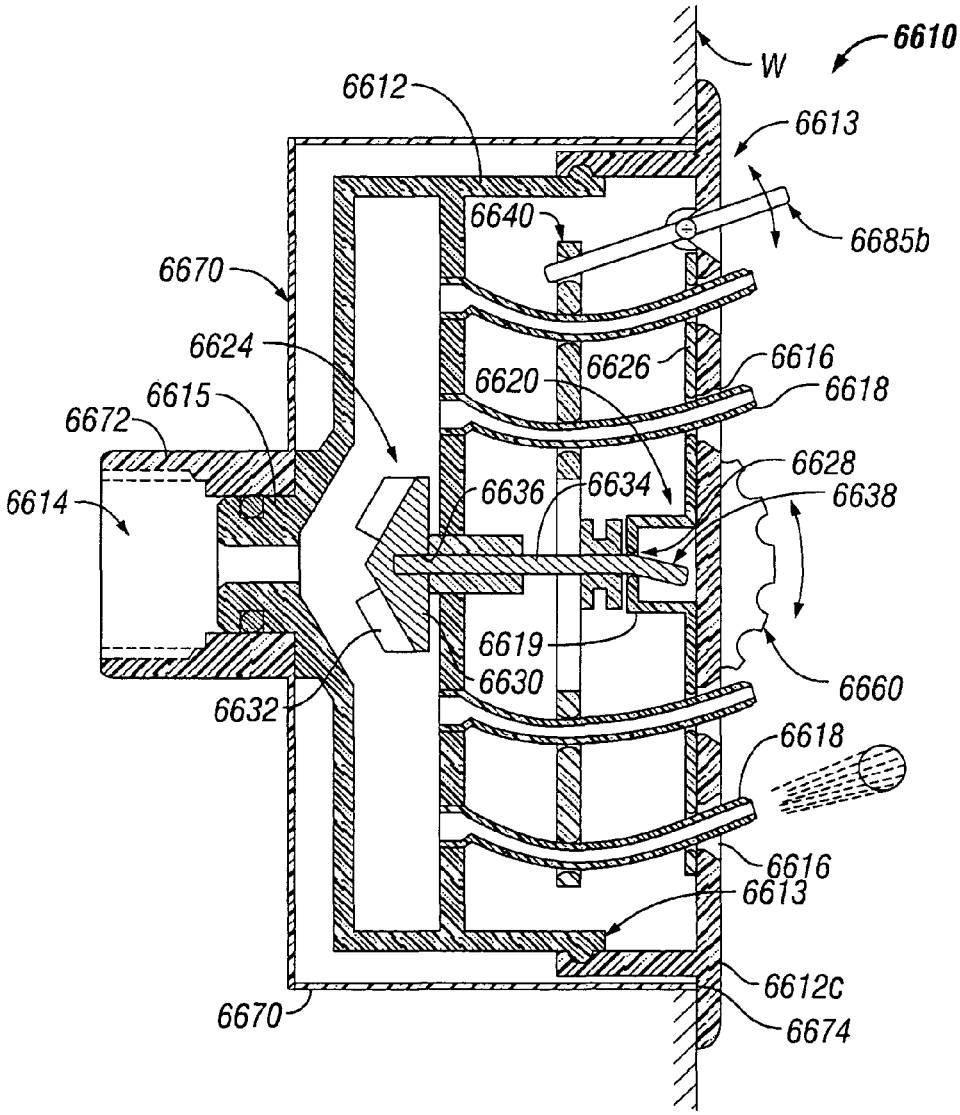
FIG. 66A-B are sectional and front-view representations of an alternative spray apparatus mounted in a wall and employing actuating levers for adjusting the pointing direction of the dispensing tubes in a unified manner, and employing an actuator wheel for adjusting the degree of oscillation applied to coupled dispensing tubes.
Figure 66B:
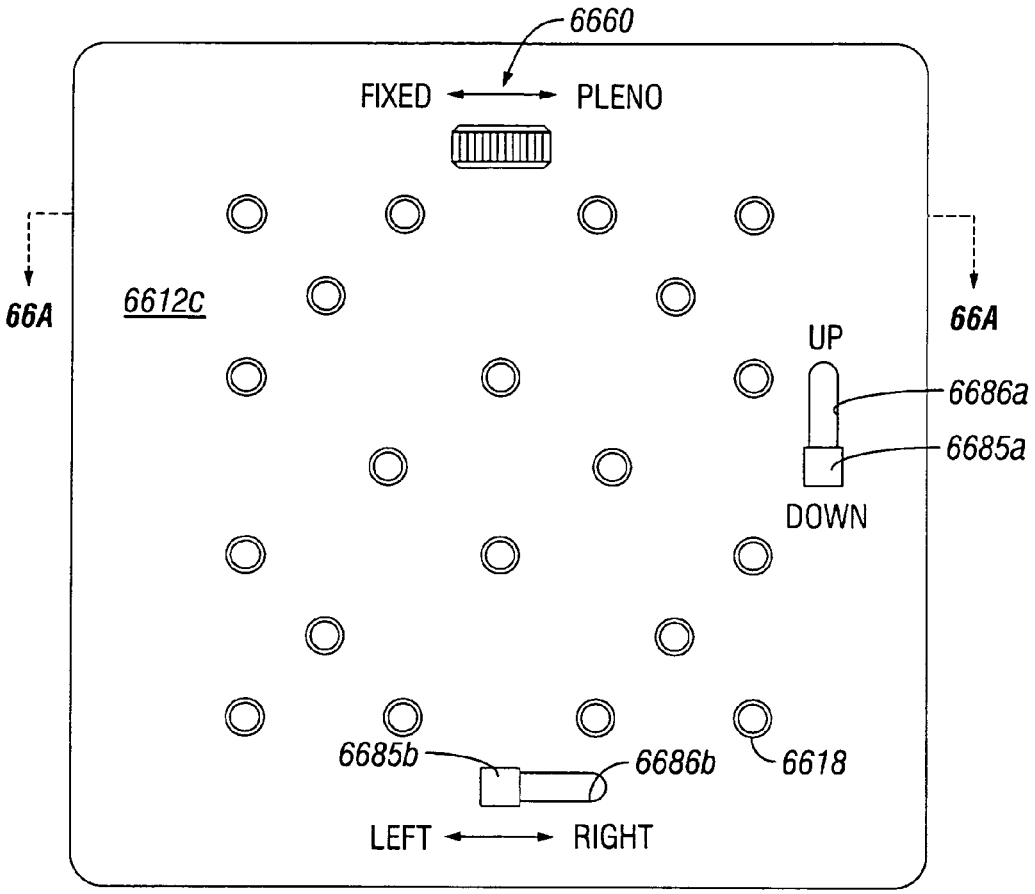

FIG. 66A-B are sectional and front-view representations of an alternative spray apparatus 6610 mounted in a shower wall W and employing actuating levers 6685*a*, 6685*b* for adjusting the pointing direction of the dispensing tubes 6618 in a unified manner. An actuator wheel 6660 is also employed for adjusting the degree of oscillation applied to coupled dispensing tubes 6619.

More particularly, the spray apparatus 6610 comprising a housing 6612 adapted for mounting within a wall space WS exposed by an opening WO in a wall W. The housing 6612 has a fluid inlet 6614 for receiving a fluid supply conduit run behind the wall, and an open end 6613 for alignment with the wall opening WO. A face plate 6612*c*, which ideally forms a component part of the housing 6612, is employed for engaging the open end 6613 of the housing. The face plate has a plurality of fluid outlets 6616 through which downstream portions of a plurality of tubes 6618 are disposed for dispensing fluid from the housing 6612 via the fluid outlets 6616 of the face plate 6623.

An integrating member 6620 is operatively coupled to at least a subset of the plurality of tubes 6618 for effecting coordinated movement of the coupled tubes in response to movement of the integrating member 6620. An actuator is employed for inducing movement of the tubes and integrating member.

The actuator preferably comprises a pair of levers 6685*a*, 6685*b* each pivotally connected to a direction control disk 6640 and extending through a slotted portion of the face plate 6612*c* for applying pivoting forces to the direction control disk 6640. Thus, the lever 6685*a* is slidable through a slot 6686*a* in the face plate 6612*c* for adjusting the nominal orientation of each of the coupled dispensing tubes 6618, so as to adjust the fluid-dispensing direction of (i.e., point) the dispensing tubes up or down in a unified manner. Similarly, the lever 6685*b* is slidable through a slot 6686*b* in the face plate 6612*c* for pointing the tubes 6618 left or right in a unified manner. Since the tube position-adjusting mechanism operates independently of movement of the housing 6612 (i.e., the housing is stationary with respect to the wall), there is no need for a typical swivel/ball housing mount. As with various other embodiments of the present invention, the dispensing tubes 6618 are preferably flexible so as to allow for easy adjustment of the fluid-dispensing direction or shape by the application of a lateral force at one or more locations along the length of the tubes.

Additionally, the actuator of the spray apparatus 6610 preferably comprises a turbine 6624 carried for rotary movement within the housing 6612 under fluid flow from the fluid inlet 6614 to one or more of the fluid outlets 6616. The integrating member 6620 is operatively coupled to the turbine 6624 for oscillatory movement relative to the housing 6612 under rotary movement of the turbine 6624. A control wheel 6660 extends partially through the face plate 6612*c* and engages the turbine (e.g., by a gear train, not shown) to adjust the axial position of the turbine shaft 6634, including the cam portion 6638 thereof, relative to a hub portion 6621 of the integrating member 6620, allowing for adjustment in the degree of oscillation applied to the coupled tubes 6619.

A receptacle box 6670 is mounted within the wall space WS exposed by the opening WO in the wall W for receiving the housing 6612. The receptacle box 6670 has a neck 6672 for receiving a fluid supply conduit (not shown) in the wall space and an open end 6674 for alignment with the wall opening WO and the open end 6613 of the housing 6612. The fluid inlet 6614 of the housing is defined by a nipple 6615 adapted for sealable fitting within the neck 6672 of the receptacle box 6670.

Figure 67A:
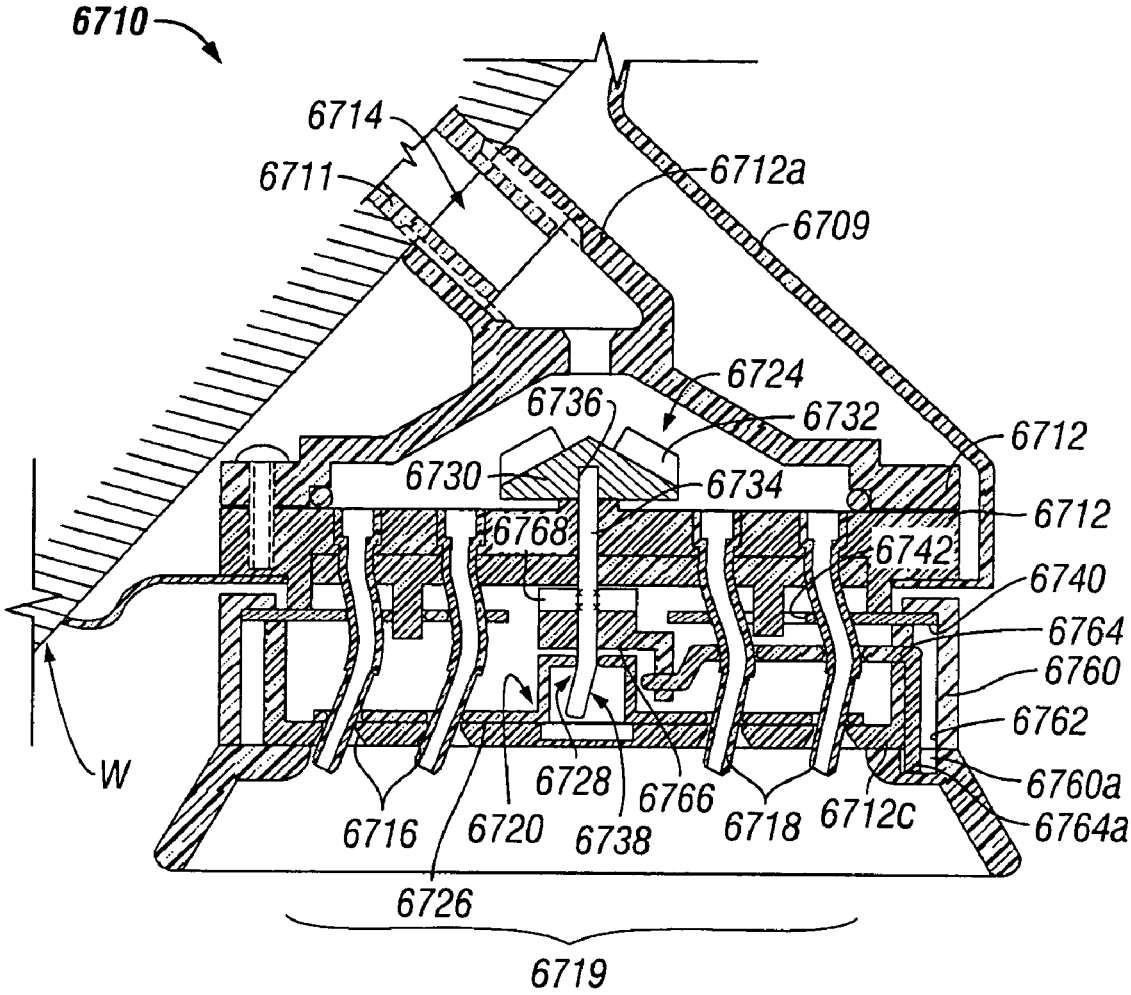
FIGS. 67A-B are sectional and side-view representations of an alternative spray apparatus having a variable turbine-cam interface for adjusting the degree of oscillation applied by an integrating member to coupled dispensing tubes, and a direction control mechanism for pointing the direction of the dispensing tubes in unison, the apparatus being mounted closely adjacent a wall without the use of a shower ball/swivel mounting.
Figure 67B:
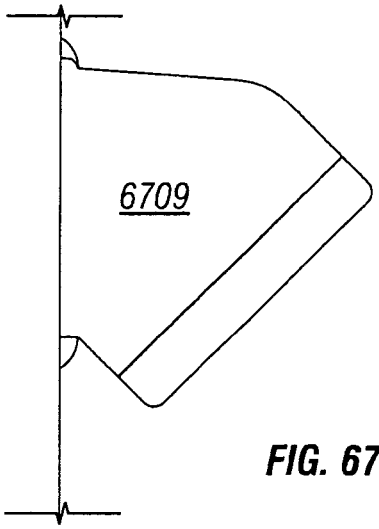

FIGS. 67A-B are sectional and side-view representations of an alternative spray apparatus 6710 having a variable turbine-cam interface for adjusting the degree of oscillation applied by an integrating member 6720 to coupled dispensing tubes 6719, and a focusing mechanism for converging/diverging the dispensing tubes in unison to achieve a focusing effect. The apparatus 6720 is mounted closely adjacent a shower wall W without the use of a shower ball/swivel mounting, by way of a housing neck 6712*a* that receives a conduit 6711 in sealed, threaded engagement. A trimming sleeve 6709 is employed to establish a smooth aesthetic transition between the housing 6712 and the wall W.

The spray apparatus 6720 employs a direction control disk 6740 for flexing the tubes 6718 at intermediate locations thereon to achieve desired pointing of the fluid dispensing spray nominal positions in unison. The direction control disk 6740 is essentially free-floating, although the inherent stiffness of the flexible tubes 6718 will constrain the control disk against (permanent) rotation. A rotatable control ring 6760 has an inner cammed profile 6762 for inducing applying a lateral force to the direction control ring 6740 when the ring 6760 is rotated.

A shaft 6764 is disposed for rotation within the housing 6712 about its own axis, and the rotation of control ring 6760 induces rotation of the crank arm 6764 by the engagement of a shoulder 6760*a* of the ring with a lower end 6764*a* of the crank arm 6764. The crank arm 6764 engages a slidable spacer 6766, such that rotation of the shaft about its axis induces a slight lift of the slidable spacer 6766 along the turbine shaft 6734, thereby moving a flange member 6768 affixed to the turbine shaft 6734 up or down. This, in turn, effects up/down movement of the turbine cam 6738, whereby the degree of oscillation imposed on the integrating member 6720 by rotation of the turbine 6724 is selectively varied.

Figure 74:
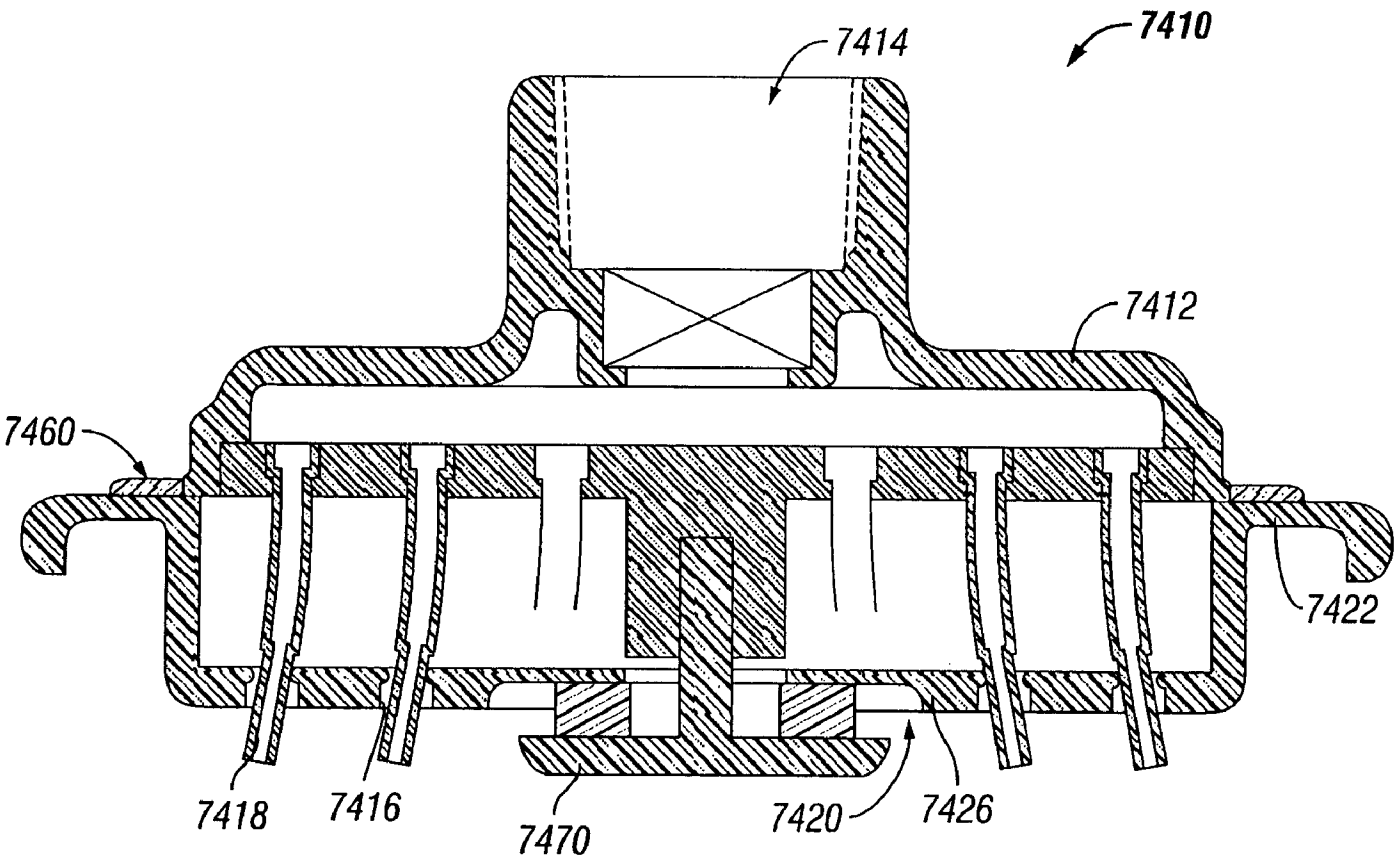

FIGS. 68-73 illustrate sectional representations of alternative spray apparatuses X10 that permit near-wall mounting and unified pointing of fluid-dispensing tubes X18 coupled by a free-floating integrating member X20 (particularly the planar member X26 thereof)—via a movable control ring actuator X22 and a spring retainer element X60 (e.g., molded plastic component)—without the need for a shower ball/swivel mounting. The natural self-centering properties of the coupled tubes X18 resist undesirable tangential forces that may be induced by the rotation of the control ring X22. Thus, the integrating member X20 is at least partially carried by the housing across the open end of the housing and has a plurality of orifices X16 for passage of the plurality of tubes X18 therethrough for effecting coordinated movement of the coupled tubes in response to movement of the integrating member. The control ring X22 is adjustably carried by the spring retainer X60 that releasably secures the control ring in one or more positions with respect to the housing. The spray apparatus 7410 of FIG. 74 is similarly equipped, except the integrating member 7420 is be integrally formed with the control ring 7422, requiring the use of retainer assembly 7470 that constrains the ring 7422 against rotation.

FIGS. 75A-D are sectional and cross-sectional representations of various aerator plug configurations for a fluid-dispensing tube 7518 of a spray apparatus. The inventive dispensing tube comprises a tubular body 7518*b*, and an aerator plug 7518*p* for insertion into an upper end 7518*i* of the tubular body. The tubular body 7518*b* employs a venturi effect, and is preferably flexible so as to allow for easy adjustment of the fluid-dispensing direction or shape by the application of a lateral force at one or more locations along the length of the tubular body.

At least one of the body 7518*b* and the plug 7518*p* is adapted for connection to a portion of the spray apparatus. In particular embodiments, like that of FIG. 75, the plug 7518*p* is integrally formed with a transverse planar housing member 7550 in which the tubes 7518 are mounted. The plug 7518*p* has one or more first passages 7518*a* for conducting water therethrough and one or more second passages 7518*b* for conducting air therethrough. The first passages 7518*a* may employ a cross-sectional shape that is one of circular, axial, curvilinear, and a combination thereof. The second passages

Figure 75A:
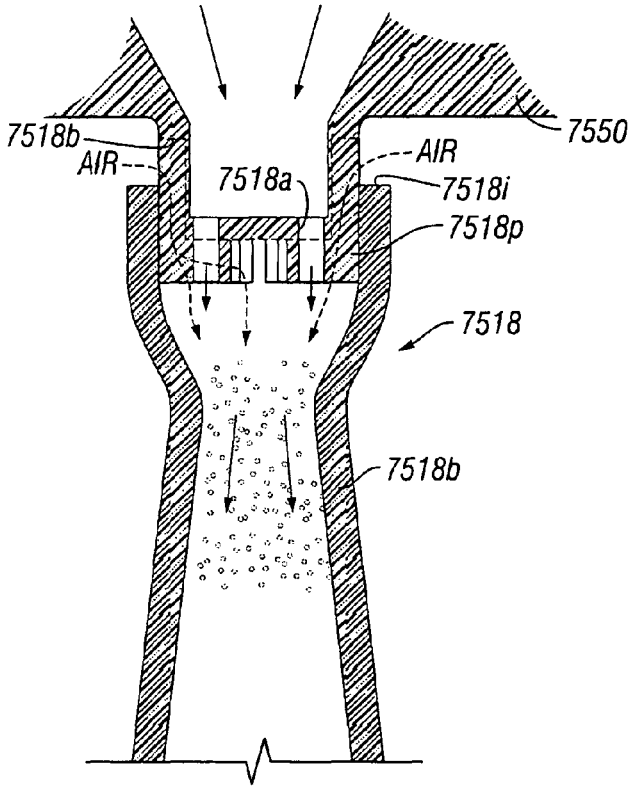
FIGS. 75A-D are sectional and cross-sectional representations of various aerator plug configurations for a fluid-dispensing tube of a spray apparatus.
Figure 75B:
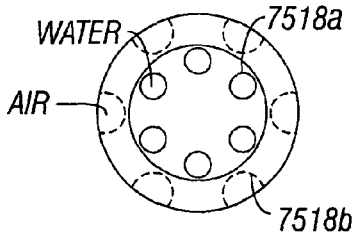
Figure 75C:
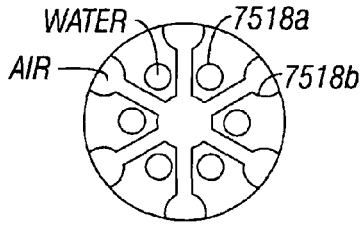
Figure 75D:
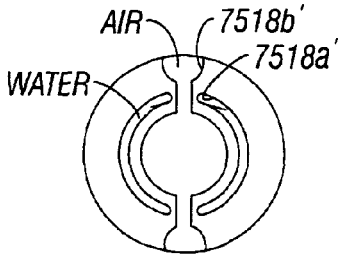

7518*b* may employ a cross-sectional shape that is one of circular, axial, curvilinear, and a combination thereof. The second passages are preferably discrete from the first passages. FIGS. 75B and 75C show respective top and bottom cross-sectional views taken through the plug 7518*p*. FIG. 75D shows a top cross-section of an alternative plug equipped with alternative first and second passages 7518*a*', 7518*b*'.

It will be understood from the foregoing description that various modifications and changes may be made in the preferred and alternative embodiments of the present invention without departing from its true spirit. Thus, e.g., while several components of the above-disclosed spray apparatus embodiments have been described as separate, it will be appreciated that certain of such components may be integrally manufactured for the sake of economy. For example, the tubes 4618, straps 4618*s*, webs 4641, posts 4640, and integrating member 4620 (see FIG. 46) may all be integrally manufactured in a so-called "over-molding" operation.

This description is intended for purposes of illustration only and should not be construed in a limiting sense. The scope of this invention should be determined only by the language of the claims that follow. The terms "comprising," "containing," having," and "including" are all intended to mean an open set or group of elements. "A," "an" and other singular terms are intended to include the plural forms thereof unless specifically excluded.

The following is a listing that describes various embodiments of the invention, most of which have been previously described, and form part of the detailed description.

1. A spray apparatus, comprising:

a housing having a fluid inlet and a plurality of fluid outlets;

a turbine carried for rotary movement within the housing under fluid flow from the fluid inlet to one or more of the fluid outlets;

an integrating member operatively coupled to the turbine for oscillatory movement relative to the housing under rotary movement of the turbine; and a plurality of tubes each disposed in one of the fluid outlets for dispensing fluid from the housing, at least a subset of the plurality of tubes being operatively-coupled to the integrating member for coordinated movement of the coupled tubes in the respective plurality of fluid outlets.

2. The spray apparatus of claim 1, wherein the oscillatory movement of the integrating member comprises at least one of circular, elliptical, and linear movement.

3. The spray apparatus of claim 1, wherein the integrating member is operatively coupled to the turbine for oscillatory movement within the housing under rotary movement of the turbine.

4. The spray apparatus of claim 1, wherein the plurality of tubes are each sealingly disposed in one of the fluid outlets.

5. The spray apparatus of claim 1, wherein the tubes are rigid.

6. The spray apparatus of claim 1, wherein the tubes are flexible.

7. The spray apparatus of claim 6, wherein the tubes comprise a natural polymer, a synthetic polymer, or a combination thereof.

8. The spray apparatus of claim 1, wherein the coupled tubes are oriented with respect to one another in a configuration that is parallel, divergent, convergent, or a combination thereof.

9. The spray apparatus of claim 1, wherein the fluid inlet directs fluid towards the turbine in a direction selected from axial, radial, tangential, and combinations thereof.

10. The spray apparatus of claim 1, wherein at least a portion of the housing is substantially cylindrical.

11. The spray apparatus of claim 1, wherein the rotary movement of the turbine comprises spinning, nutating, or a combination thereof.

12. The spray apparatus of claim 11, wherein the nutating comprises a wobbling motion.

13. The spray apparatus of claim 1, wherein the turbine comprises a head having at least two angled or curved vanes on an upper surface thereof and being radially symmetrical.

14. The spray apparatus of claim 1, wherein:

the integrating member comprises a first planar member having a substantially central orifice; and the turbine comprises:

a head having at least one angled or curved vane on an upper surface thereof; and a shaft depending from the turbine head and extending at least partially through the orifice in the first planar member for operatively coupling the integrating member to the turbine.

15. The spray apparatus of claim 14, wherein the turbine shaft is disposed in an opening formed through a lower portion of the turbine head.

16. The spray apparatus of claim 15, wherein the turbine shaft is fixed for rotation with the turbine head.

17. The spray apparatus of claim 14, wherein the turbine shaft is integrally formed with the turbine head.

18. The spray apparatus of claim 16, further comprising a cam portion fixed about the turbine shaft opposite the turbine head such that the cam portion rotates with the turbine head, the cam portion being carried within the orifice of the first planar member.

19. The spray apparatus of claim 16, further comprising a cam portion fixed about the turbine shaft beneath the turbine head such that the cam portion rotates with the turbine head, the cam portion being carried within the orifice of the first planar member.

20. The spray apparatus of claim 19, wherein the cam portion is integral with the turbine head.

21. The spray apparatus of claim 18, wherein:

the cam portion has a sloping vertical profile; and further comprising:

a means for adjusting the elevation of the integrating member relative to the cam portion so as to induce engagement of the integrating member with varying elevations of the sloping vertical profile of the cam portion, whereby the range of oscillating of the integrating member resulting from rotation of the turbine may be adjusted.

22. The spray apparatus of claim 16, further comprising a second planar member sealingly mounted against rotation within the housing between the integrating member and the fluid inlet, the second planar member comprising:

a substantially central orifice within which the turbine shaft is carried for rotation; and a plurality of noncentral orifices therein; and wherein an upstream portion of each of the tubes is affixed in one of the noncentral orifices of the second planar member and a downstream portion of each of the tubes extends at least partially through one of the fluid outlets, such that fluid flowing into the fluid inlet is directed through the tubes via the noncentral orifices.

23. The spray apparatus of claim 16, wherein the integrating member comprises stacked complementary upper and lower plates each having a plurality of slots therein, the slots of the upper plate overlying and being conversely oriented to respective slots of the lower plate so as to effect a plurality of common constricted slot areas through the upper and lower plates for engaging the respective coupled tubes by the extension of portions of the respective coupled tubes through the common slot areas, at least one of the complementary plates being rotatable with respect to the other of the complementary plates for moving the coupled tubes.

24. The spray apparatus of claim 23, wherein at least one of the complementary plates is rotatable with respect to the other of the complementary plates for moving the coupled tubes inwardly or outwardly with respect to the central axis.

25. The spray apparatus of claim 16, further comprising a second planar member sealingly mounted against rotation within the housing above the integrating member and comprising:

a substantially central orifice within which the turbine shaft is carried for rotation; and a plurality of noncentral orifices therein; and wherein an upstream portion of each of the tubes is affixed in one of the noncentral orifices of the second planar member and a downstream portion of each of the tubes extends at least partially through one of the fluid outlets, such that fluid flowing into the fluid inlet is directed through the tubes via the noncentral orifices.

26. The spray apparatus of claim 25, further comprising a third planar member supported for limited rotation about the central axis within the housing, the third planar member comprising a plurality of noncentral angularly-oriented slots for engaging portions of the respective coupled tubes intermediate the downstream and upstream portions thereof by the extension of the coupled tube portions through the plurality of noncentral slots of the third planar member, the third planar member being rotatable with respect to the housing for moving the coupled tube portions.

27. The spray apparatus of claim 26, wherein the third planar member is rotatable with respect to the housing for moving the coupled tube portions inwardly or outwardly with respect to the central axis.

28. The spray apparatus of claim 27, further comprising an actuator carried by the housing for rotating the third planar member.

29. The spray apparatus of claim 15, wherein the shaft is carried in the orifices of the integrating member and the turbine such that the turbine is rotationally supported by the integrating member.

30. The spray apparatus of claim 14, wherein the shaft is disposed for nutation within the orifice of the integrating member.

31. The spray apparatus of claim 14, wherein:

the turbine further comprises an eccentric portion carried about the shaft for rotation within the orifice of the integrating member, whereby spinning of the turbine about the axis of the shaft results in nutation of the turbine.

32. The spray apparatus of claim 14, wherein the shaft is a crankshaft having a first end portion mounted to the turbine head and a second end portion rotatably carried within the substantially central orifice in the first planar member, the second end portion being axially offset from the axis of the shaft by a bend in the crankshaft intermediate the first and second end portions.

33. The spray apparatus of claim 32, wherein:

the crankshaft is supported for rotation about a central axis within the housing by a second planar member sealingly mounted against rotation within the housing between the integrating member and the turbine head, the second planar member comprising:

a substantially central orifice within which the crankshaft is carried for rotation; and a plurality of noncentral orifices therein; and wherein an upstream portion of each of the tubes is affixed in one of the noncentral orifices of the second planar member and a downstream portion of each of the tubes extends at least partially through one of the fluid outlets, such that fluid flowing into the fluid inlet is directed through the tubes via the noncentral orifices.

34. The spray apparatus of claim 33, further comprising an adjustable manifold disposed within the housing above the second planar member for directing fluid from the inlet to one of:

an outer sub-plurality of the noncentral orifices of the second planar member;

an inner sub-plurality of the noncentral orifices of the second planar member; and a combination thereof.

35. The spray apparatus of claim 1, wherein the integrating member engages each of the coupled tubes at a similar location on each tube.

36. The spray apparatus of claim 35, wherein the engagement location is at or near a downstream portion of each coupled tube.

37. The spray apparatus of claim 35, wherein the engagement location is at or near an upstream portion of each coupled tube.

38. The spray apparatus of claim 37, wherein the integrating member comprises a plurality of orifices therein, and an upstream portion of each of the coupled tubes is affixed in one of the orifices of the integrating member.

39. The spray apparatus of claim 38, wherein a downstream portion of each of the tubes extends at least partially through one of the outlets, and each of the outlets is equipped with an O-ring through which a portion of each of the tubes intermediate the upstream and downstream portions is pivotally carried.

40. The spray apparatus of claim 39, further comprising a plurality of sleeves each fitted about one of the tubes intermediate the integrating member and the outlet through which the tube extends.

41. The spray apparatus of claim 35, wherein the engagement location is intermediate downstream and upstream portions of each coupled tube.

42. The spray apparatus of claim 1, wherein oscillating of the integrating member effects a coordinated oscillating of the downstream portion of each of the coupled tubes.

43. The spray apparatus of claim 42, wherein the oscillating of the downstream portion of each of the coupled tubes comprises at least one of circular, elliptical, and linear movement.

44. The spray apparatus of claim 1, wherein the tubes have downstream portions that extend at least partially through the respective fluid outlets, and further comprising a plurality of flexible nozzles each carried within the fluid outlets about respective downstream portions of the tubes.

45. The spray apparatus of claim 44, wherein the nozzles have internal profiles that are sized and shaped to effect a desired range of nozzle movement under movement of the downstream portions of the coupled tubes within the fluid outlets.

46. The spray apparatus of claim 44, wherein the downstream portions of the coupled tubes have external profiles that are sized and shaped to effect a desired range of nozzle movement upon movement of the downstream portions of the coupled tubes with respect to the fluid outlets.

47. The spray apparatus of claim 44, wherein movement of downstream portions of the coupled tubes within the flexible nozzles results in a generally conical fluid spray pattern for each nozzle.

48. The spray apparatus of claim 1, wherein the coupled tubes are integrally formed with the integrating member.

49. The spray apparatus of claim 1, wherein:

the integrating member is planar and is supported for rotation about a central axis within the housing; and wherein the integrating member comprises a plurality of angularly-oriented slots for engaging portions of the respective coupled tubes intermediate the upstream and downstream portions thereof by the extension of the coupled tube portions through the angularly-oriented slots, the integrating member being rotatable with respect to the housing for moving the coupled tube portions.

50. The spray apparatus of claim 49, further comprising an actuator carried by the housing for rotating the integrating member.

51. The spray apparatus of claim 1, further comprising an actuator for restricting oscillatory movement of the integrating member so as to restrict movement of the coupled tubes.

52. The spray apparatus of claim 14, wherein the turbine comprises:

an eccentric member carried about the turbine shaft opposite the turbine head such that the eccentric member rotates with the head, the eccentric member being carried within the orifice of the first planar member and being nutated by rotation of the turbine head to induce orbiting of the integrating member; and further comprising a means for selectively pointing downstream end portions of the plurality of tubes.

53. The spray apparatus of claim 52, wherein:

each of the coupled tubes comprises an elastomeric material;

the first planar member further comprises a plurality of noncentral orifices; and the pointing means comprises:

a set of spaced-apart protuberances on an outer surface of each of the coupled tubes defining a side recess between the protuberances, each of the coupled tubes being disposed in the noncentral orifices of the first planar member in such a manner that the first planar member is connected to the plurality of coupled tubes via the side recesses; and an internally-threaded sleeve carried for rotation about an externally-threaded sidewall portion of the housing, the sleeve having an annular groove formed in an inner surface thereof within which the first planar member is circumferentially carried, whereby rotation of the sleeve induces vertical movement thereof that applies a vertical force to the coupled tubes at the respective side recesses.

54. The spray apparatus of claim 22, wherein:

the housing defines a flow passage for communicating with the noncentral orifices of the second planar member; and further comprising:

a valve assembly for directing fluid in the flow passage to one of:

an outer sub-plurality of the noncentral orifices of the second planar member;

an inner sub-plurality of the noncentral orifices of the second planar member; and a combination thereof.

55. The spray apparatus of claim 54, wherein the valve assembly comprises:

a stop valve having a movable stem for closing portions of the flow passage; and an actuator for moving the stem as desired to direct the fluid flow.

56. The spray apparatus of claim 55, further comprising:

a third planar member for removably covering the inner sub-plurality of noncentral orifices of the second planar member, the third planar member having a sloped rim about at least a portion thereof; and wherein the movable valve stem is equipped with a plug, and a distal end, such that movement of the valve stem in a radially-inward direction results in the plug closing off a portion of the fluid passage communicating fluid to the outer sub-plurality of noncentral orifices of the second planar member and the distal end engaging the sloped rim so as to remove the third planar member from the inner sub-plurality of noncentral orifices of the second planar member.

57. The spray apparatus of claim 56, wherein movement of the valve stem in a radially-inward direction results in the distal end engaging the sloped rim so as to remove the third planar member from the inner sub-plurality of noncentral orifices of the second planar member, prior to the plug closing off a portion of the fluid passage communicating fluid to the outer sub-plurality of noncentral orifices of the second planar member.

58. The spray apparatus of claim 1, wherein the turbine comprises a head that is rotationally imbalanced.

59. A spray apparatus, comprising:

a housing having a fluid inlet;

a plurality of tubes for dispensing fluid from the housing;

an integrating member operatively coupled to at least a subset of the plurality of tubes for effecting coordinated movement of the coupled tubes in response to movement of the integrating member; and an actuator for inducing movement of the integrating member.

60. The spray apparatus of claim 59, wherein the integrating member comprises a plurality of angularly-oriented slots for engaging portions of the respective coupled tubes intermediate the upstream and downstream portions thereof by the extension of the coupled tube portions through the plurality of angularly-oriented slots, the integrating member being rotatable by the actuator with respect to the housing for moving the coupled tube portions.

61. The spray apparatus of claim 60, wherein the actuator comprises a slidable lever extending through a slot in a side wall of the housing, the lever having an inner portion that engages the integrating member and an outer portion disposed outside the housing.

62. A spray apparatus, comprising:

a housing having a fluid inlet and a plurality of fluid outlets;

a plurality of tubes each exclusively disposed in one of the fluid outlets for dispensing fluid from the housing;

an integrating member operatively coupled to at least a subset of the plurality of tubes for effecting coordinated movement of the coupled tubes in the respective plurality of fluid outlets in response to movement of the integrating member; and an actuator for inducing movement of the integrating member.

63. The spray apparatus of claim 62, wherein:

the actuator comprises a turbine carried for rotary movement within the housing under fluid flow from the fluid inlet to one or more of the fluid outlets; and the integrating member is operatively coupled to the turbine for oscillatory movement relative to the housing under rotary movement of the turbine.

64. The spray apparatus of claim 16, further comprising a second planar member sealingly mounted against rotation within the housing between the integrating member and the fluid inlet, the second planar member comprising:

a substantially central orifice within which the turbine shaft is carried for rotation;

a plurality of first orifices therein; and a plurality of second orifices therein; and wherein:

an upstream portion of each of the coupled tubes is affixed in one of the first orifices of the second planar member and a downstream portion of each of the coupled tubes extends at least partially through one of the fluid outlets, such that fluid flowing into the fluid inlet is directed through the coupled tubes via the first orifices; and a second portion of the tubes are not coupled to the integrating member, each of the non-coupled tubes having an upstream portion affixed in one of the second orifices of the second planar member and a downstream portion that extends at least partially through one of the fluid outlets, such that fluid flowing into the fluid inlet is directed through the non-coupled tubes via the second orifices.

65. The spray apparatus of claim 64, wherein:

the housing defines a flow passage for selectively communicating with the first and second orifices of the second planar member; and further comprising:

a valve assembly for directing fluid in the flow passage to one of:

the first orifices of the second planar member;

the second orifices of the second planar member; and a combination thereof.

66. A method of spraying fluid, comprising the steps of:

delivering pressurized fluid to a plurality of dispensing tubes;

coupling together at least a subset of the plurality of tubes so that the coupled tubes move in a coordinated fashion under an actuating force; and applying an actuating force to the coupled tubes to effect a desired fluid spray through the tubes.

67. A spray apparatus, comprising:

a housing having a fluid inlet;

an actuator carried for rotary movement within the housing under fluid flow from the fluid inlet;

an integrating member operatively coupled to the actuator for oscillatory movement relative to the housing under rotary movement of the actuator; and a plurality of tubes for dispensing fluid from the housing, at least a subset of the plurality of tubes being operatively-coupled to the integrating member for coordinated movement of the coupled tubes.

68. A spray apparatus, comprising:

a housing having a fluid inlet;

a plurality of tubes for dispensing fluid from the housing; and a means for converting energy from fluid delivered through the fluid inlet into coordinated movement of at least a subset of the plurality of tubes.

69. A spray apparatus, comprising:

a housing having a fluid inlet;

a plurality of flexible tubes for dispensing fluid from the housing;

an integrating member operatively coupled to at least a subset of the plurality of tubes for effecting coordinated movement of the coupled tubes in response to movement of the integrating member; and an actuator for inducing movement of the integrating member.

70. The spray apparatus of claim 69, wherein:

the actuator comprises a turbine carried for rotary movement within the housing under fluid flow from the fluid inlet; and the integrating member is operatively coupled to the turbine for oscillatory movement relative to the housing under rotary movement of the turbine, resulting in coordinated oscillatory movement of the coupled dispensing tubes.

71. The spray apparatus of claim 70, wherein:

the integrating member comprises a planar member having a substantially central orifice;

the turbine comprises an output shaft having a cam portion that extends at least partially through the central orifice of the planar member for operatively coupling the turbine to the integrating member.

72. The spray apparatus of claim 69, wherein integrating member is operatively coupled to at least a subset of the plurality of tubes at positions intermediate the ends of the respective coupled tubes.

73. The spray apparatus of claim 69, wherein integrating member is operatively coupled to at least a subset of the plurality of tubes at positions near dispensing ends of the respective coupled tubes.

74. The spray apparatus of claim 71, wherein:

the cam portion has a sloping profile; and further comprising:

a mechanism for adjusting the engagement position of the integrating member relative to the cam portion so as to induce engagement of the integrating member with varying portions of the sloping profile of the cam portion, whereby the range of oscillating of the integrating member resulting from rotation of the turbine may be adjusted.

75. The spray apparatus of claim 74, further comprising one or more focusing elements that transversely engage the periphery of the respective dispensing tubes, the focusing elements being displaced by the adjustment of the engagement position of the integrating member so as to adjust the fluid-dispensing direction of the dispensing tubes in a unified converging manner.

76. The spray apparatus of claim 75, wherein each focusing element comprises a flexible arm associated with one or more dispensing tubes, each focusing element being connected between a movable component of the spray apparatus and a fixed component of the spray apparatus.

77. The spray apparatus of claim 76, wherein:

the movable component is a movable outlet plate disposed beneath the planar member of the integrating member; and the fixed component is a planar member transversely-mounted within the housing above the integrating member.

78. The spray apparatus of claim 75, wherein each focusing element is associated with a sub-plurality of dispensing tubes that define a cluster.

79. The spray apparatus of claim 78, wherein each focusing element is operable to adjust the fluid-dispensing direction of the dispensing tubes of a cluster in a unified converging or diverging manner.

80. The spray apparatus of claim 78, wherein each focusing element is integrally formed with the integrating member.

81. The spray apparatus of claim 79, wherein each focusing element is operable to produce a high impact spray, a soft impact spray, or a combination thereof from its associated cluster.

82. The spray apparatus of claim 79, wherein the plurality of focusing elements are operable in a unified converging manner to produce a high impact shower, a soft impact shower, or a combination thereof from their respective clusters.

83. The spray apparatus of claim 70, wherein:

each coupled dispensing tubes is oscillated about a nominal position; and further comprising a mechanism for adjusting the nominal position of each of the dispensing tubes.

84. The spray apparatus of claim 83, wherein the housing is adapted for stationary mounting to a wall, and the position-adjusting mechanism operates independently of movement of the housing.

85. The spray apparatus of claim 69, wherein the housing is integrally formed with a handle for gripping by a user.

86. The spray apparatus of claim 69, wherein the housing is adapted for use in a kitchen faucet application.

87. A spray apparatus, comprising:

a housing having a fluid inlet;

a plurality of tubes for dispensing liquid from the housing;

an aerator for dispensing an air-liquid mixture from the housing;

an integrating member operatively coupled to at least a subset of the plurality of tubes for effecting coordinated movement of the coupled tubes in response to movement of the integrating member;

an actuator for inducing movement of the integrating member; and a valve assembly for regulating the flow of liquid between the dispensing tubes and the aerator.

88. The spray apparatus of claim 87, wherein the aerator is located centrally with respect to the dispensing tubes.

89. The spray apparatus of claim 87, wherein:

the actuator comprises a turbine carried for rotary movement within the housing under fluid flow from the fluid inlet; and the integrating member is operatively coupled to the turbine for oscillatory movement relative to the housing under rotary movement of the turbine.

90. The spray apparatus of claim 89, wherein:

the integrating member comprises a planar member having a substantially central orifice;

the turbine comprises an output shaft having a cam portion that extends at least partially through the central orifice of the planar member for operatively coupling the turbine to the integrating member.

91. The spray apparatus of claim 90, wherein:

the cam portion has a sloping profile; and further comprising:

a means for adjusting the engagement position of the integrating member relative to the cam portion so as to induce engagement of the integrating member with varying portions of the sloping profile of the cam portion, whereby the range of oscillating of the integrating member resulting from rotation of the turbine may be adjusted.

92. The spray apparatus of claim 87, wherein the dispensing tubes are flexible.

93. A spray apparatus, comprising:

a housing adapted for mounting within a wall space exposed by an opening in a wall, the housing having a fluid inlet for receiving a fluid supply conduit and an open end for alignment with the wall opening;

a face plate for engaging the open end of the housing, the face plate having a plurality of fluid outlets;

a plurality of tubes for dispensing fluid from the housing via the fluid outlets of the face plate;

an integrating member operatively coupled to at least a subset of the plurality of tubes for effecting coordinated movement of the coupled tubes in response to movement of the integrating member; and an actuator for inducing movement of the integrating member.

94. The spray apparatus of claim 93, wherein the actuator comprises a lever connected to the integrating member and extending through a slotted portion of the face plate for applying a sliding force to the integrating member.

95. The spray apparatus of claim 93, wherein:

the actuator comprises a turbine carried for rotary movement within the housing under fluid flow from the fluid inlet to one or more of the fluid outlets; and the integrating member is operatively coupled to the turbine for oscillatory movement relative to the housing under rotary movement of the turbine.

96. The spray apparatus of claim 94, wherein:

the integrating member comprises a planar member having a substantially central orifice;

the turbine comprises an output shaft having a cam portion that extends at least partially through the central orifice of the planar member for operatively coupling the turbine to the integrating member.

97. The spray apparatus of claim 96, wherein:

the cam portion has a sloping profile; and further comprising:

a means for adjusting the engagement position of the integrating member relative to the cam portion so as to induce engagement of the integrating member with varying portions of the sloping profile of the cam portion, whereby the range of oscillating of the integrating member resulting from rotation of the turbine may be adjusted.

98. The spray apparatus of claim 93, wherein the dispensing tubes are flexible.

99. A spray apparatus, comprising:

a receptacle box adapted for mounting within a wall space exposed by an opening in a wall, the box having a neck for receiving a fluid supply conduit in the wall space and an open end for alignment with the wall opening;

a housing for fitting with the receptacle box, the housing having an open end for alignment with the open end of the receptacle box and a fluid inlet defined by a nipple adapted for sealable fitting within the neck of the receptacle box;

a face plate for engaging the open end of the housing, the face plate having a plurality of fluid outlets;

a plurality of tubes for dispensing fluid from the housing via the fluid outlets of the face plate;

an integrating member operatively coupled to at least a subset of the plurality of tubes for effecting coordinated movement of the coupled tubes in response to movement of the integrating member; and an actuator for inducing movement of the integrating member.

100. The spray apparatus of claim 99, wherein the actuator comprises a lever connected to the integrating member and extending through a slotted portion of the face plate for applying a sliding force to the integrating member.

101. The spray apparatus of claim 99, wherein the dispensing tubes are flexible.

102. A spray apparatus, comprising:

a housing having a fluid inlet for conveying fluid to a chamber thereof, and an open end opposite the fluid inlet;

a plurality of tubes for dispensing fluid from the chamber of the housing;

an integrating member at least partially carried by the housing across the open end of the housing and having a plurality of orifices for passage of the plurality of tubes therethrough for effecting coordinated movement of the coupled tubes in response to movement of the integrating member; and an actuator for inducing movement of the integrating member.

103. The spray apparatus of claim 102, wherein:

the integrating member comprises a planar member; and the actuator comprises an adjustable control ring that at least partially carries the planar member.

104. The spray apparatus of claim 103, wherein the control ring is adjustably carried by the housing.

105. The spray apparatus of claim 104, further comprising a spring retainer for releasably securing the control ring in one or more positions with respect to the housing.

106. The spray apparatus of claim 103, wherein the integrating member is integrally formed with the control ring.

107. The spray apparatus of claim 102, wherein the dispensing tubes are flexible.

108. A dispensing tube for conducting fluid from a spray apparatus, comprising:

a tubular body; and an aerator plug for insertion in an end of the tubular body, the plug having one or more first passages for conducting water therethrough and one or more second passages for conducting air therethrough;

at least one of the body and the plug being adapted for connection to a portion of the spray apparatus.

109. The dispensing tube of claim 108, wherein the first passages employ a cross-sectional shape that is one of circular, axial, curvilinear, and a combination thereof.

110. The dispensing tube of claim 108, wherein the second passages employ a cross-sectional shape that is one of circular, axial, curvilinear, and a combination thereof.

111. The dispensing tube of claim 108, wherein the second passages are discrete from the first passages.

112. The dispensing tube of claim 108, wherein the tubular body is flexible.

113. A dispensing tube for conducting fluid from a spray apparatus, comprising:

a flexible tubular body having a non-uniform stiffness about its periphery, whereby the application of uniform lateral force about the periphery will produce non-uniform lateral flexing of the tubular body.

114. The dispensing tube of claim 113, wherein the non-uniform stiffness is provided by the tubular body having a non-uniform wall thickness about its periphery.

115. The dispensing tube of claim 113, wherein the non-uniform stiffness is provided by the tubular body having a non-uniform rib distribution about its periphery.

116. A dispensing tube for conducting fluid from a spray apparatus, comprising:

a flexible tubular body having a non-uniform stiffness along its length, whereby the application of lateral force to the tubular body will produce non-uniform flexing of the tubular body along its length.

117. The dispensing tube of claim 116, wherein the non-uniform stiffness is provided by the tubular body having a non-uniform wall thickness along its length.

118. The dispensing tube of claim 116, wherein the non-uniform stiffness is provided by the tubular body having a non-uniform rib distribution along its length.

119. A dispensing tube for conducting fluid from a spray apparatus, comprising:

a tubular body having an inlet for receiving fluid and an outlet for dispensing fluid, the tubular body being flexible along substantially its entire length, whereby the outlet of the tubular body may be easily pointed under the application of lateral force to the tubular body at one or more locations along the length of the tubular body.

120. The dispensing tube of claim 119, wherein the tubular body comprises a natural polymer, a synthetic polymer, or a combination thereof.

121. The dispending tubes of claim 119, further comprising a strap connected at or near the inlet of the tubular body for pivotally mounting the tubular body within the housing.

122. The dispensing tube of claim 121, wherein the strap is pivotally mounted to the tubular body.

123. The dispensing tube of claim 121, wherein the strap is flexible.

124. The dispensing tube of claim 121, wherein the strap is rigid over at least a substantial portion of its length.

125. The dispensing tube of claim 124, wherein the rigidity of the strap is provided by a reinforcing member.

What is claimed is:

1. A spray apparatus, comprising:

a housing having a fluid inlet and a plurality of fluid outlets;

a turbine carried for rotary movement within the housing under fluid flow from the fluid inlet to one or more of the fluid outlets;

an upstream structural member having a plurality of openings;

a downstream structural member having a plurality of openings;

one of the upstream structural member and the downstream structural member being operatively coupled to the turbine for oscillatory movement of the operatively coupled structural member relative to the housing under rotary movement of the turbine;

the other of the upstream structural member and the downstream structural member being secured to the housing; and a plurality of flexible tubes comprising an upstream portion affixed to the openings of the upstream structural member for fluid communication with the housing and a downstream portion extending through and operatively coupled to the openings of the downstream structural member for dispensing fluid from the housing, wherein the structural member operatively coupled to the turbine effects a coordinated oscillating of a dispensing direction of the flexible tubes.

2. The spray apparatus of claim 1, wherein:

the structural member operatively coupled to the turbine is the upstream structural member; and the structural member secured to the housing is the downstream structural member.

3. The spray apparatus of claim 1, wherein:

the structural member operatively coupled to the turbine is the downstream structural member; and the structural member secured to the housing is the upstream structural member.

4. The spray apparatus of claim 1, wherein the flexible tubes extend loosely through the openings in the downstream structural member.

5. The spray apparatus of claim 1, wherein the affixed upstream portion of the flexible tubes and the operatively coupled downstream portion of the flexible tubes facilitate an amplified fluid dispensing direction of the flexible tubes.

6. The spray apparatus of claim 1, wherein the flexible tubes are sufficiently flexible so as to allow for easy adjustment of the fluid dispensing direction by the application of a lateral force at one or more locations along the length of the flexible tubes.

7. The spray apparatus of claim 1, wherein the flexible tubes are sufficiently flexible so as to allow the flexible tubes to undergo smooth arcing bends from one portion of the flexible tubes to another portion of the flexible tubes.

8. The spray apparatus of claim 1, wherein the flexible tubes have nonuniform flexibility along the length of the flexible tubes.

9. The spray apparatus of claim 1, wherein the structural member operatively coupled to the turbine is coupled to the turbine by an eccentric cam.

10. A spray apparatus, comprising:

a housing having a fluid inlet and a plurality of fluid outlets;

a turbine carried for rotary movement within the housing under fluid flow from the fluid inlet to one or more of the fluid outlets;

an integrating member having a plurality of openings and being operatively coupled to the turbine for oscillatory movement of the integrating member relative to the housing under rotary movement of the turbine;

a planar member having a plurality of openings and being secured to the housing; and a plurality of flexible tubes comprising an upstream portion affixed to the openings of the integrating member for fluid communication with the housing and a downstream portion extending through and operatively coupled to the openings of the planar member for dispensing fluid from the housing, wherein the integrating member effects a coordinated oscillating of a dispensing direction of the flexible tubes.

11. The spray apparatus of claim 10, wherein the flexible tubes extend loosely through the openings in the planar member.

12. A spray apparatus, comprising:

a housing having a fluid inlet and a plurality of fluid outlets;

a turbine carried for rotary movement within the housing under fluid flow from the fluid inlet to one or more of the fluid outlets;

a planar member having a plurality of openings and being secured to the housing;

an integrating member having a plurality of openings and being operatively coupled to the turbine for oscillatory movement of the integrating member relative to the housing under rotary movement of the turbine; and a plurality of flexible tubes comprising an upstream portion affixed to the openings of the planar member for fluid communication with the housing and a downstream portion extending through and operatively coupled to the openings of the integrating member for dispensing fluid from the housing, wherein the integrating member effects a coordinated oscillating of a dispensing direction of the flexible tubes.

13. The spray apparatus of claim 12, wherein the flexible tubes extend loosely through the openings in the integrating member.

14. The spray apparatus of claim 12, wherein each of the flexible tubes has a proximal end that is sealingly disposed in fluid communication with one of the openings of the planar member.

15. The spray apparatus of claim 12, wherein the housing forms a water chamber and the integrating member is disposed outside the water chamber.

16. A spray apparatus, comprising:

a housing having a fluid inlet and a plurality of fluid outlets;

a turbine carried for rotary movement within the housing under fluid flow from the fluid inlet to one or more of the fluid outlets;

an integrating member being operatively coupled to the turbine for oscillatory movement of the integrating member relative to the housing under rotary movement of the turbine; and a plurality of flexible tubes comprising an upstream portion affixed to the openings of the integrating member for fluid communication with the housing and a downstream portion disposed in the fluid outlets for dispensing fluid from the housing, wherein the integrating member effects a coordinated oscillating of a dispensing direction of the flexible tubes.

17. The spray apparatus of claim 16, wherein the flexible tubes are disposed loosely in the fluid outlets.

18. The spray apparatus of claim 16, wherein the integrating member and the flexible tubes are integrally formed.

* * * * *